US011791585B2

(12) United States Patent
Muha et al.

(10) Patent No.: US 11,791,585 B2
(45) Date of Patent: Oct. 17, 2023

(54) HIGH SPEED, HIGH DENSITY CONNECTOR

(71) Applicant: FCI USA LLC, Etters, PA (US)

(72) Inventors: James J. Muha, Boiling Springs, PA (US); Scott Martin, Manchester, PA (US); Douglas M. Johnescu, York, PA (US); Gregory A. Hull, York, PA (US); Mark E. Lauermann, Harrisburg, PA
(Continued)

(73) Assignee: FCI USA LLC, Etters, PA (US)

( * ) Notice: Subject to any disclaimer, the term of this patent is extended or adjusted under 35 U.S.C. 154(b) by 25 days.

(21) Appl. No.: 17/794,578

(22) PCT Filed: Jan. 27, 2021

(86) PCT No.: PCT/US2021/015178

§ 371 (c)(1),
(2) Date: Jul. 21, 2022

(87) PCT Pub. No.: WO2021/154779

PCT Pub. Date: Aug. 5, 2021

(65) Prior Publication Data

US 2023/0107361 A1 Apr. 6, 2023

Related U.S. Application Data

(60) Provisional application No. 63/076,692, filed on Sep. 10, 2020, provisional application No. 62/966,517,
(Continued)

(51) Int. Cl.
*H01R 13/648* (2006.01)
*H01R 13/502* (2006.01)
(Continued)

(52) U.S. Cl.
CPC ..... *H01R 13/502* (2013.01); *H01R 13/6587* (2013.01); *H01R 43/18* (2013.01);
(Continued)

(58) Field of Classification Search
CPC ..... H01R 13/46; H01R 13/502; H01R 13/504;
(Continued)

(56) References Cited

U.S. PATENT DOCUMENTS 7,309,257 B1 12/2007 Minich
8,182,289 B2 5/2012 Stokoe et al.
(Continued)

OTHER PUBLICATIONS

International Preliminary Report on Patentability Chapter II mailed Apr. 1, 2022 in connection with International Application No. PCT/US2021/015073.
(Continued)

*Primary Examiner* — Khiem M Nguyen
(74) *Attorney, Agent, or Firm* — Wolf, Greenfield & Sacks, P.C.

(57) ABSTRACT

Electrical connectors for very high speed signals, including signals at frequencies at or above 112 GHz, with high density. Such connectors may be formed with fine features molded into portions of the connector housing to support closely spaced signal conductors. The signal conducts may nonetheless be accurately positioned, which leads to uniform impedance and other electrical characteristics that enable high frequency operation through the use of skeletal members that restrain bowing and twisting of housing components that position, directly or indirectly, the signal conductors. The skeletal members may be simply incorporated into the housing components by stamping a metal skeleton from a metal sheet in conjunction with one or more carrier strips. The housing component may be overmolded around the skeleton and then severed from the carrier strips.

20 Claims, 32 Drawing Sheets

(72) Inventors: (US); Jason John Ellison, Dillsburg, PA (US); Jan De Geest, Wetteren (BE); Charles Copper, Hummelstown, PA (US); Mark R. Gray, York, PA (US); William Tanis, Mechanicsburg, PA (US); Steven E. Minich, York, PA (US)

Related U.S. Application Data

(60) filed on Jan. 27, 2020, provisional application No. 62/966,528, filed on Jan. 27, 2020.

(51) Int. Cl.
*H01R 43/24* (2006.01)
*H01R 43/18* (2006.01)
*H01R 13/6587* (2011.01)

(52) U.S. Cl.
CPC ..... *H01R 43/24* (2013.01)

(58) Field of Classification Search
CPC ..... H01R 13/6581; H01R 13/6585; H01R 13/6586; H01R 13/6587; H01R 43/18; H01R 43/24
USPC ..... 439/607.23
See application file for complete search history.

(56) References Cited

U.S. PATENT DOCUMENTS

| | | | |
|---|---|---|---|
| 8,550,861 | B2 | 10/2013 | Cohen et al. |
| 9,065,230 | B2 | 6/2015 | Milbrand, Jr. |
| 9,225,083 | B2 | 12/2015 | Krenceski et al. |
| 9,257,778 | B2 | 2/2016 | Buck et al. |
| 9,831,588 | B2 | 11/2017 | Cohen |
| 9,923,309 | B1 | 3/2018 | Aizawa et al. |
| 9,985,389 | B1 | 5/2018 | Morgan et al. |
| 10,038,284 | B2 | 7/2018 | Krenceski et al. |
| 10,096,921 | B2 | 10/2018 | Johnescu et al. |
| 10,148,025 | B1 | 12/2018 | Trout et al. |
| 10,355,416 | B1 | 7/2019 | Pickel et al. |
| 10,446,983 | B2 | 10/2019 | Krenceski et al. |
| 10,965,063 | B2 | 3/2021 | Krenceski et al. |
| 2003/0162441 | A1 | 8/2003 | Nelson et al. |
| 2004/0224559 | A1 | 11/2004 | Nelson et al. |
| 2006/0068640 | A1 | 3/2006 | Gailus |
| 2006/0110977 | A1 | 5/2006 | Matthews |
| 2008/0248659 | A1 | 10/2008 | Cohen et al. |
| 2009/0124101 | A1 | 5/2009 | Minich et al. |
| 2010/0197149 | A1 | 8/2010 | Davis et al. |
| 2010/0221959 | A1 | 9/2010 | Pan |
| 2011/0067237 | A1 | 3/2011 | Cohen et al. |
| 2016/0134057 | A1 | 5/2016 | Buck et al. |
| 2018/0109043 | A1 | 4/2018 | Provencher et al. |
| 2019/0036256 | A1 | 1/2019 | Martens et al. |
| 2020/0251841 | A1 | 8/2020 | Stokoe et al. |
| 2021/0234314 | A1 | 7/2021 | Johnescu et al. |
| 2021/0234315 | A1 | 7/2021 | Ellison et al. |

OTHER PUBLICATIONS

International Preliminary Report on Patentability Chapter II mailed Apr. 5, 2022 in connection with International Application No. PCT/US2021/015048.

International Search Report and Written Opinion mailed Jul. 1, 2021 in connection with International Application No. PCT/US2021/015048.

International Search Report and Written Opinion mailed May 17, 2021 in connection with International Application No. PCT/US2021/015073.

International Search Report and Written Opinion mailed May 17, 2021 in connection with International Application No. PCT/US2021/015178.

202A

HIGH SPEED, HIGH DENSITY CONNECTOR

RELATED APPLICATIONS

This patent application is a 35 U.S.C. § 371 National Phase filing of International Application No. PCT/US2021/015178, filed on Jan. 27, 2021, entitled "HIGH SPEED, HIGH DENSITY CONNECTOR," which claims priority to and the benefit of U.S. Provisional Pat. Application Serial No. 62/966,517, filed Jan. 27, 2020 and entitled "HIGH SPEED, HIGH DENSITY CONNECTOR," which is hereby incorporated herein by reference in its entirety. PCT/US2021/015178 also claims priority to and the benefit of U.S. Provisional Pat. Application Serial No. 62/966,528, filed Jan. 27, 2020 and entitled "HIGH SPEED CONNECTOR," which is hereby incorporated herein by reference in its entirety. PCT/US2021/015178 also claims priority to and the benefit of U.S. Provisional Pat. Application Serial No. 63/076,692, filed Sep. 10, 2020 and entitled "HIGH SPEED CONNECTOR," which is hereby incorporated herein by reference in its entirety.

TECHNICAL FIELD

This patent application relates generally to interconnection systems, such as those including electrical connectors, used to interconnect electronic assemblies.

BACKGROUND

Electrical connectors are used in many electronic systems. It is generally easier and more cost effective to manufacture a system as separate electronic assemblies, such as printed circuit boards ("PCBs"), which may be joined together with electrical connectors. A known arrangement for joining several printed circuit boards is to have one printed circuit board serve as a backplane. Other printed circuit boards, called "daughterboards" or "daughtercards," may be connected through the backplane.

A known backplane is a printed circuit board onto which many connectors may be mounted. Conducting traces in the backplane may be electrically connected to signal conductors in the connectors so that signals may be routed between the connectors. Daughtercards may also have connectors mounted thereon. The connectors mounted on a daughtercard may be plugged into the connectors mounted on the backplane. In this way, signals may be routed among the daughtercards through the backplane. The daughtercards may plug into the backplane at a right angle. The connectors used for these applications may therefore include a right angle bend and are often called "right angle connectors."

In other system configurations, signals may be routed between parallel boards, one above the other. Connectors used in these applications are often called "stacking connectors" or "mezzanine connectors." In yet other configurations, orthogonal boards may be aligned with edges facing each other. Connectors used in these applications are often called "direct mate orthogonal connectors." In yet other system configurations, cables may be terminated to a connector, sometimes referred to as a cable connector. The cable connector may plug into a connector mounted to a printed circuit board such that signals that are routed through the system by the cables are connected to components on the printed circuit board.

Regardless of the exact application, electrical connector designs have been adapted to mirror trends in the electronics industry. Electronic systems generally have gotten smaller, faster, and functionally more complex. Because of these changes, the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

In a high density, high speed connector, electrical conductors may be so close to each other that there may be electrical interference between adjacent signal conductors. To reduce interference, and to otherwise provide desirable electrical properties, shield members are often placed between or around adjacent signal conductors. The shields may prevent signals carried on one conductor from creating "crosstalk" on another conductor. The shield may also impact the impedance of each conductor, which may further contribute to desirable electrical properties.

Other techniques may be used to control the performance of a connector. For instance, transmitting signals differentially may also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals.

In an interconnection system, connectors are attached to printed circuit boards. Typically, a printed circuit board is formed as a multi-layer assembly manufactured from stacks of dielectric sheets, sometimes called "prepreg." Some or all of the dielectric sheets may have a conductive film on one or both surfaces. Some of the conductive films may be patterned, using lithographic or laser printing techniques, to form conductive traces that are used to make interconnections between components mounted to the printed circuit board. Others of the conductive films may be left substantially intact and may act as ground planes or power planes that supply the reference potentials. The dielectric sheets may be formed into an integral board structure by heating and pressing the stacked dielectric sheets together.

To make electrical connections to the conductive traces or ground/power planes, holes may be drilled through the printed circuit board. These holes, or "vias", are filled or plated with metal such that a via is electrically connected to one or more of the conductive traces or planes through which it passes.

To attach connectors to the printed circuit board, contact "tails" from the connectors may be inserted into the vias or attached to conductive pads on a surface of the printed circuit board that are connected to a via.

SUMMARY

Embodiments of a high speed, high density interconnection system are described.

Some embodiments relate to a connector housing for holding a plurality of connector modules, each module comprising a plurality of conductive elements. The connector housing comprises at least one support member of a first material; and a portion of a second material different from the first material, the portion of the second material comprising a plurality of openings configured to hold the plurality of connector modules, wherein the second material encapsulates the at least one support member.

In some embodiments, the first material is a metal.

In some embodiments, the second material encapsulates the at least one support member such that the at least one support member is isolated from the conductive elements of the connector modules.

In some embodiments, the at least one support member comprises one or more holes filled with the second material.

In some embodiments, the at least one support member comprises a flange and an elongated member, and the portion of the second material comprises an outer wall encapsulating the flange and an inner wall encapsulating the elongated member.

In some embodiments, the portion of the second material comprises a feature configured to mate with a matching feature of a connector housing of a mating connector, and the feature comprises the flange of the at least one support member.

In some embodiments, the portion of the second material comprises a plurality of inner walls separated by a plurality of second openings configured to receive a plurality of connector modules of a mating connector.

Some embodiments relate to an electrical connector. The connector comprises a plurality of connector modules, each module comprising a plurality of conductive elements, each conductive element comprising a mating end, a mounting end opposite the mating end, and an intermediate portion extending between the mating end and the mounting end; and a housing comprising at least one support member of a first material and a second material overmolded on the at least one support member, the second material comprising a plurality of inner walls bounding a plurality of openings, wherein the mating ends of the plurality of conductive elements of the plurality of connector modules are exposed with the openings.

In some embodiments, the at least one support member is isolated from the conductive elements of the connector modules by the second material.

In some embodiments, the at least one support member comprises first and second flanges and an elongated member extending between the first flange and the second flange, and the second material comprises first and second outer walls encapsulating the first and second flanges respectively and an inner wall of the plurality of inner walls encapsulating the elongated member.

In some embodiments, each of the plurality of connector modules comprises one or more leadframe assemblies and a core member, each leadframe assembly comprises at least a portion of the plurality of conductive elements disposed in a column, and the one or more leadframe assemblies are attached to one or more sides of the core member.

In some embodiments, the plurality of inner walls extend in a first direction; the core member comprises a body and a mating portion adjacent the mating ends of the conductive elements of the one or more leadframe assemblies attached to the core member; and the mating portions of the core member comprise projections extending in a direction perpendicular to the first direction.

Some embodiments relate to a method of manufacturing a connector. The method comprises providing at least one support member held to a carrier strip by at least one tie bar; molding a material over the at least one support member in a mold having a first opening/closing direction, wherein the over molded material comprising a housing of the connector with at least one opening extending in a first direction through the housing parallel to the first opening/closing direction; severing the at least one tie bar; and attaching a connector module to the housing, wherein the connector module comprises a plurality of conductive elements with mating contact portions and the mating contact portions are exposed in an opening of the at least one opening.

In some embodiments, providing the support member comprises stamping and bending a metal sheet.

In some embodiments, molding the material over the at least one support member comprises filling the material into holes of a support member of the at least one support member.

In some embodiments, the method further comprises molding a core member of the connector module in a mold having a second opening/closing direction such that the core member comprises a body and features extending from the body in a second direction parallel to the second opening/closing direction and orthogonal to the first direction.

In some embodiments, the method further comprises attaching one or more leadframe assemblies to the core member with contact portions of conductive elements of the one or more leadframe assemblies adjacent the features of the core member.

In some embodiments, the housing comprises a channel extending in the first direction and inserting the connector module comprises sliding projecting portions of the core member in the channel.

In some embodiments, molding the core member comprises molding a lossy material over a shield.

In some embodiments, the lossy material forms at least a portion of the features extending in the second direction.

These techniques may be used alone or in any suitable combination. The foregoing summary is provided by way of illustration and is not intended to be limiting.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1B:
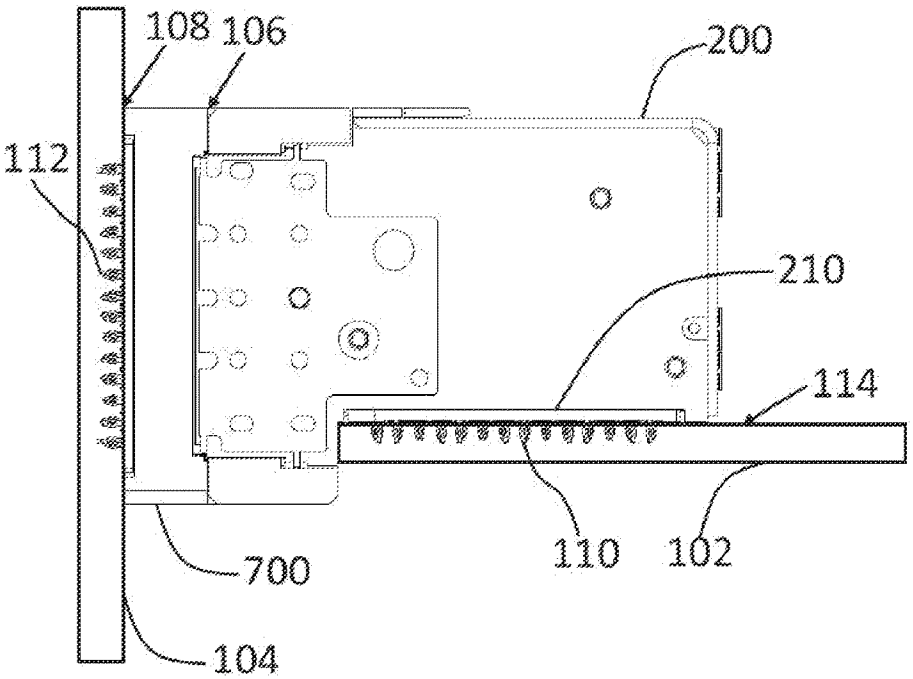
FIG. 1B is a side view of two printed circuit boards electrically connected through the connectors of FIG. 1A, according to some embodiments.

The inventors have recognized and appreciated connector designs that increase performance of a high density interconnection system, particularly those that carry very high frequency signals that are necessary to support high data rates. The connector designs may be simply constructed, using conventional molding processes for the connector housing, yet be mechanically robust and provide desirable performance at very high frequencies to support high data rates, including at 112 Gbps and above.

As one example, for high density interconnects, additional support may be incorporated into a molded component of a high density connector to prevent bowing and twisting of the component. The support may include members that form a skeleton for the component. Such a skeleton may be simply incorporated in the component using an insert molding operation. The skeleton, for example, may be cut and formed from a sheet of metal and retained on carrier strips, with one or more tie bars holding the support members in a desired position. Molding material may then be molded over the skeleton. Subsequently, the tie bars may be severed such that the molded component may be freed from the carrier strips.

Such a molded component may support and physically and/or electrically separate leadframe assemblies configured to support a high speed, high density interconnect. The leadframe assemblies, for example, may be closely spaced to provide a high density of signal conductors while also incorporating shielding and/or lossy material for maintaining the integrity of signals passing through the signal conductors. Such a molded component may be used, for example, as a front housing of a connector receiving improved leadframe assemblies as described herein.

As another example, the inventors have recognized and appreciated techniques to incorporate conductive shielding and lossy material in locations that enable operation at very high frequencies to support high data rates, for example, at or above 112 Gbps. To enable effective isolation of the signal conductors at very high frequencies, the connector may include conductive material coupled to selectively positioned lossy material. The conductive material may provide effective shielding in a mating region where two connectors are mated. When the two connectors are mated, the mating interface shielding may be disposed between mated portions of conductive elements carrying separate signals. The mating interface shielding of the connector may overlap with internal ground shielding of a mating connector and provide consistent shielding from the bodies of the connectors to their mating interface, which further reduces cross talk.

The inventors have further recognized techniques to connect shields within a connector to a ground plane of a printed circuit board to which the connector is mounted so as to reduce resonances and increase the integrity of signals passing through a connector. The connection may be made through mounting interface shielding, which may be compressible. The mounting interface shielding may include compressible members at selected, discrete locations. The compressible members may be configured to make physical contact with a flooded ground plane of a PCB. In some embodiments, the mounting interface shielding may be integrally formed with internal ground shields of the connector. As a specific example, mounting interface shielding suppresses a resonance that occurs at about 35 GHz, thereby increasing the frequency range of the connector.

The connector may include housing features configured to avoid mechanical stubbing of conductive elements of a connector with those in a mating connector. Each connector may have projections that, during a mating sequence, engages and deflects the tip of a conductive element from the mating connector. Such deflection increases the separation between the tips of the conductive elements to be mated, reducing the risk that those tips will mechanically stub, even with variability in position of those tips that might arise in the manufacture or use of the connectors. Further, this technique enables the tips to have only short segments between a contact point and the distal end of the conductive element, which provides for only a short stub extending past the contact point. As a stub might impact signal integrity at frequencies inversely proportional to its length, providing for a short stub ensures that any impact on signal integrity is at a high frequency, thereby providing for a large operating frequency range of the connector.

The connector may include contact tails configured for stably and precisely mounting to a printed circuit board with a high density footprint. A connector may have ground contact tails disposed between groups of signal contact tails. The signal contact tails may have smaller dimensions than the ground contact tails. Such configuration may provide benefits including, for example, reducing parasitic capacitance, providing a desired impedance of signal vias within the printed circuit board, and also reducing the size of the connector footprint. On the other hand, relatively larger ground contact tails may assist with precisely aligning the contact tails with corresponding contact holes on a printed circuit board and retaining the connector to the printed circuit board with sufficient attachment force.

In some embodiments, a connector may include conductive elements held in columns as leadframe assemblies. The leadframe assemblies may be aligned in a row direction. The leadframe assemblies may be attached to core members before inserting into a housing. The core member may include features that would be difficult to mold in an interior portion of a housing, including relatively fine features that are conventionally included at the mating interface of a connector. Such a design may enable the housing to have substantially uniform walls without complex and thin sections required by conventional connector housing to hold mating portions of conductive elements. Such a design may also allow using materials that previously would not have filled a conventional housing mold that includes the complex and thin geometry. Further, such a design may allow additional features that cannot be practically achieved with front-to-back coring used in molding of conventional connectors, such as a recess extending in a direction perpendicular to the columns and configured to protect contact tips.

The core member may have a body portion and a top portion. Body portions of leadframe assemblies may be attached to the body portions of the core members. A column of contact portions of the conductive elements, extending from the body portions of a leadframe assembly, may parallel the top portion of the core member. The top portion may be molded with fine features, including a long thin edge paralleling the tips of the conductive elements, which would be difficult to reliably mold as part of the housing.

In some embodiments, high frequency performance may be enabled by shielding throughout two mated connectors, which may both be formed with leadframe assemblies attached to core members. That shielding may extend from the mounting interfaces of a first connector to a first circuit board to which a first connector is mounted, through the first connector, through a mating interface to a second connector, through the body of the second connector and through a mounting interface of the second connector to a second circuit board to which the second connector is mounted. Shielding within the body portions of the leadframe assembly may be provided by shields attached to sides of the leadframe assemblies. At the mating interface, a shield may be in the interior of the top portion of the core member.

Effectiveness of the shielding may be increased by features that electrically connect the shield in the top portion of the core member to the shields of the leadframe assemblies. Further, features may be included to electrically couple the shields of the leadframe assemblies to ground planes on a surface of the printed circuit boards to which the connectors are mounted. In some embodiments, that electrical coupling may be formed with tines extending toward the printed circuit board and that are selectively positioned in regions of high electromagnetic radiation.

For example, in some embodiments, each leadframe assembly may include a signal leadframe and at least one ground plate. In some embodiments, the leadframe may be sandwiched by two ground plates. The mounting interface shielding for the connector may be formed by compressible members extending from the ground plates. The signal leadframe may include pairs of signal conductive elements. The compressible members extending from the ground plates may be positioned in groups. Each group of compressible members may at least partially surround a pair of signal conductive elements.

Further, the shield in the top portion of the core member may be electrically coupled to ground conductive elements in the leadframe assemblies. This coupling may be made through lossy material, which suppresses resonances that might otherwise occur as a result of distal ends of the top shields, away from connections to other grounded structures.

In some embodiments, intermediate portions of signal conductive elements within the bodies of the leadframe assemblies are shielded on two sides by leadframe assembly shields but contact portions are adjacent to only one top shield within the top portion of the core member. However, two-sided shielding may be provided throughout the signal path through two mated connectors. At the mating interface, mated contact portions of two mating connectors will be bounded on each of two sides by a top portion of the core members of one of the connectors. Thus, each contact portion will be bounded on two sides by a top shield, one from the connector of which it is a part and one from the connector to which it is mated. Providing shielding in the same configuration, such as two-sided shielding, throughout the signal path enables high integrity signal interconnects, as mode conversions and other effects that can degrade signal integrity at the transition between shielding configurations are avoided.

Such shielding may be simply and reliably formed in each of the multiple regions of the interconnection system. In some embodiments, a core member may be formed by a two-shot process. In the first shot, lossy material may be molded. In some embodiments, the lossy material may be selectively molded over conductive material. In the second shot, the lossy material may be selectively over molded with insulative material.

The foregoing techniques may be used singly or together in any suitable combination.

Figure 1A:
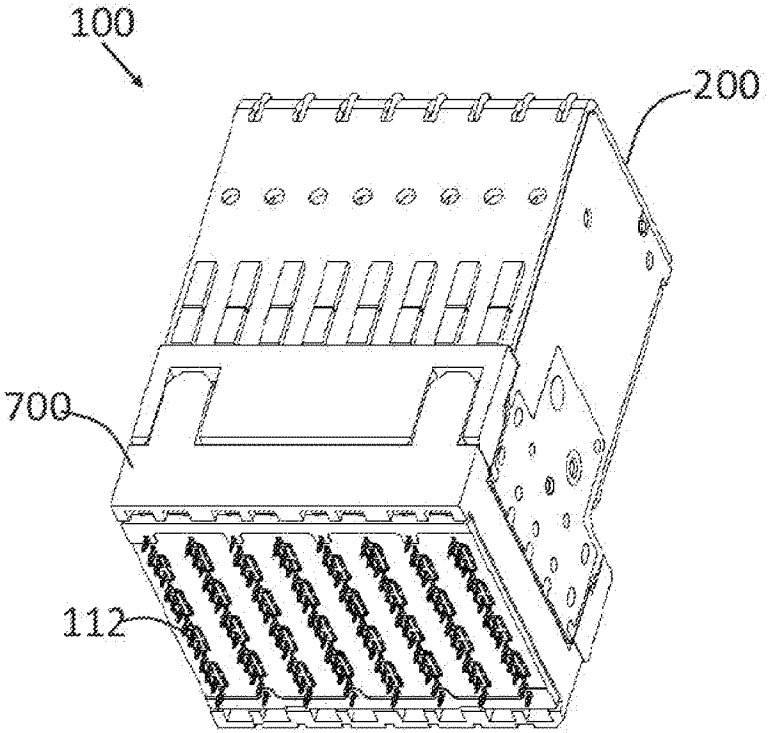
FIG. 1A is a perspective view of a header connector mated to a complementary right angle connector, according to some embodiments.

An exemplary embodiment of such connectors is illustrated in FIGS. 1A and 1B. FIGS. 1A and 1B depict an electrical interconnection system 100 of the form that may be used in an electronic system. Electrical interconnection system 100 may include two mating connectors, here illustrated as a right angle connector 200 and a header connector 700.

In the illustrated embodiment, the right angle connector 200 is attached to a daughtercard 102 at a mounting interface 114, and mated to the header connector 700 at a mating interface 106. The header connector 700 may be attached to a backplane 104 at a mounting interface 108. At the mounting interfaces, conductive elements, acting as signal conductors, within the connectors may be connected to signal traces within the respective printed circuit boards. At the mating interfaces, the conductive elements in each connector make mechanical and electrical connections such that the conductive traces in the daughtercard 102 may be electrically connected to conductive traces in the backplane 104 through the mated connectors. Conductive elements acting as ground conductors within each connector may be similarly connected, such that the ground structures within the daughtercard 102 similarly may be electrically connected to ground structures in the backplane 104.

To support mounting of the connectors to respective printed circuit boards, right angle connector 200 may include contact tails 110 configured to attach to the daughtercard 102. The header connector 700 may include contact tails 112 configured to attach to the backplane 104. In the illustrated embodiment, these contact tails form one end of conductive elements that pass through the mated connectors. When the connectors are mounted to printed circuit boards, these contact tails will make electrical connection to conductive structures within the printed circuit board that carry signals or are connected to a reference potential. In the example illustrated, the contact tails are press fit, "eye of the needle (EON)," contacts that are designed to be pressed into vias in a printed circuit board, which in turn may be connected to signal traces, ground planes or other conductive structures within the printed circuit board. However, other forms of contact tails may be used, for example, surface mount contacts, or pressure contacts.

Figure 2B:
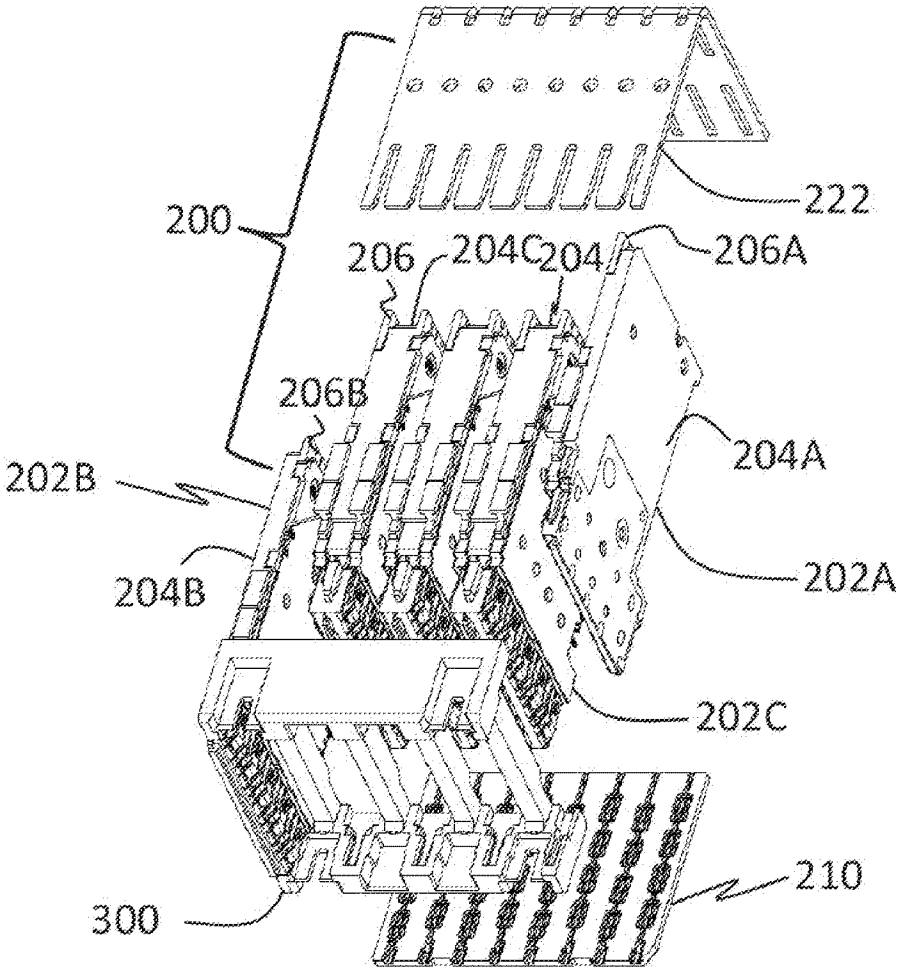
FIG. 2B is an exploded view of the right angle connector of FIG. 2A, according to some embodiments.
Figure 2A:
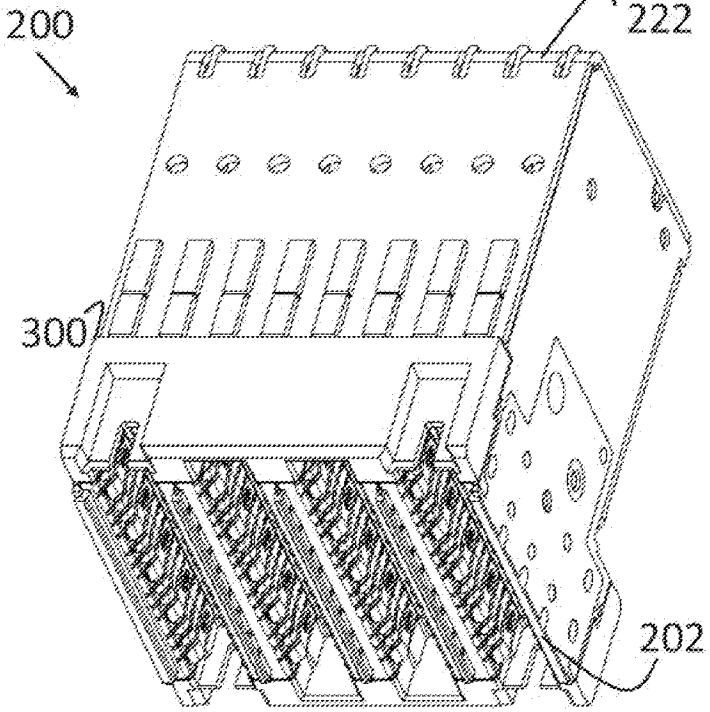
FIG. 2A is a perspective view of the right angle connector of FIG. 1A, according to some embodiments.

FIGS. 2A and 2B depict a perspective view and exploded view, respectively, of the right angle connector 200, according to some embodiments. The right angle connector 200 may be formed from multiple subassemblies, which in this example are T-Top assemblies, aligned side-by-side in a row. A T-Top assembly may include a core member 204 and at least one leadframe assembly 206 attached to the core member. These components may be configured individually for simple manufacture and to provide high frequency operation when assembled, as described in more detail below.

In the example of FIG. 2B, three types of T-Top assemblies are illustrated. T-Top assembly 202A is at a first end of the row, and T-Top assembly 202B is at a second end of the row. A plurality of a third type of T-Top assemblies 202C are positioned within the row between the T-Top assemblies 202A and 202B. The types of T-Top assemblies may differ in the number and configuration of leadframe assemblies.

A leadframe assembly may hold a column of conductive elements forming signal conductors. In some embodiments, the signal conductors may be shaped and spaced to form single ended signal conductors (e.g., 208A in FIG. 2C). In some embodiments, the signal conductors may be shaped and spaced in pairs to provide pairs of differential signal conductors (e.g., 208B in FIG. 2C). In the embodiment illustrated, each column has four pairs and one single-ended conductor, but this configuration is illustrative and other embodiments may have more or fewer pairs and more or fewer single ended conductors.

The column of signal conductors may include or be bounded by conductive elements serving as ground conductors (e.g., 212). It should be appreciated that ground conductors need not be connected to earth ground, but are shaped to carry reference potentials, which may include earth ground, DC voltages or other suitable reference potentials. The "ground" or "reference" conductors may have a shape different than the signal conductors, which are configured to provide suitable signal transmission properties for high frequency signals.

In the embodiment illustrated, signal conductors within a column are grouped in pairs positioned for edge-coupling to support a differential signal. In some embodiments, each pair may be adjacent at least one ground conductor and in some embodiments, each pair may be positioned between adjacent ground conductors. Those ground conductors may be within the same column as the signal conductors.

In some embodiments, a T-Top assembly may alternatively or additionally include ground conductors that are offset from the column of signal conductors in a row direction, which is orthogonal to the column direction. Such ground conductors may have planar regions, which may separate adjacent columns of signal conductors. Such ground conductors may act as electromagnetic shields between columns of signal conductors.

Conductive elements may be made of metal or any other material that is conductive and provides suitable mechanical properties for conductive elements in an electrical connector. Phosphor-bronze, beryllium copper and other copper alloys are non-limiting examples of materials that may be used. The conductive elements may be formed from such materials in any suitable way, including by stamping and/or forming.

The insert molded leadframe assemblies may be constructed by stamping conductive elements from a sheet of metal. Curves and other features of the conductive elements may also be formed, as part of the stamping operation or in a separate operation. The signal conductors and ground conductors of a column may be stamped from a sheet of metal, for example. In the stamping operation, portions of the metal sheet, serving as tie bars between the conductive elements, may be left to hold the conductive elements in position. The conductive elements may be overmolded by plastic, which in this example is insulative and serves as a portion of the connector housing, which holds the conductive elements in position. The tie bars may then be severed.

In some embodiments, the signal and ground conductors of the leadframe may be held stable by pinch pins. The pinch pins may extend from the surfaces of a mold used in the insert molding operation. In a conventional insert molding operation, pinch pins from opposing sides of a mold may pinch signal conductors and ground conductors between them. In this way, the position of the signal and ground conductors with respect to the insulative housing molded over them is controlled. When the mold is opened, and the IMLA is removed, holes (e.g., holes 550 in FIG. 5P) in the insulative housing in the locations of the pinch pins remain. These holes are generally regarded as non-functional for the completed IMLA as they are made with pins that are of small enough diameter that they do not materially impact the electrical properties of the signal conductors.

In some embodiments, however, the number of pinch pins pinching each signal conductor may be selected so as to provide a functional benefit. As a specific example, in a conventional connector the number of pinch pins, and the resulting number of pinch pin holes, may be the same for each signal conductors of a pair of adjacent signal conductors. In some connectors, such as right angle connectors, one of the signal conductors of a pair may be longer than the other. More pinch pins may be used for the longer signal conductor of each pair. More pinch pins results in more pinch pin holes and a lower effective dielectric constant of the housing along the length of the longer signal conductor, as compared to the shorter. This configuration may result in more pinch pin holes along the longer conductor than is needed, but may also reduce intrapair skew and otherwise improve performance of the connector.

In some embodiments, the conductive elements in different ones of the leadframe assemblies may be configured differently. In this example, there are two types of leadframes assemblies, differing in the position of the signal and ground conductors within the column such that, when the two types of leadframe assemblies are positioned side by side, a ground conductive element in one leadframe assembly (e.g., Type-A IMLA 206A) is adjacent a signal conductive element in the other leadframe assembly (e.g., Type-B IMLA 206B). In the illustrated example, Type-A IMLAs are positioned to the left of a core member (when the connector is viewed from a perspective looking toward the mating interface). Type-B IMLAs are positioned to the right of a core member. This configuration may reduce the column-to-column cross talk between leadframe assemblies.

In the illustrated embodiment, the right angle connector 200 includes a single Type-A IMLA T-Top assembly 202A at a first end of a row that the T-Top assemblies 202 align along, a single Type-B IMLA T-Top assembly 202B at a second end of the row, opposite the first end of the row, and multiple dual IMLA T-Top assemblies 202C between the first and second ends. The Type-A IMLA T-Top assembly 202A has a single leadframe assembly 206A attached to a core member. The Type-B IMLA T-Top assembly 202B has a single leadframe assembly 206B attached to a core member. Accordingly, each of the Type-A IMLA T-Top assembly and the Type-B IMLA T-Top assembly has a side not attached with a leadframe assembly. This configuration allows using the open sides of the core members of the Type-A IMLA T-Top assembly 202A and the Type-B IMLA T-Top assembly 202B as part of the connector housing.

A core member of a dual IMLA T-Top assembly 202C may have two leadframe assemblies, here a Type-A IMLA and a Type-B IMLA, attached to opposite sides of the core member. In some embodiments, the conductive elements in the two leadframe assemblies may be configured the same.

One or more members may hold the T-Top assemblies in a desired position. For example, a support member 222 may hold top and rear portions, respectively, of multiple T-Top assemblies in a side-by-side configuration. The support member 222 may be formed of any suitable material, such as a sheet of metal stamped with tabs, openings or other features that engage corresponding features on the individual T-Top assemblies. As another example, support members may be molded from plastic and may hold other portions of the T-Top assemblies and serve as a portion of the connector housing, such as front housing 300.

Figure 2D:
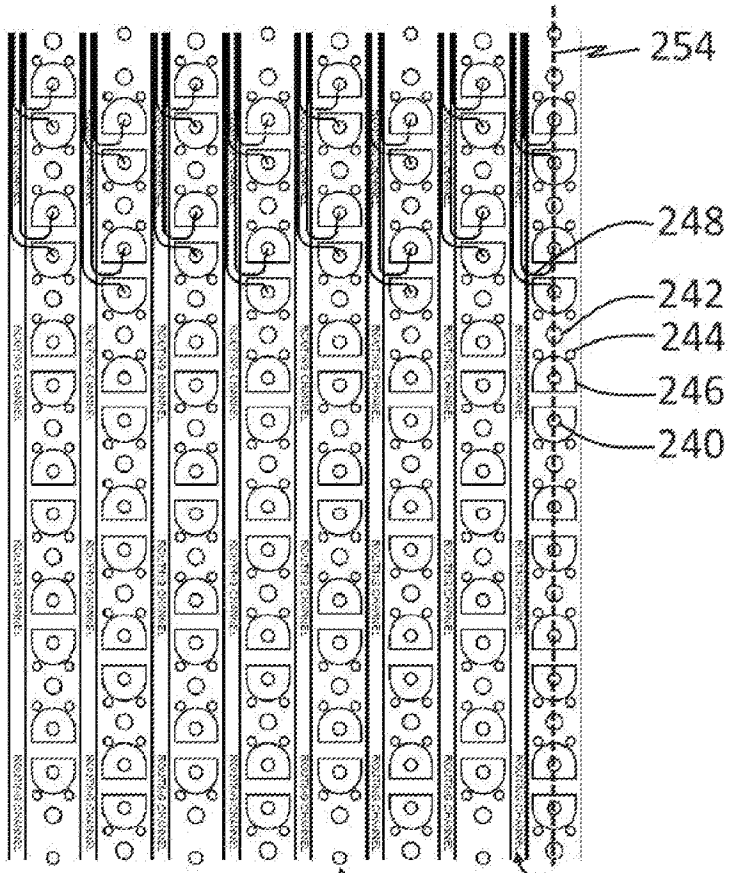
FIG. 2D is a top, plan view of a complimentary footprint for the right angle connector of FIG. 2C, according to some embodiments.
Figure 2C:
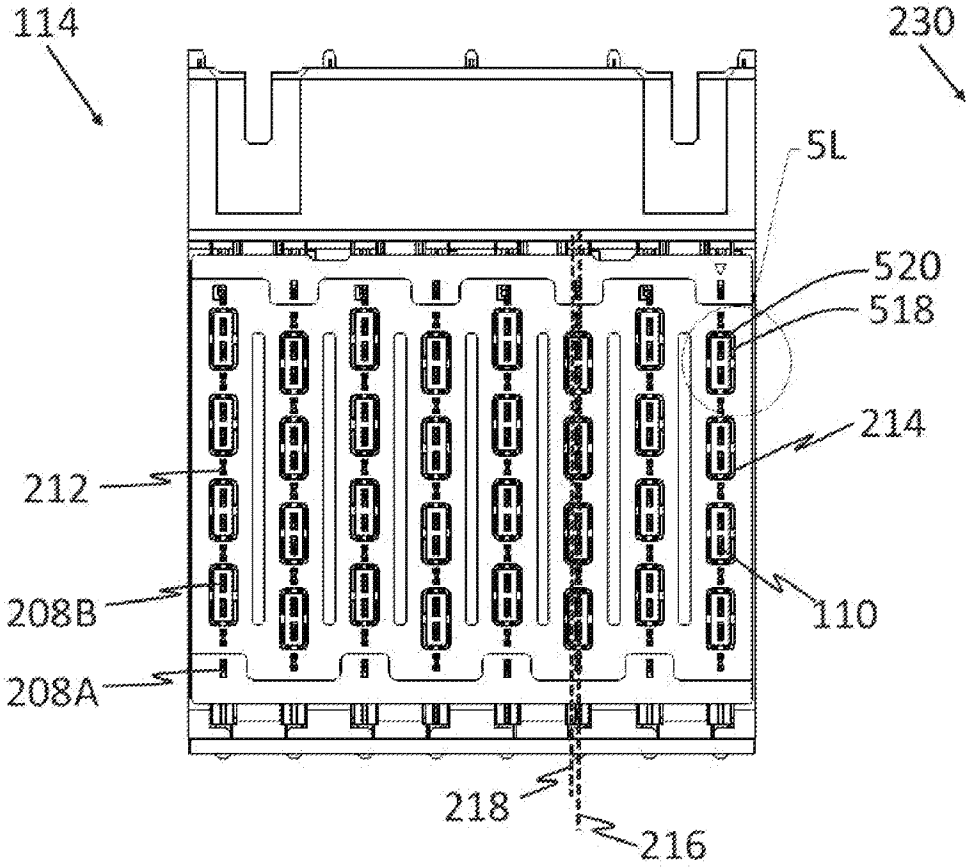
FIG. 2C is a plan view of the right angle connector of FIG. 2A, illustrating a mounting interface of the right angle connector, according to some embodiments.

FIG. 2C depicts the mounting interface 114 of the right angle connector 200, according to some embodiments. The contact tails 110 of the connector 200 may be arranged in an array including multiple parallel columns 216, offset from one another in a row direction, perpendicular to the column direction. Each column 216 of contact tails 110 may include ground contact tails 212 disposed between pairs of signal contacts 208B. In some embodiments, all or a portion of the signal contacts 208B may be manufactured thinner than the ground contacts. Thinner signal contacts may provide a desired impedances. The ground contact tails 212 may be thicker in order to provide good mechanical strength.

In some embodiments, the signal contacts may be formed in the same leadframe by stamping a sheet of metal into the desired shape. Nonetheless, all or portions of the signal contacts may be thinner than the ground contacts by reducing their thickness, such as by coining the signal contacts. In some embodiments, the signal contacts may be between 75 and 95% of the thickness of the ground contacts. In other embodiments, the signal contacts may be between 80% and 90% of the thickness of the ground contacts.

In some embodiments, intermediate portions of the signal contacts may be the same thickness as intermediate portions of the ground contacts. The tails of the signal contacts nonetheless may be of reduced thickness. In an embodiment in which the tails of the signal contacts are configured for press fit mounting, such a configuration may enable the tails of the signal contacts to fit within relatively small holes. The holes, for example, may be formed with a drill of 0.3 mm to 0.4 mm diameter, or 0.32 mm to 0.37 mm, such as a 0.35 mm drill. The finished hole size may be 0.26 mm +/- 10%. In contrast, the ground tails may be inserted into a larger hole. For example, the hole might be formed with a 0.4 mm to 0.5 mm drill, such as a 0.45 mm drill, with a finished diameter of 0.31 mm to 0.41 mm, for example. The contact tails may be configured with a width larger than the finished diameter of the respective holes into which they are inserted and to be compressible to a width that is the same as or smaller than the finished hole diameter.

Forming contact tails with these dimensions may reduce parasitic capacitance between signal conductors and adjacent grounds in an assembly in which such a connector is used, for example. Nonetheless, the grounds may provide sufficient attachment force to retain the connector on a printed circuit board to which the connector is mounted. Further, by stamping the signals and grounds, though of different finished thicknesses, from the same sheet of metal, precise positioning of the signal tails relative to ground tails may be provided. Positions of the signal contact tails, for example, may be within 0.1 mm or less of their designed position, as measured relative to position of the tails of the ground contacts. Such a configuration simplifies attachment of the connector to the printed circuit board. The more robust ground contact tails may be used to align the connector with respect to the printed circuit board by engaging their respective holes. The signal contact tails will then be sufficiently aligned with their respective holes to enter the holes with little risk of damage when the connector is pressed into the board. As a result, the connector may be mounted with a simple tool that presses the connector perpendicularly with respect to the printed circuit board, without the need for expensive fixtures or other tooling.

The ground contact tails and/or signal contact tails may be configured to support mounting of the connector to a printed circuit board in this way. As is visible, for example in FIG. 5I, the ground contacts tails, may be longer than the signal contact tails. The ground contacts may be longer by an amount such that they enter their respective holes in the printed circuit board before the tips of the signal contacts reach a plane parallel to the surface of the printed circuit board. In the embodiment illustrated, the contact tails taper towards the tips. In the illustrated embodiment, the ground contact tails have a body with an opening therethrough, which enables compression of the tail upon insertion into a hole. The distal portion of the tail is elongated such that it is narrower than the body and may readily enter a hole on a printed circuit board. The signal contacts have a shorter elongated portion at their distal ends.

The connector 200 may include a mounting interface shielding interconnects 214 configured to make electrical connections, for at least high frequency signals, between the ground conductors acting as shields between columns of signal conductors within the connector and ground structures with the PCB to which the connector is mounted. Shielding interconnects 214 are adjacent to and/or make contact with a flooded ground plane of the daughtercard 102. In this example, the mounting interface shielding interconnects 214 include a plurality of tines 520 configured to be adjacent to and/or make physical contact with the flooded ground plane of the daughtercard.

The tines 520 may be positioned to also reduce radiated emissions at the mounting interface 114. In some embodiments, the tines 520 may be arranged in an array including columns 218. Neighboring columns 216 of the contact tails 110 may be separated by one or more columns 218 of the tines 520 of the interface shielding interconnect 214. The tines 520 may have a portion in a same plane as a body of a ground conductor acting as a shield between columns within the connector. Accordingly, a portion of the tines 520 may be offset from the contact tails 110 in a row direction that is perpendicular to the column direction. Additionally, each of the tines may include a portion that is bent out of that plane towards to column of signal conductors. That portion of the tines 520 may be positioned between a ground contact tail 212 and a signal contact tail 208B.

In some embodiments, the mounting interface shielding interconnect 214 may be compressible. A compressible interconnect may generate a force that makes a reliable contact to the ground plane on the printed circuit board, such as by generating contact force and/or enabling contact to be made despite tolerance in the position of the connector with respect to the surface of the printed circuit board. In some embodiments, some or all of the tines 214 may make physical contact with the daughtercard 102 when the connector 200 is mounted to the daughtercard 102. Alternatively or additionally, some or all of the tines 214 may be capacitively coupled to the ground plane on daughtercard 102 without physical contact and/or a sufficient number of the tines 214 may be coupled to the ground plane to achieve the desired effect.

In some embodiments, the mounting interface shielding interconnect 214 may extend from internal shields of the connector 200 and may be formed integrally with the internal shields of the connector 200. In some embodiments, the mounting interface shielding interconnect 214 may be formed by compressible members extending from internal shields of the leadframe assemblies 206, for example, compressible members 518 illustrated in FIG. 5I and/or may be a separate compressible member.

FIG. 2D depicts, partially schematically, a top view of a footprint 230 on the daughtercard 102 for the right angle connector 200, according to some embodiments. The footprint 230 may include columns of footprint patterns 252 separated by routing channels 250. A footprint pattern 252 may be configured to receive mounting structures of a leadframe assembly (e.g., contacts tails 110 and compressible members 518 of a leadframe assembly 206).

The footprint pattern 252 may include signal vias 240 aligned in a column 254 and ground vias 242 aligned to the column 254. The ground vias 242 may be configured to receive contact tails from ground conductive elements (e.g., 212). The signal vias 240 may be configured to receive contact tails of signal conductive elements (e.g., 208A, 208B). As illustrated, the ground vias 242 may be larger than the signal vias 240. When a connector is being mounted to a board, larger and more robust ground contact tails may align the connector with the bigger ground vias. This aligns the signal contact tails with the smaller signal vias. This configuration may increase the economics of an electronic assembly by, for example, enabling a conventional mounting method such as press fit with flat-rock tooling, and avoiding expensive special tooling that might otherwise be necessary to mount the connector to the printed circuit board without damage to the thinner signal contact tails that might otherwise be susceptible to damage.

The signal vias 240 may be positioned in respective anti-pads 246. The printed circuit board may have layers containing large conductive regions interspersed with layers patterned with conductive traces. The traces may carry signals and the layers that predominately sheets of conductive material may serve as grounds. Anti-pads 246 may be formed as openings in the ground layers such that the electrically conductive material of a ground layer of the PCB is not connected to the signal vias. In some embodiments, a differential pair of signal conductive elements may share one anti-pad.

Figure 5B:
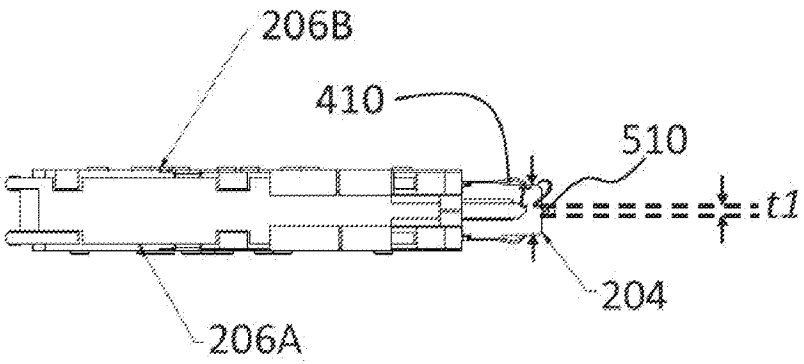
FIG. 5B is a top view of the dual IMLA assembly of FIG. 5A, illustrating Type-A and Type-B IMLAs attached to opposite sides of a core member, according to some embodiments.
Figure 5A:
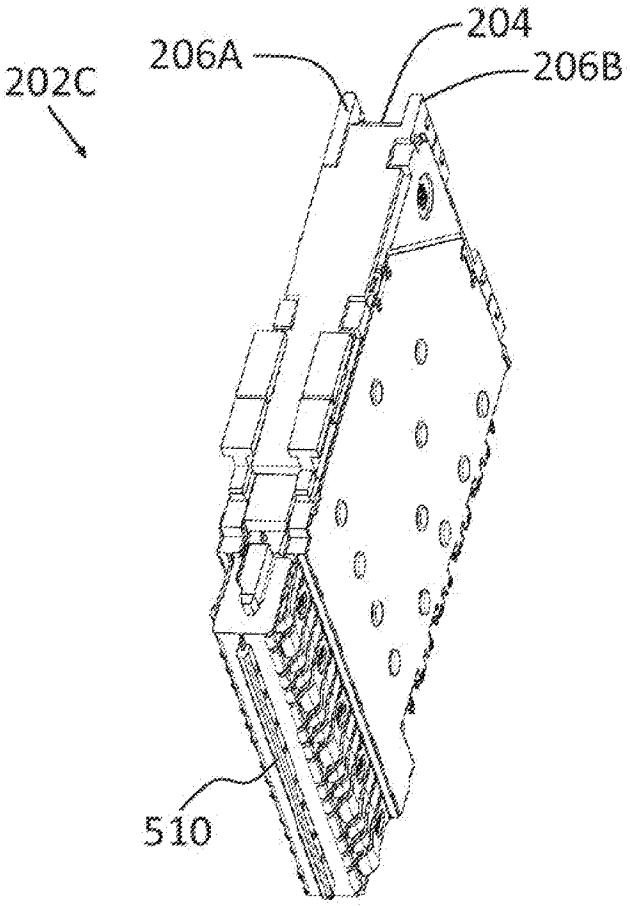
FIG. 5A is a perspective view of a dual insert-molded-leadframe-assembly (IMLA) assembly, according to some embodiments.

The via pattern 252 may include ground vias 244 for the compressible members 518 of the mounting interface shielding interconnect 214. In some embodiments, the ground vias 244 may be shadow vias configured to enhance electrical connection between internal shields of the connector to the PCB, without receiving ground contact tails. In some embodiments, the shadow vias may be below and/or be compressed against by the compressible members 518, for example, by the tines 520 of the compressible members 518 (FIG. 5K). The ground vias 244 may be sized and positioned to provide enough space between footprint patterns 252 such that traces 248 can run in the routing channel 250. In some embodiments, the ground vias 244 may be offset from the column 254. In some embodiments, the ground vias 244 may be within a width of the anti-pads 246 such that the width of the anti-pads 246 defines the width of the column footprint pattern 252.

It should be appreciated that although some structures such as the traces 248 are illustrated for some of the signal vias, the present application is not limited in this regard. For example, each signal via may have corresponding breakouts such as traces 248.

FIG. 2D shows some of the structures that may be in a PCB, including structures that might be visible on the surface of the printed circuit board and some that might be in the interior layers of the PCB. For example, the anti-pads 246 may be formed in a ground plane on a surface of a printed circuit board and/or may be formed in some or all of the ground planes in the inner layers of the PCB. Moreover, even if formed on the surface of the PCB, the ground plane might be covered by a solder mask or coating such that it is not visible. Likewise, traces 248 may be on one or more inner layers.

Referring back to FIG. 1B and FIG. 2B, the connector 200 may include an organizer 210, which may be configured to hold the contact tails 110 in an array. The organizer 210 may include a plurality of openings that are sized and arranged for some or all of the contact tails 110 to pass through them. In some embodiments, the organizer 210 may be made of a rigid material and may facilitate alignment of the contact tails in a predetermined pattern. In some embodiments, the organizer may reduce the risk of damage to contact tails when the connector is mounted to a printed circuit board by limiting variations in the positions of the contact tails to the locations of the slots, which may be reliably positioned.

An organizer may be used in conjunction with thin and/or narrow signal contact tails, as described elsewhere herein. In some embodiments, the organizer may be used in conjunction with a leadframe in which ground contact tails position are used to position the leadframe with respect to a printed circuit board. In the illustrated embodiment, the openings are elongated in a column direction. The openings may be sized to provide greater limitation on movement of the contact tails in a direction perpendicular to the column direction than in the column direction. The openings may ensure alignment, in a direction perpendicular to the column direction, of the contact tails with openings in the printed circuit board. As described above, alignment of the ground contacts in a leadframe assembly with holes in the printed circuit board may lead to alignment in the column direction of all of the contact tails in the leadframe assembly. In combination, these two techniques may provide accurate alignment in two dimensions of the contact tails with holes of the printed circuit board, enabling thin and narrow signal contact tails, with correspondingly small diameter signal holes in the printed circuit board with low risk of damage.

In some embodiments, the organizer may reduce airgaps between the connector and the board, which can cause undesirable changes in impedance along the length of conductive elements. An organizer may also reduce relative movement among the T-Top assemblies 202. In some embodiments, the organizer 210 may be made of an insulative material and may support the contact tails 110 as a connector is being mounted to a printed circuit board or keep the contact tails 110 from being shorted together. In some embodiments, the organizer 210 may include lossy material to reduce degradation in signal integrity for signals passing through the mounting interface of the connector. The lossy material may be positioned to be connected to or preferentially couple to ground conductive elements passing from the connector to the board. In some embodiments, the organizer may have a dielectric constant that matches the dielectric constant of a material used in the front housing 300 and/or the core member 204 and/or the leadframe assemblies 206.

Figure 2G:
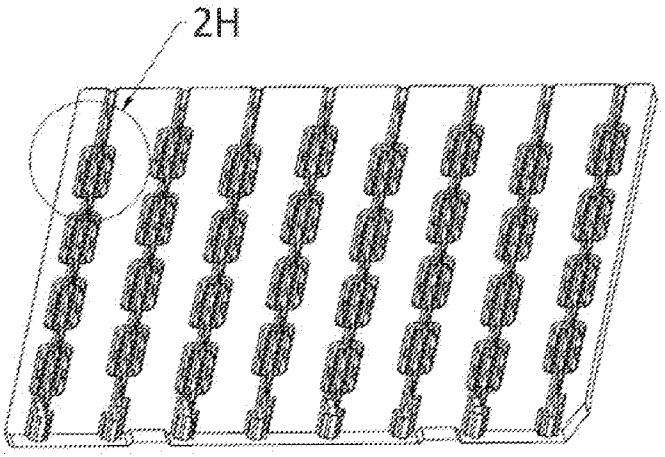
FIG. 2G is a perspective view of the organizer of FIG. 2E, showing a connector attaching face, according to some embodiments.
Figure 2H:
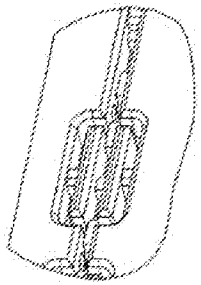
FIG. 2H is an enlarged view of the portion of the organizer within the circle marked as "2H" in FIG. 2G, according to some embodiments.
Figure 2E:
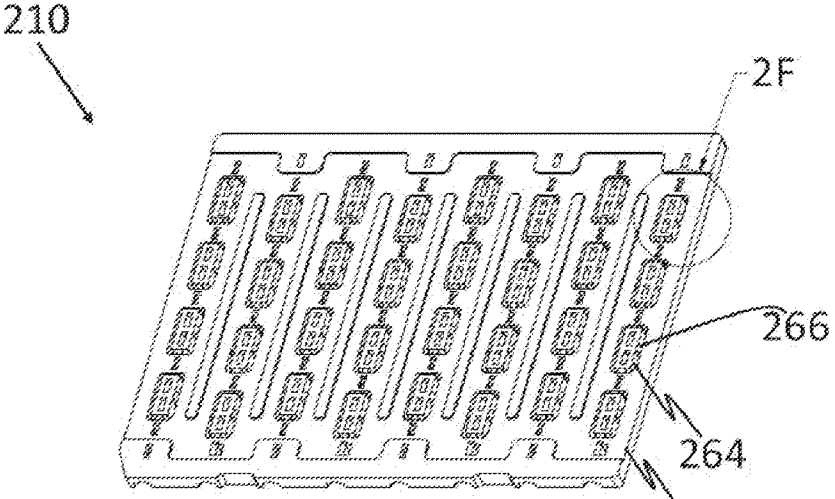
FIG. 2E is a perspective view of an organizer of the right angle connector of FIG. 2A, showing a board mounting face, according to some embodiments.
Figure 2F:
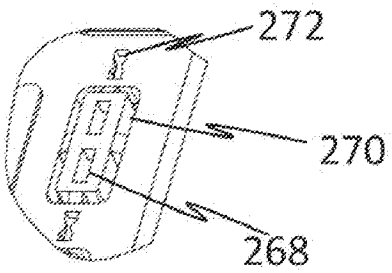
FIG. 2F is an enlarged view of the portion of the organizer within the circle marked as "2F" in FIG. 2E, according to some embodiments.

In the embodiment illustrated in FIG. 1B, the organizer is configured to occupy space between the T-Top assemblies 202 and the surface of the daughtercard 102. To provide such a function, for example, the organizer 210 may have a flat surface for mounting against the daughtercard 102. An opposing surface, facing the T-Top assemblies 202, may have projections of any other suitable profile to match a profile of the T-Top assemblies. In this way, the organizer 210 may contribute to a uniform impedance along signal conductive elements passing through the connector 200 and into the daughtercard 102. According to some embodiments, FIG. 2E and FIG. 2G are perspective views of the organizer 210 of the right angle connector 200, showing a board mounting face and a connector attaching face, respectively. FIG. 2F and FIG. 2H are enlarged views of the portions of the organizer 210 within the circle marked as "2F" in FIG. 2E and the circle marked as "2H" in FIG. 2G, respectively.

The organizer 210 may include a body 262 and islands 264 physically connected to the body 262 by bridges 266. The islands 264 may include slots 268 sized and positioned for signal contact tails to pass therethrough. Slots 270 for interface shielding interconnects 214 to pass therethrough are formed between the body 262 and the islands 264 and separated by the bridges 266. The body 262 may include slots 272 between adjacent islands configured for ground contact tails to pass therethrough.

A front housing 300 may be configured to hold mating regions of the T-Top assemblies. A method of assembling the right angle connector 200 may include inserting the T-Top assemblies 206 into the front housing 300 from the back as illustrated in FIG. 2B. FIGS. 3A-3E depict views of the front housing 300 from various perspectives, according to some embodiments. The front housing 300 may include inner walls 304 configured to separate adjacent T-Top assemblies, and outer walls 306 extending substantially perpendicular to the length of the inner walls and connecting the inner walls. The inner walls 304 may extend between an upper outer wall and a lower outer wall. The outer walls 306 may have alignment features 302 between adjacent inner walls. The alignment features 302 are in pairs and configured to engage matching features of the core members. The T-Top assemblies 206 may be held in the front housing 300 through the alignment features 302, which enables the inner walls and outer walls having substantially similar thickness and simplifies the housing mold, compared to conventional connectors, which include thin inner walls and complex, thin features to hold mating portions of conductive elements.

The front housing may be formed of a dielectric material such as plastic or nylon. Examples of suitable materials include, but are not limited to, liquid crystal polymer (LCP), polyphenyline sulfide (PPS), high temperature nylon or polyphenylenoxide (PPO) or polypropylene (PP). Other suitable materials may be employed, as aspects of the present disclosure are not limited in this regard.

The inventors have recognized and appreciated that parts of a connector housing such as the inner walls may bow or twist under forces that might occur during the manufacture or use of the connector. This may be because the volume of the material needed to form the connector housing to hold high speed leadframe assemblies close together to provide a high density interconnect is smaller than in a conventional connector housing. A connector housing of conventional design therefore may lack strength to support connector modules such as the T-Top assemblies. Such bowing or twisting may move the connector modules out of their designed positions or otherwise create problems.

The inventors have recognized and appreciated that a connector housing may be reinforced by forming one or more support members and then molding a material over the support members. In some embodiments, the support member may be formed of metal or any other material that provides suitable mechanical properties. The overmolding material may be dielectric material in some embodiments or may be or include lossy material in some embodiments. Accordingly, a connector housing may include at least one support member of a first material fully or partially encapsulated in a portion of a second material, such as an insulative overmold.

Figure 3B:
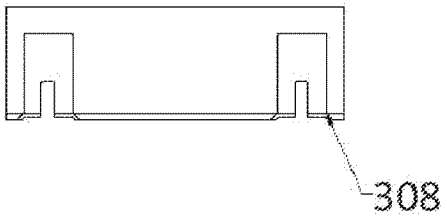
FIG. 3B is a top plan view of the front housing of FIG. 3A, according to some embodiments.
Figure 3E:
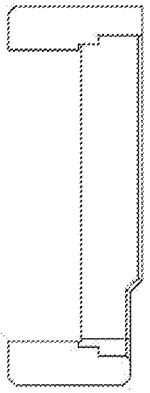
FIG. 3E is a side view of the front housing of FIG. 3A, according to some embodiments.
Figure 3D:
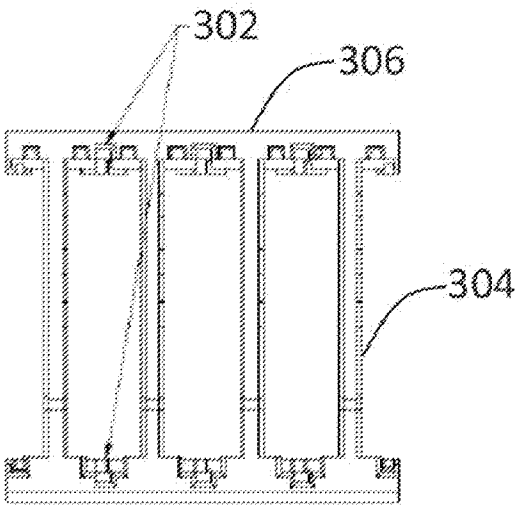
FIG. 3D is a rear plan view of the front housing of FIG. 3A, according to some embodiments.
Figure 3C:
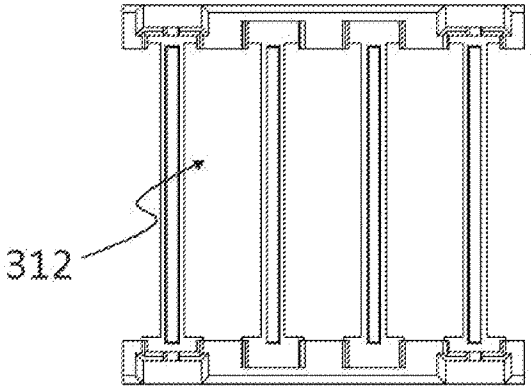
FIG. 3C is a front plan view of the front housing of FIG. 3A, according to some embodiments.
Figure 3A:
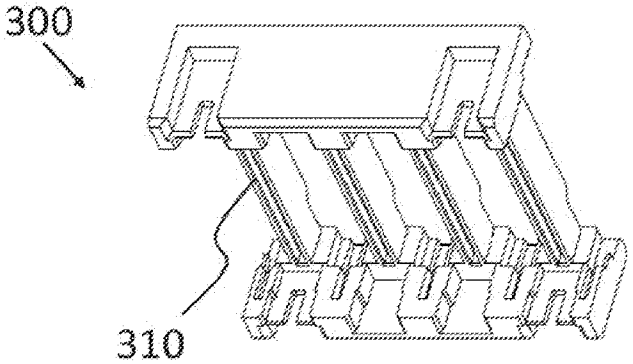
FIG. 3A is a perspective, top, front view of a front housing of the right angle connector of FIG. 2A, according to some embodiments.
Figure 3F:
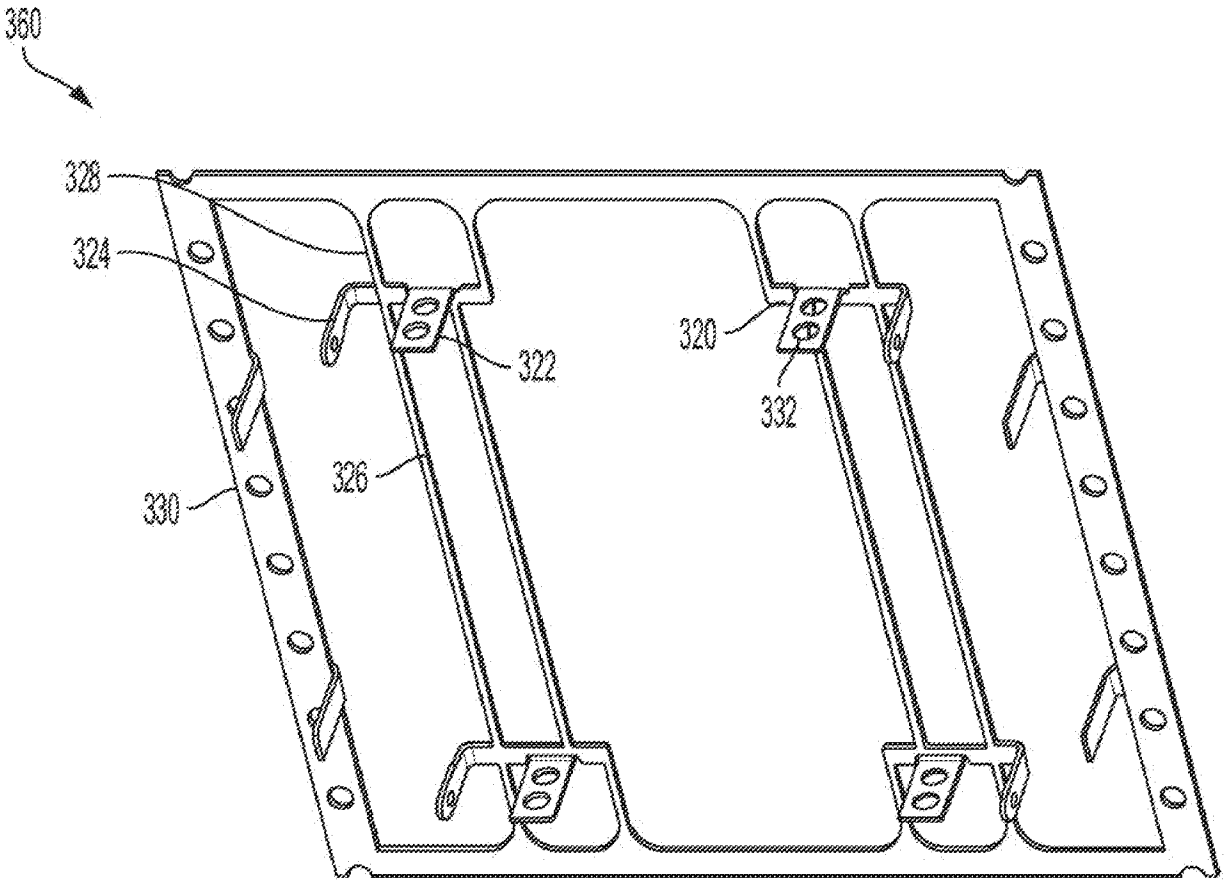
FIG. 3F is a front perspective view of a support structure configured to support a connector housing, according to some embodiments.
Figure 3G:
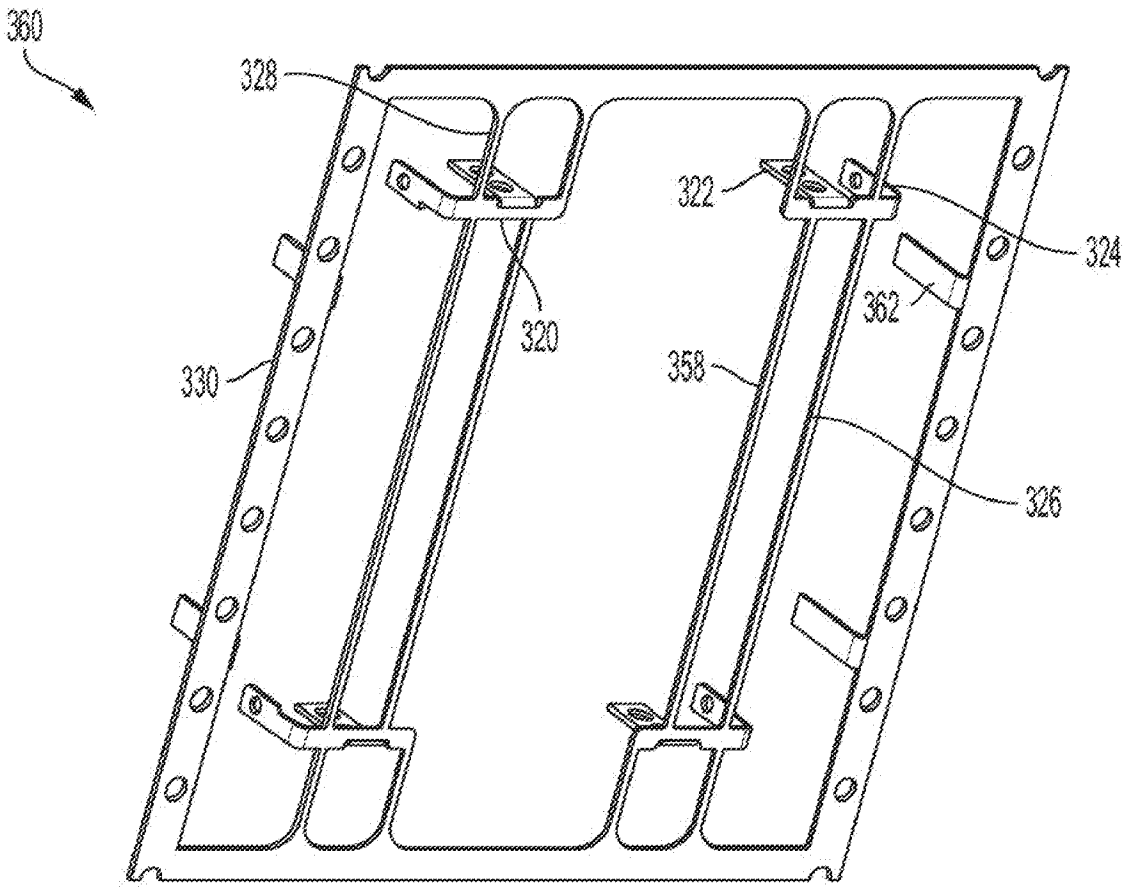
FIG. 3G is a rear perspective view of the support structure of FIG. 3F, according to some embodiments.

In accordance with some embodiments, a front housing having an embedded skeleton is shown in FIGS. 3F-3G. FIGS. 3F and 3G depict front and rear perspective views of a metal stamping 360, respectively. The skeleton may include one or more members in the plane of the metal from which stamping 360 is formed. In this example, support members 320 and/or other elongated members 326 are in that plane. In some embodiments, one or more members may bend out of that plane. In this example, flanges bend out of the plane at a right angle, but components may bend out of the plane at other angles. Also in this example, the flanges extend from members within the plane, but in other embodiments flanges may extend from other portions of the stamping 360.

The stamping 360 may include carrier strips 330, which are here shown attached to support members 320 through tie bars 328. Alternatively or additionally, stamping 360 may include tie bars establishing the relative position of members forming the skeleton. For example, in some embodiments, a tie bar 358 may connect two members of the skeleton to ensure that the spacing between those members is maintained during an overmolding operation.

Figure 3H:
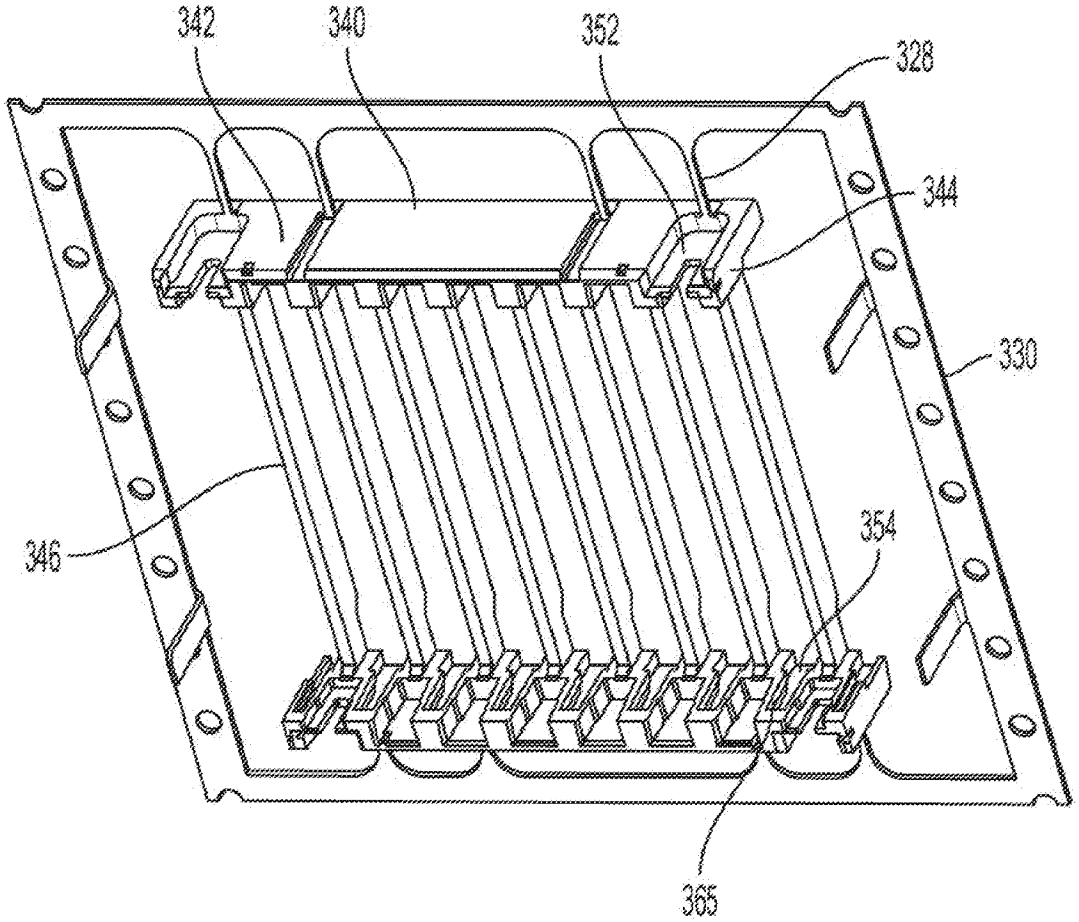
FIG. 3H is a front perspective view of a connector housing before being severed from carrier strips, according to some embodiments.
Figure 3I:
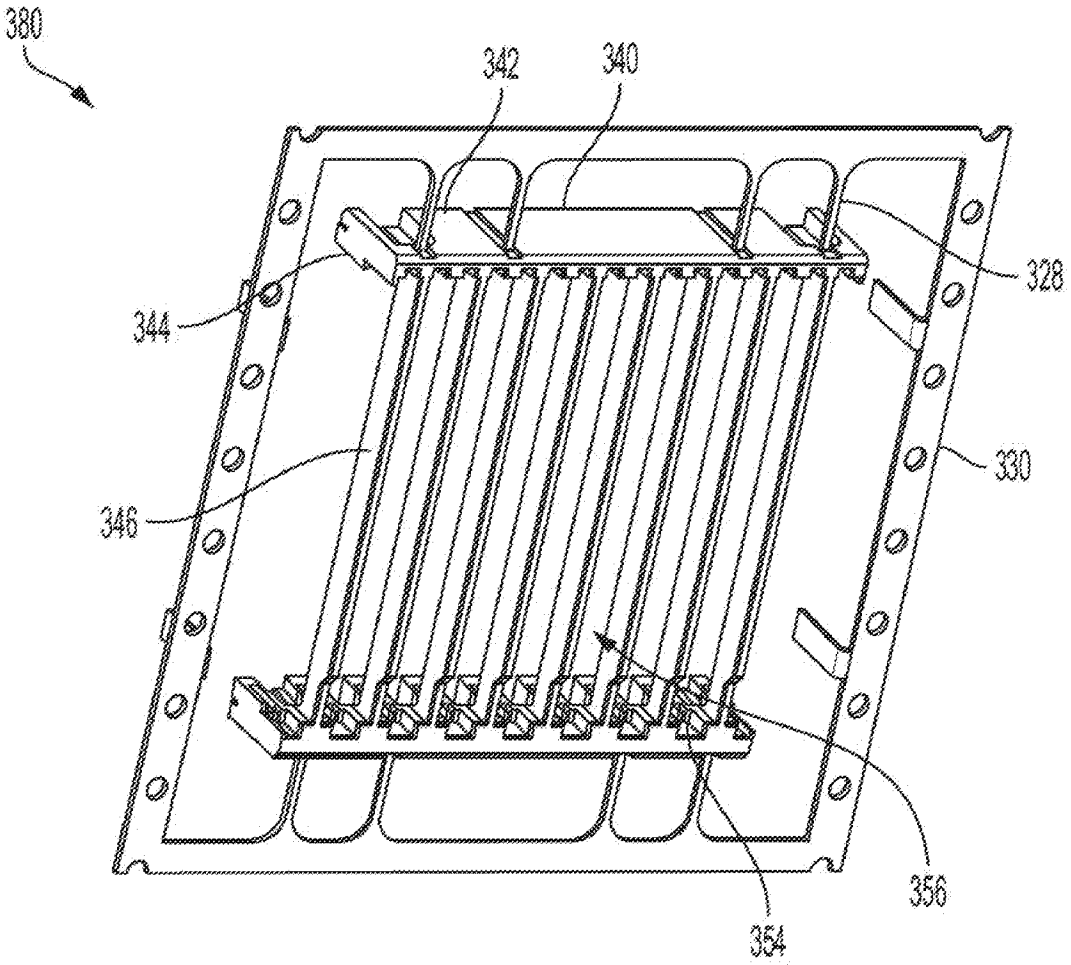
FIG. 3I is a rear perspective view of the connector housing of FIG. 3H, according to some embodiments.

In this example, the skeleton within stamping 360 is configured to reinforce a front housing 340. A front housing 340, formed by molding over the support members 320, is shown in FIGS. 3H and 3I. In the illustrated example, the carrier strips 330 include features that aid in the insert molding operation including, for example, holes for positioning the stamping 360 relative to a mold. Although FIG. 3F illustrates one stamping 360 for a connector housing, in some embodiments, a long strip of metal may be stamped with multiple stampings, each for a connector housing. That long strip may then be wound on a reel, and then fed into a molding process. Tabs 362 extending perpendicularly from the carrier strips may protect the support structure from damage when wound on the reel. After molding the multiple connector housings simultaneously or in sequence, individual connector housings may be obtained by severing the ties bars.

The members of stamping 360 forming a skeleton may be stamped to align with locations of a connector housing that are prone to bowing or twisting and/or locations of the connector housing that can be reinforced to prevent bowing or twisting at other locations. For example, a front housing of a connector may have outer walls with a plurality of inner walls extending between two opposing outer walls. The inner walls may be spaced to provide openings between adjacent inner walls. The openings may be sized to receive a mating interface of a mating connector. To enable a high density of mating contacts, the inner walls may be long and thin so as to enable the mating interface to provide multiple closely spaced columns of mating contact portions. The aspect ratio of the inner walls, as measured by the ratio of the longest dimension to the shortest may be greater than 10:1, such as between 10:1 and 100:1, or between 10:1 and 50:1 or 10:1 and 25:1, or 15:1 and 30:1, in various embodiments. Inner walls with such a large aspect ration may allow the front housing to bow or otherwise deform.

In the example illustrated in FIGS. 3F and 3G, the stamping includes four support members 320. An end wall flange 322 and a sidewall flange 324 may extend from each support member 320. Two support members 320 may be joined by one or more elongated pieces 326. The flanges 322 and 324 may extend in a direction perpendicular to the direction that elongated pieces 326 extend. Such a 3D configuration may provide more structural strength than a 2D structure. The flanges may include features such as holes 332, enabling a material to flow through during molding such that the flanges are more securely locked into the molded material.

A front housing 340 may be formed by overmolding insulative material on a support structure, such as the support structure in the stamping 360 of FIGS. 3F and 3G. Overmolding may result in the members of the support structure being fully or partially encapsulated by the overmolded material. In the illustrative embodiment, the overmolding material is insulative, and the skeleton is sufficiently encapsulated by the insulative overmold that the metal of skeleton is insulated from any conductive members of the leadframe assemblies attached to front housing 340.

In the example illustrated in FIGS. 3H and 3I, the front housing 340 includes outer walls 342, side walls 344, and inner walls 346. End wall flanges 322 may be embedded in and support the outer walls 342. Sidewall flanges 324 may be embedded in and support the side walls 344. Each elongated piece 326 may be embedded in and support an inner walls 346. In the illustrated embodiment, only a subset of the inner walls in the front housing include an elongated piece 326.

As discussed above, the locations of the features of the skeleton, such as flanges 322, 324 and elongated pieces 326 may be selectively disposed to provide a more robust component while not materially interfering with the flow of insulative material during a subsequent molding operation. In the illustrated example, the elongated pieces 326 are disposed to support the two outermost inner walls 346. Support members 320 each extend over only a portion of the length of an outer wall. In some embodiments, members forming the skeleton may extend through a greater portion of the connector component. For example, a support member or multiple support members collectively may extend over all or substantially all the length of each outer wall. As another example, the skeleton may include additional elongated pieces, with additional pieces aligned to be overmolded by additional inner walls, respectively. For example, an elongated structure may, instead of or in addition to a tie bar 358 that is offset from an inner wall, align with the inner wall adjacent an outermost inner wall. In this way, members of the skeleton may reinforce the four outermost inner walls. In other embodiments, additional elongated members may be present such that the skeleton may reinforce all or any number of the inner walls in the front housing 340.

In other embodiments, other connector housing portions may have different sizes and numbers of skeletal members. For example, the front housing 340 has four support members 320 embedded within it, one on each corner of the front housing 340. In some embodiments, regardless of the size of a connector housing, skeletal members may extend through additional portions. For example, an additional support member 320 may extend through an elongated piece 326 in a central portion of the housing.

Similarly, additional flanges may be included. Sidewall flanges 324 may be embedded in a portion of the side wall 344 of the front housing 340 that is thinner than other portions of the side wall 344. For connectors with other thinned sidewall sections, other flanges may be embedded in those thinned sections, for example.

The front housing 340 may include fine features such as the mating features 352 configured to mate with matching features of a mating connector housing. There may be support members embedded in the material forming the fine features to provide additional strength. For example, the mating features 352 may be formed by material molded around the end wall flange 322.

Similar to the front housing 300 illustrated in FIGS. 3A-3E, the front housing 340 may include openings 356, into which connector modules such as the T-Top assemblies may be inserted. The front housing 340 may also include alignment features 354 for the accuracy of the insertions. In the illustrated example, alignment features 354 include channels 365 into which projecting portions of the connector modules such as extensions 510 in FIG. 5B may be slid.

In the illustrated example, s tie bar 358 may be severed, for example, after the overmolding operation. Other tie bars 328 may be retained such that the molded housing may be handled with the carrier strips but may be severed to free the molded part from the carrier strip before use.

It should be appreciated that the front housing 340 illustrated in FIGS. 3H and 3I has more openings than the front housing 300 illustrated in FIGS. 3A-3E. Front housing may be used in a connector module that incorporates more leadframe assemblies than front housing 300. A skeleton as described herein may be used to enable large connectors such as, for example, connectors with six or more leadframe assemblies or, in some embodiments, eight or more leadframe assemblies. Each of the leadframe assemblies may provide at least one column of conductive elements for carrying signals. In embodiments as described herein, each leadframe assembly may provide two columns of conductive elements. Moreover, with support provided by a skeleton as described herein, each leadframe assembly may be long enough to support multiple pairs of signal conductors. For example, there may be at least 6 or 8 pairs of signal conductors along each column. Despite the density of such a connector, it may nonetheless be mechanically robust. A housing as described herein, for example, may have seven openings, each receiving a dual insert molded leadframe assembly, as shown in FIGS. 3H and 3I. Two additional spaces receiving single insert molded leadframe assemblies may be provided at the ends of the connector. Housings for such a connector may have skeletal structures as illustrated in FIGS. 3F and 3G.

Figure 4B:
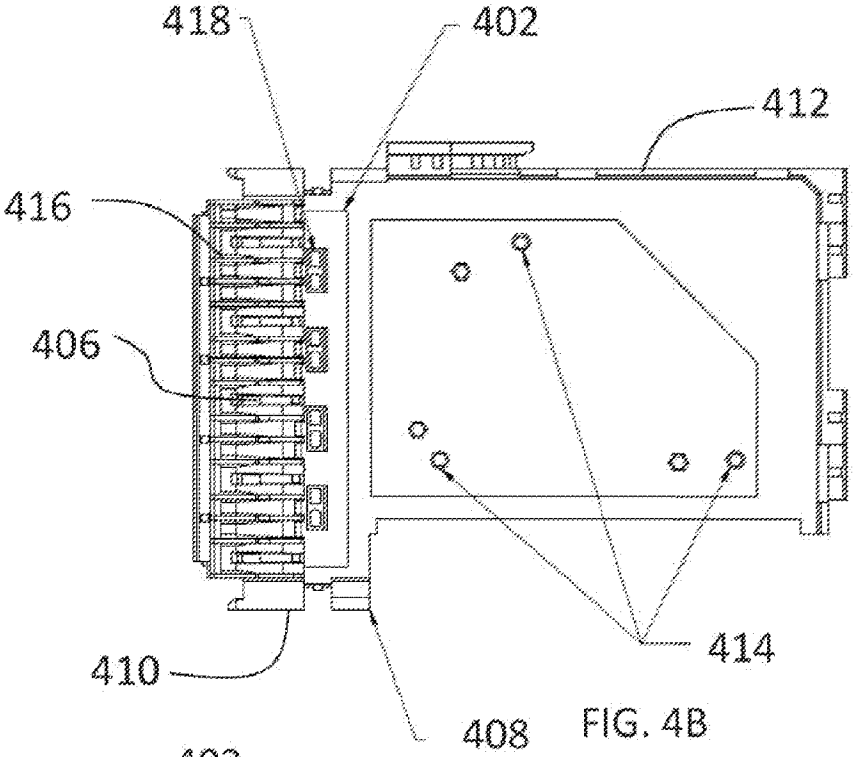
FIG. 4B is a side view of the core member of FIG. 4A, according to some embodiments.
Figure 4C:
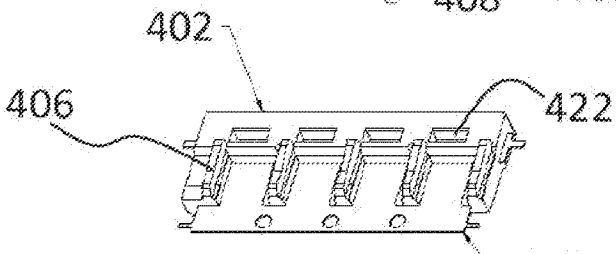
FIG. 4C is a perspective view of the core member of FIG. 4A after a first shot of lossy material and before a second shot of insulative material, according to some embodiments.
Figure 4A:
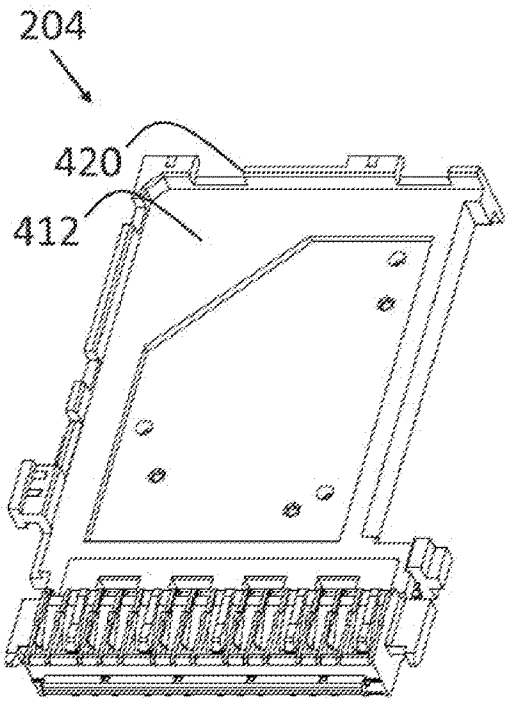
FIG. 4A is a perspective view of a core member, according to some embodiments.

FIGS. 4A-4B depict a core member 204, according to some embodiments. In the illustrated embodiment, core member 204 is made of three components: a metal shield, lossy material and insulative material. FIG. 4C depicts an intermediate state of the core member 204, which is after a first shot of lossy material and before a second shot of insulative material, according to some embodiments.

In some embodiments, the core member 204 may be formed by a two-shot process. In a first shot, lossy material 402 may be selectively molded over a T-Top interface shield 404. The lossy material 402 may form ribs 406 configured to provide connection between the ground conductive elements in the leadframe assemblies attached to the core member by, for example, physically contacting the ground conductive elements as illustrated in FIG. 5E. In conventional connectors without the core members, the housings are made by molding insulative material, without thin features of lossy material such as the ribs 406. The lossy material 402 may include slots 418, by which portions of the interface shield 404 may be exposed. This configuration may enable shields within the leadframe assemblies to be connected to the interface shield 404, such as by beams passing through the slots 418.

In a second shot, insulative material 408 may be selectively molded over the lossy material 402 and T-Top interface shield 404, forming a T-Top region 410 of the core member. The T-Top region 410 may be configured to hold the mating portions of the conductive elements of leadframe assemblies. The insulative material of the T-Top region may provide isolation between signal conductive elements of the leadframe assemblies and also mechanical support for the conductive elements by, for example, forming ribs 416.

In some embodiments, the shot for the lossy material 402 may be completed in multiple shots (e.g., 2 shots) for higher reliability in filling the mold. Similarly, the shot for the insulative material 408 may be completed in multiple shots (e.g., 2 shots).

The components of the T-Top assembly may be configured for simple and low cost molding. In conventional connectors without the core members, the mating interface portion of the connector includes a housing molded with walls between mating contact portions of conductive elements that are intended to be electrically separate. Other fine details, such as a preload shelf might similarly be molded in the housing to support proper operation of the connector when IMLAs are inserted into the housing.

The ease with which such features can reliably be molded depends, at least in part, on the size and shape of the features as well as their location relative to other features in the part to be molded. The shape of a molded part is defined by recesses and projections on the interior surfaces of mold halves that are closed to encircle a cavity in which the molded part is formed. The part is formed by injecting molding material, such as molten plastic, into the cavity. During molding, the molding material is intended to flow throughout the cavity, so as to fill the cavity and create a molded part in the shape of the cavity. Features that are formed in portions of the mold cavity that molding material can reach only after flowing through relatively narrow passages are difficult to reliably fill, as there is a possibility that insufficient molding material will flow into those sections of the mold. That possibility might be avoided by using higher pressure during molding or creating more inlets into the mold cavity into which molding material can be injected. However, such counter measures increase the complexity of the molding process, and may still leave an unacceptable risk of defective parts.

Further, it is desirable in a molding operation for the molded part to be easily released from the mold when the mold halves are opened. Features in a molded part formed by projections or recesses that extend parallel to the direction in which the molded halves move when opened or closed can move, unobstructed by the molded part, when the mold opens.

In contrast, features formed by portions of the mold that project in an orthogonal direction contribute to added complexity, because those projections are inside an opening, or coring, of the molded part at the end of the molding operation. To remove the molded part from the mold, those projecting portions of the mold might be retracted. Molding operations can be performed with retractable projections, but retractable projections increase the cost of a mold. Thus, the cost and/or complexity of molding a connector housing may depend on the direction in which corings extend into the molded part with respect to the direction in which the mold halves move when opened or closed.

The inventors have recognized and appreciated connector designs that simplify the molding operation, reducing cost and manufacturing defects. In the embodiment illustrated, the mating interface is more simply formed using a combination of features in front housing 300 and core members 204, both of which may be shaped so as to avoid portions that are filled in a mold only through relatively long and narrow portions of the mold cavity.

For example, front housing 300 includes relatively large openings 312 housing the mating interface of the connector. Openings 312 are bounded by walls having relatively few features such that portions of the mold in which those walls are formed may be reliably filled in a molding operation. Further, housing 300 has features that can be formed by projections in a mold with halves that move in a direction perpendicular to the top and bottom orientations of FIGS. 3C and 3D. There may be few, if any, corings in locations that require moving parts in the mold.

Some fine features, including features that support reliable operation of the connector, may be formed in core members 204. While those features might increase molding complexity or have a risk of manufacturing defects if formed in a conventional connector housing, those features may be reliably formed in a simple molding operation. For example, the ribs 416, which extend outwards from a relatively large body portion 412 are easier to form than complex and thin sections inside a conventional connector housing.

Nonetheless, the ribs 416 may extend to a length that is sufficient for providing isolation between the mating contact portions of the adjacent conductive elements, but are not filled through relatively long and narrow passages in a mold cavity.

Moreover, these features are on an exterior surface of a part in a mold that opens or closes in a direction perpendicular to the surface of body 412. As can be seen in FIG. 4A, features such as ribs 416 and border 420 extend perpendicularly from the surface of body 412. In this way, the use of moving parts in the mold can be reduced or eliminated.

The insulative material 408 may extend beyond the T-Top region 410 to form a body 412 of the core member. The IMLAs may be attached to the body 412. The body 412 may include retention features 414 configured to secure the leadframe assemblies attached to the core member, such as posts that fit into holes in the IMLAs or holes that receive posts from the IMLAs.

The T-Top interface shield 404 may be made of metal or any other material that is fully or partially conductive and provides suitable mechanical properties for shields in an electrical connector. Phosphor-bronze, beryllium copper and other copper alloys are non-limiting examples of materials that may be used. The interface shields may be formed from such materials in any suitable way, including by stamping and/or forming.

In the embodiment illustrated, the shield 404 is molded over with lossy material and a second shot of insulative material is then over molded on that structure to form both the insulative portions of T-Top region 410 and body 412. When IMLAs are attached to core member 204, shield 404 is positioned adjacent the mating contact portions of the conductive elements of the IMLAs. For a dual IMLA assembly 202C, shield 404 is positioned between, and therefore adjacent, the mating contact portions of the signal conductors of both IMLAs attached to the core. Positioning shield 404 adjacent the mating contact portions and parallel to the column of mating contact portions may reduce degradation in signal integrity at the mating interface of the connector, such as by reducing cross talk from one column to the next and/or changes of impedance along the length of signal conductors at the mating interface. Lossy material electrically coupled to shield 404 may also reduce degradation of signal integrity.

Any suitable lossy material may be used for the lossy material 402 of the T-Top region 410 and other structures that are "lossy." Materials that conduct, but with some loss, or material which by another physical mechanism absorbs electromagnetic energy over the frequency range of interest are referred to herein generally as "lossy" materials. Electrically lossy materials can be formed from lossy dielectric and/or poorly conductive and/or lossy magnetic materials. Magnetically lossy material can be formed, for example, from materials traditionally regarded as ferromagnetic materials, such as those that have a magnetic loss tangent greater than approximately 0.05 in the frequency range of interest. The "magnetic loss tangent" is the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest. Electrically lossy material can be formed from material traditionally regarded as dielectric materials, such as those that have an electric loss tangent greater than approximately 0.05 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain conductive particles or regions that are sufficiently dispersed that they do not provide high conductivity or otherwise are prepared with properties that lead to a relatively weak bulk conductivity compared to a good conductor such as copper over the frequency range of interest.

Electrically lossy materials typically have a bulk conductivity of about 1 Siemen/meter to about 10,000 Siemens/meter and preferably about 1 Siemen/meter to about 5,000 Siemens/meter. In some embodiments, material with a bulk conductivity of between about 10 Siemens/meter and about 200 Siemens/meter may be used. As a specific example, material with a conductivity of about 50 Siemens/meter may be used. However, it should be appreciated that the conductivity of the material may be selected empirically or through electrical simulation using known simulation tools to determine a suitable conductivity that provides a suitably low cross talk with a suitably low signal path attenuation or insertion loss.

Electrically lossy materials may be partially conductive materials, such as those that have a surface resistivity between 1 Ω /square and 100,000 Ω /square. In some embodiments, the electrically lossy material has a surface resistivity between 10 Ω /square and 1000 Ω /square. As a specific example, the material may have a surface resistivity of between about 20 Ω /square and 80 Ω /square.

In some embodiments, electrically lossy material is formed by adding to a binder a filler that contains conductive particles. In such an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, many alternative forms of binder materials may be used. Curable materials, such as epoxies, may serve as a binder. Alternatively, materials such as thermosetting resins or adhesives may be used.

Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Celanese Corporation which can be filled with carbon fibers or stainless steel filaments. A lossy material, such as lossy conductive carbon filled adhesive preform, such as those sold by Techfilm of Billerica, Massachusetts, US may also be used. This preform can include an epoxy binder filled with carbon fibers and/or other carbon particles. The binder surrounds carbon particles, which act as a reinforcement for the preform. Such a preform may be inserted in a connector wafer to form all or part of the housing. In some embodiments, the preform may adhere through the adhesive in the preform, which may be cured in a heat treating process. In some embodiments, the adhesive may take the form of a separate conductive or nonconductive adhesive layer. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, a lossy portion may be manufactured by stamping a preform or sheet of lossy material. For example, a lossy portion may be formed by stamping a preform as described above with an appropriate pattern of openings. However, other materials may be used instead of or in addition to such a preform. A sheet of ferromagnetic material, for example, may be used.

However, lossy portions also may be formed in other ways. In some embodiments, a lossy portion may be formed by interleaving layers of lossy and conductive material such as metal foil. These layers may be rigidly attached to one another, such as through the use of epoxy or other adhesive, or may be held together in any other suitable way. The layers may be of the desired shape before being secured to one another or may be stamped or otherwise shaped after they are held together. As a further alternative, lossy portions may be formed by plating plastic or other insulative material with a lossy coating, such as a diffuse metal coating.

Figure 4E:
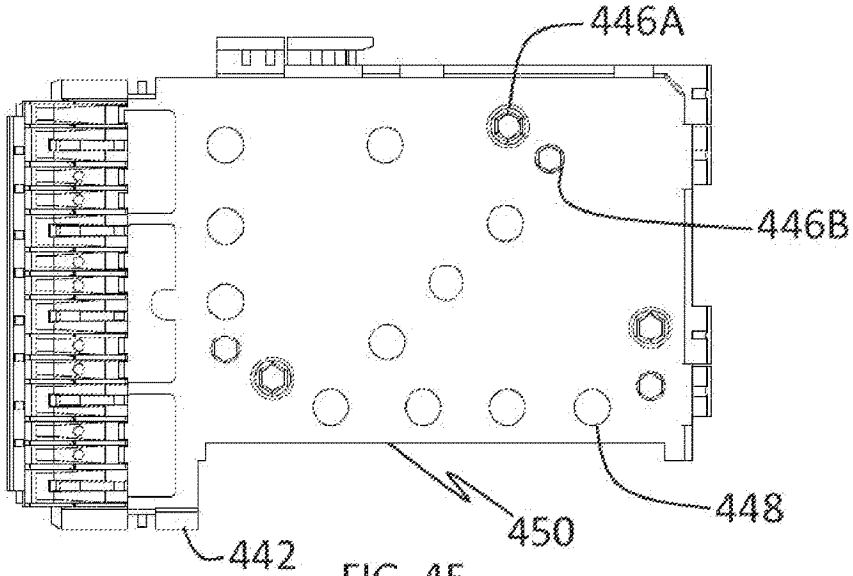
FIG. 4E is a side view of the core member of FIG. 4D, according to some embodiments.
Figure 4F:
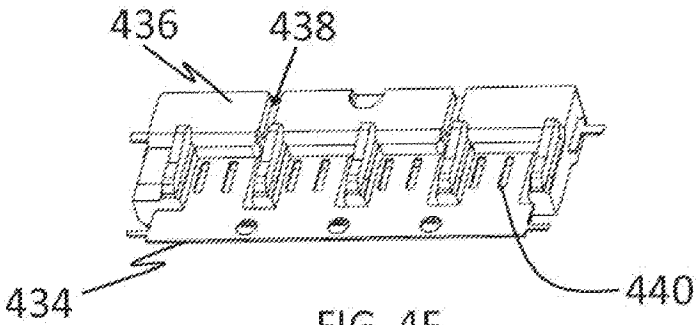
FIG. 4F is a perspective view of the core member of FIG. 4D after a first shot of lossy material and before a second shot of insulative material, according to some embodiments.
Figure 4D:
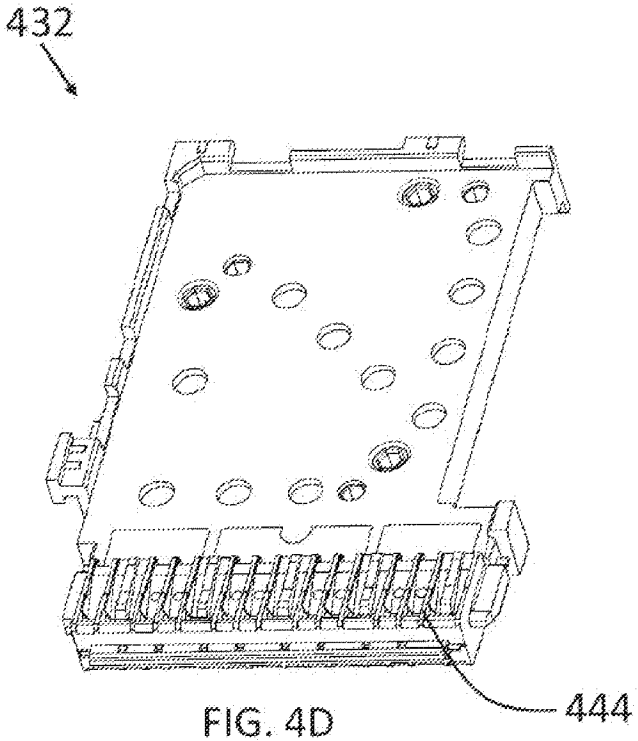
FIG. 4D is a perspective view of a core member, according to some embodiments.

FIGS. 4D-4F depict another embodiment of a core member. FIG. 4D is a perspective view of a core member 432. FIG. 4E is a side view of the core member 432. FIG. 4F is a perspective view of the core member 432 after a first shot of lossy material and before a second shot of insulative material. The core member 432 may include a T-Top interface shield 434 having through holes 440, lossy material 436 selectively molded over the T-Top interface shield 434, and insulative material 442 molded over exposed portions of the T-Top interface shield 434 and forming a body 450. Portions of the lossy material 436 may be separated by gaps 438, from which the T-Top interface shield 434 may be exposed. The insulative material 442 may be molded over areas of the T-Top interface shield 434 that are exposed, fill the through holes 440 and form ribs 444. The insulative material 442 may fill the gaps 438 between the portions of the lossy material 436 so as to provide mechanical strength between the body 450 of the core member and the T-Top interface shield 434. As the body 412 illustrated in FIG. 4B, the body 450 may include retention features 446A for a Type-A IMLA and retention features 446B for a Type-B IMLA. Additionally, the body 450 may include openings 448, which may be sized and positioned according to openings 452 of shields 502 (See, e.g., FIG. 5N). The openings 448 may enable electrical connections between the shields 502 of the Type-A and Type-B IMLAs attached to the core member 432. Fully or partially electrically conductive members may pass through the openings to make such connections. For example, the openings may be filled with lossy material. As another example, conductive fingers from the shields 502 may pass through the openings. Such configuration may reduce crosstalk, for example, between IMLAs.

FIGS. 5A-5D depict a dual IMLA assembly 202C, according to some embodiments. The dual IMLA assembly 202C may include a core member 204. A type-A IMLA 206A may be attached to one side of the core member 204. A Type-B IMLA 206B may be attached to the other side of the core member 204. Each IMLA may include a column of conductive elements shaped and positioned for signal and ground, respectively. In the illustrated example, ground conductive elements are wider than signal conductive elements. The mating contact portions of the ground conductive elements may include openings 530 shaped and positioned to provide a mating force approximating that of the mating contact portions of the signal conductive elements. The ribs 406 of the lossy material 402 of the core member 204 may be positioned such that, when the IMLA is attached to the core member, the ground conductive elements of the IMLA are electrically coupled to the lossy material 402 through ribs 406. In some operating states, the ground conductive elements may press against the ribs 406 and/or may be close enough to capacitively couple to them.

The T-Top interface shield 404 of the core member 204 may include an extension 510. The extension 510 may extend beyond the mating face 536 of the IMLA such that the extension 510 of the interface shield 404 may extend into a mating connector. Such a configuration may enable the interface shield 404 to overlap internal shields of a mating connector as illustrated in an exemplary embodiment of FIGS. 11A-11B. The extension 510 of the interface shield 404 may be molded over with the insulative material 408 by a thickness $t1$, which may be smaller than a thickness $t2$ of the insulative material over molding the body of the T-Top region 410. In some embodiments, the thickness $t1$ may be less than 20% of the thickness $t2$, or less than 15%, or less than 10%.

In addition to extending a ground reference provided by shield 404 through the mating interface, a relatively thin extension 510 may contribute to mechanical robustness of the interconnection system. This configuration allows inserting the extension 510 of the interface shield into a matching slot in a housing of a mating connector, which may be formed with only a small impact on the mechanical structure of the housing of the mating connector. In the illustrated embodiment, the mating connectors have similar mating interfaces. Accordingly, front housing 300 of connector 200 (FIG. 3A), illustrates certain features that are also present in a mating connector, e.g., the header connector 700. One such feature is slots 310 configured to receive the extensions 510 at the distal ends of the T-Top regions.

If the core member 204 did not have this extension 510, but a substantially uniform thickness in a shape of, for example, a rectangle at the distal end, a receiving housing wall of the mating connector would be reduced to accommodate the extension 510, which would reduce the robustness of the mechanical structure of the connector housing.

FIG. 5E depicts a front view of the dual IMLA assembly 202C, partially cut away, according to some embodiments. As can be seen in the cutaway section, ribs 406 of lossy material 402 extend towards certain ones of the mating contact portions in each column. Those mating contact portions may be of the ground conductive elements. Here, the lossy material 402 is shown to occupy a continuous volume, but in other embodiments, the lossy material may be in discontinuous regions. For example, the lossy material 402 on one side of the shield 404 may be physically disconnected from the lossy material 402 on the other side of the shield.

Figure 5D:
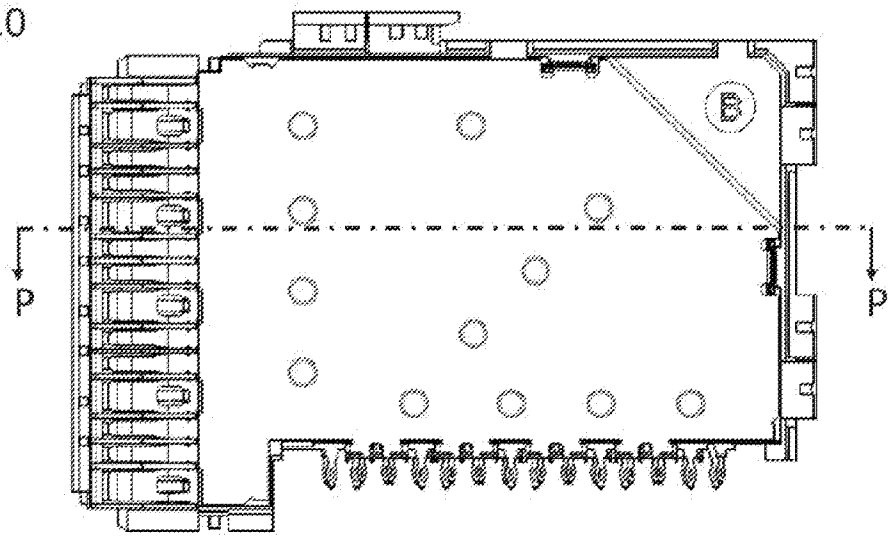
FIG. 5D is a second side view of the dual IMLA assembly of FIG. 5A, illustrating a Type-B IMLA attached to the second side, according to some embodiments.
Figure 5C:
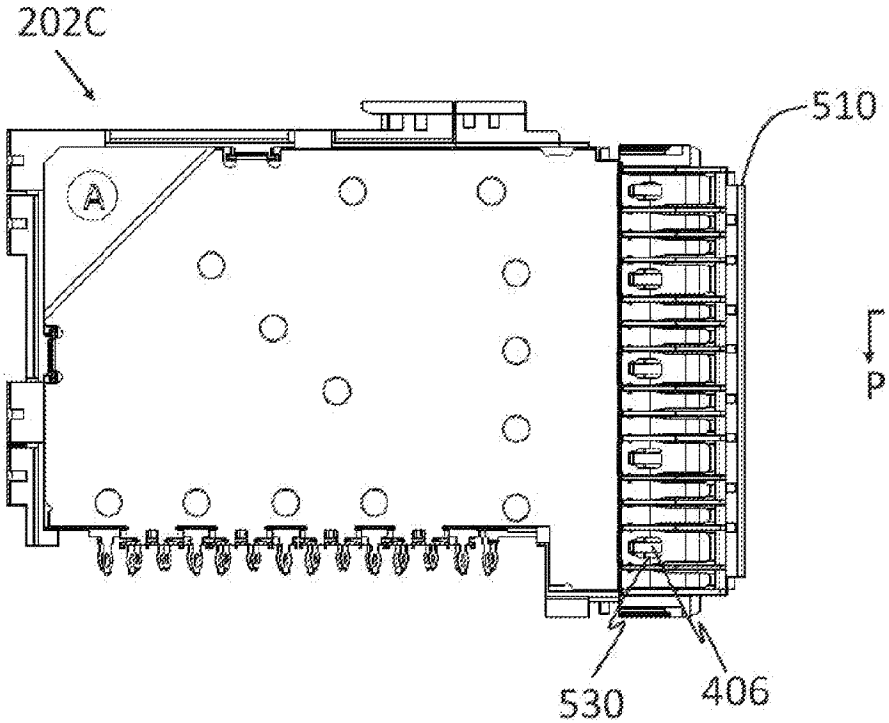
FIG. 5C is a first side view of the dual IMLA assembly of FIG. 5A, illustrating a Type-A IMLA attached to the first side, according to some embodiments.
Figure 5F:
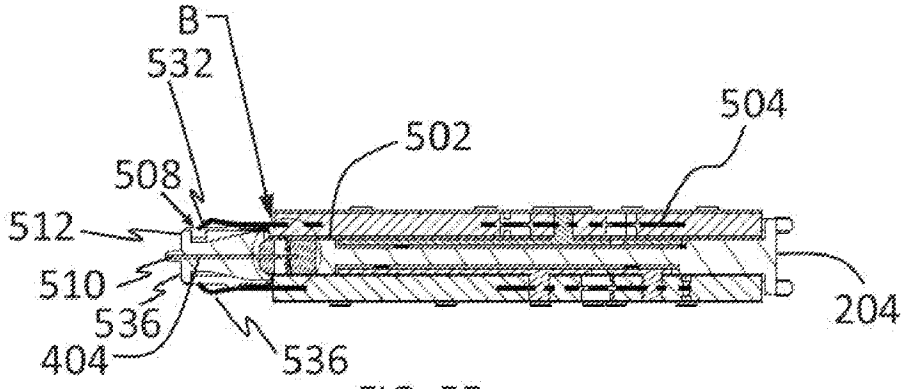
FIG. 5F is a cross sectional view along line P-P in FIG. 5D, illustrating a shield of the Type-A IMLA coupled to a shield of the Type-B IMLA through the core member of FIG. 4A, according to some embodiments.

FIG. 5F depicts a cross-sectional view along line P-P in FIG. 5D, illustrating the Type A IMLA coupled to the Type-B IMLA through the core member 204 (FIG. 4A), according to some embodiments. FIG. 5F reveals that, in the illustrated embodiment, each IMLA has a shield 502 parallel to the intermediate portions of the conductive elements serving as signal conductors or ground conductors through the IMLA. Shield 404 is parallel to the mating contact portions of the conductive elements. Shields 404 and 502 may be electrically connected.

Figure 5G:
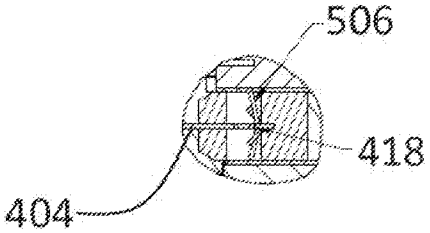
FIG. 5G is an enlarged view of the portion of the dual IMLA assembly within the circle marked as "B" in FIG. 5F, according to some embodiments.
Figure 5E:
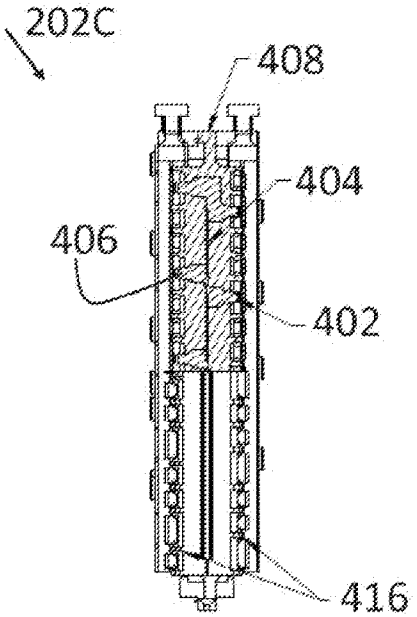
FIG. 5E is a front view of the dual IMLA assembly of FIG. 5A, partially cut away, according to some embodiments.

FIG. 5G shows features for connecting shields 404 and 502 in an enlarged view of the circle marked as "B" in FIG. 5F, according to some embodiments. This region encompasses openings 422 (see also, FIG. 4C) in the lossy portion of the core member 204, through which portions of the shields 404 are exposed. The exposed portions of the shields 404 include features to connect to shields 502. Here, those features are slots 418. Shields 502 may be stamped from a sheet of metal and may be stamped with structures, such beams 506, which may be inserted into slots 418 when the IMLA is pressed onto core member 204 so as to electrically connect shields 404 and 502.

Figure 5H:
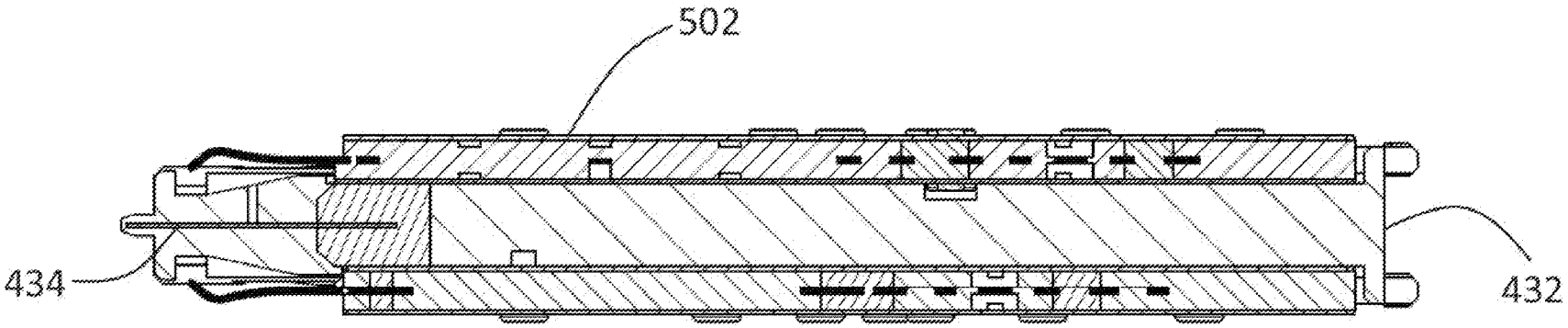
FIG. 5H is a cross sectional view along line P-P in FIG. 5D, illustrating a shield of the Type-A IMLA coupled to a shield of the Type-B IMLA through the core member of FIG. 4D, according to some embodiments.

FIG. 5H depicts a cross-sectional view along ling P-P in FIG. 5D, illustrating the Type A IMLA coupled to the Type-B IMLA through the core member 432 (FIG. 4D), according to some embodiments. As illustrated, in some embodiments, the T-Top may be configured without T-Top shield slots 418. Omitting the slots 418 may enable a connector to have a smaller pitch, such as less than 3 mm, and may be approximately 2 mm, for example.

In some embodiments, the features for connecting the shields may also be simply formed. For example, openings 422 are extend in a direction perpendicular to the surface of body portion 412 and may be molded without moving portions of the mold. Also, a preload feature 512 is shown, also extending in a direction perpendicular to the surface of body portion 412.

Likewise, core member 204 may be molded with an opening 508. The opening 508 may be configured to receive the beam tips of conductive elements when an IMLA is mounted to the core member 204. The opening 508 enables the beam tips to flex upon mating with a mating connector.

In some embodiments, the core member 204 may include pre-load features 512 configured to preload conductive elements of a mating connector. The pre-load features may be positioned beyond the distal end of a tip 532 of a conductive element of the IMLA. In this configuration, the pre-load feature may touch a conductive element of a mating connector before the conductive element reaching the tip 532. For example, upon mating, a first connector including the IMLA assembly of FIG. 5F with a second connector having a similar mating interface, the pre-load features 512 of the first connector may engage tips 532 of the second connector and press them into opening 508. Thus, the tips 532 of the second connector are pressed out of the path of the first connector, which reduces the chance of stubbing. When the mating interfaces of the first and second connector are similar, the tips 532 of the first connector are pressed out of the path of the second connector by pre-load features 512 of the second connector.

The pre-load features illustrated in FIG. 5F differ from a pre-load shelf in conventional connectors in which the beam tips of the conductive element are restrained, in a partially deflected state, by pre-load features of the same connector. Such a design, for example, may involve a pre-load shelf on which a portion of the beam tip rests. In that configuration a portion of the tip extends far enough onto the pre-load shelf to be reliably held in place.

Such a configuration entails a segment of the conductive element between the convex contract point for each conductive element and the distal-most tip of the conductive element. That segment of the conductive element is out of the desired signal path and can constitute an un-terminated stub, which may undesirably impact the integrity of signals propagating along the conductive elements. The frequency of that impact may be inversely related to the length of the stub such that shortening the stub enables high frequency connector operation. Unterminated stubs on ground conducive elements may similarly impact signal integrity.

In the illustrated embodiment, however, the tip of the conductive elements is unrestrained. The segment between the convex contract point 536 and the distal end of tip 532 does not have to be sufficiently long to engage a pre-load shelf. This design enables reducing the length of the tips of conductive elements, without increasing the risk of stubbing upon mating. In some embodiments, the distance between the convex contact location and the tip of the conductive elements may be in the range of 0.02 mm and 2 mm and any suitable value in between, or in the range of 0.1 mm and 1 mm and any suitable value in between, or less than 0.3 mm, or less than 0.2 mm, or less than 0.1 mm. A method of operating connectors with such pre-load features to mate with each other is described with respect to FIGS. 11A-11F.

Forming these features as part of the core members enables miniaturization of the connector, as these features will have dimensions that are proportional to the dimensions of the conductive elements and the spacing between them. However, as these features are formed in the core member, rather than as a thin, complex geometry if integrally formed with the front housing 300, they may be more reliably formed. These features may be used in a high speed, high density connector in which signal conductive elements are spaced (center-to-center) from each other by less than 2 mm, or less than 1 mm, or less than 0.75 mm in some embodiments, such as in the range of 0.5 mm to 1.0 mm, or any suitable value in between. Pairs of signal conductive elements may be spaced (center-to-center) from each other by less than 6 mm, or less than 3 mm, or less than 1.5 mm in some embodiments, such as in the range of 1.5 mm to 3.0 mm, or any suitable value in between.

In some embodiments, a leadframe assembly may include IMLA shield 502, extending in parallel to a column of conductive elements 504. The IMLA shield 502 may include a beam 506 extending in a direction substantially perpendicular to the plane along which the IMLA shield extends. The beam 506 may be inserted in an opening 422 and contact a portion of the T-Top interface shield 404, such as by being inserted into a shield slot 418. In the illustrated example, the IMLA shield 502 of the Type-A IMLA is electrically coupled to an IMLA shield of the Type-B IMLA through the lossy material 402 and the interface shield 404 of the core member 204.

Figure 5I:
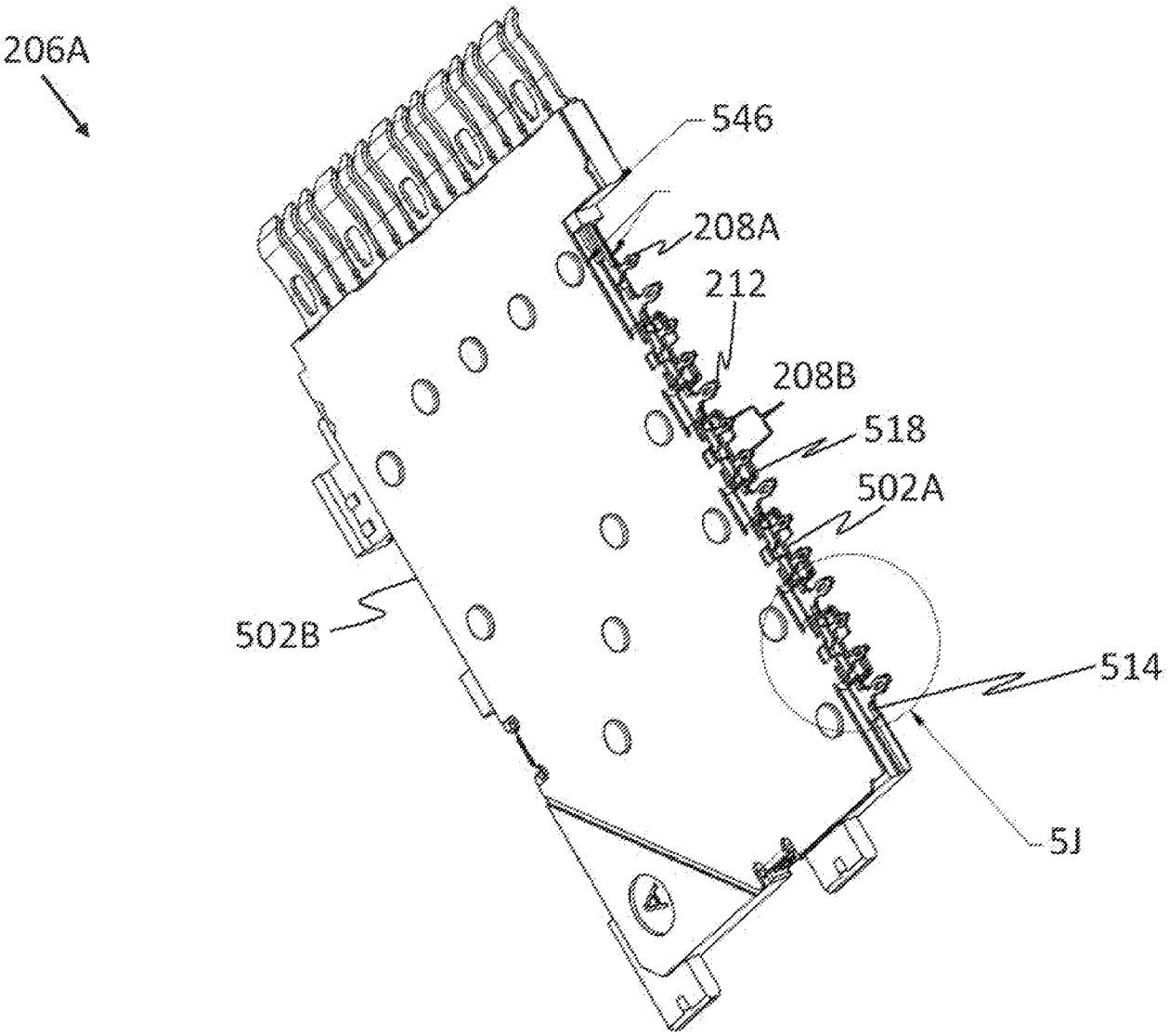
FIG. 5I is a perspective view of the Type-A IMLA of FIG. 5C, according to some embodiments.

FIG. 5I is a perspective view of the Type-A IMLA 206A, according to some embodiments. In the illustrated example, the Type-A IMLA 206A includes a leadframe 514 sandwiched between ground plates 502A and 502B. The leadframe 514 may be selectively overmolded with dielectric material 546 before the ground plates 502A and 502B are attached. FIG. 5N is an exploded view of the Type-A IMLA 206A, with dielectric material 546 removed, according to some embodiments. FIG. 5O is a partial cross-sectional view of the Type-A IMLA 206A of FIG. 5N, according to some embodiments. FIG. 5P is a plan view of the Type-A IMLA 206A, with ground plates 502A and 502B removed and showing the dielectric material 546, according to some embodiments.

The leadframe 514 may include a column of signal conductive elements. The signal conductive elements may include single-ended signal conductive element 208A and differential signal pairs 208B, which may be separated by ground conductive elements 212. In some embodiments, the conductive element 208A may be used for purposes other than passing differential signals, including passing, for example, low speed or low frequency signal, power, ground, or any suitable signals.

Shielding substantially surrounding the differential signal pairs 208B may be formed by the ground conductive elements together with the ground plates 502A, 502B. As illustrated, the ground conductive elements 212 may be wider than the signal conductive elements 208A, 208B. The ground conductive elements 212 may include openings 212H. In some embodiments, the leadframe 514 may be selectively molded with insulative material, which may substantially over mold intermediate portions of the signal conductive elements. The ground plates 502A, 502B may be attached to the over molded leadframe 514.

In some embodiments, the leadframe may include lossy material that contacts and electrically connects the ground plates and the ground conductors. In some embodiments, lossy material may extend through openings 212H in the ground conductors and/or through openings 452 of ground plates 502A and 502B to make electrical contact. In some embodiments, this configuration may be achieved by molding a second shot of lossy material after the ground plates are attached. For example, lossy material may fill at least portions of the openings 212H through the openings 452 of the ground plates 502A, 502B so as to electrically connect the ground conductive elements 212 with the ground plates 502A, 502B and seal the gap between them caused by the insulative leadframe overmold. The openings 212H of the ground conductive elements 212 and the openings 452 of the ground plates 502A, 502B may be shaped to increase tolerance for filling the lossy material. For example, as illustrated in FIG. 5N, the openings 212H of the ground conductive elements 212 may have an elongated shape compared to the openings 452 that are substantially circles. Alternatively or additionally, the lossy material may be molded over the leadframe assembly, with hubs at the surface. Ground plates 502A, 502B may be attached by pressing the hubs through openings 452.

Figure 11B:
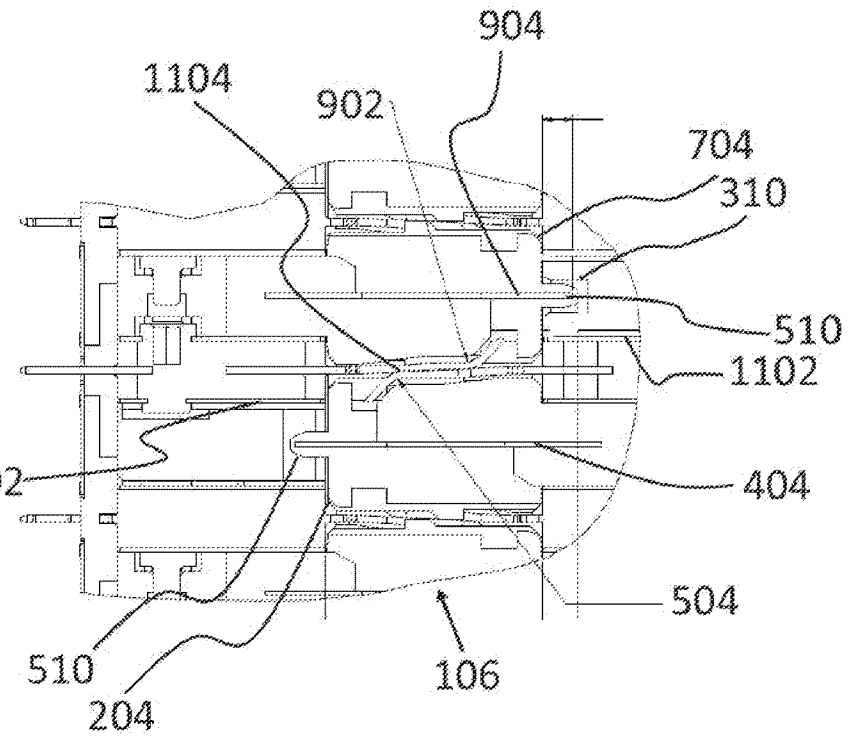
FIG. 11B is an enlarged view of the portions of the mating interface within the circle marked as "Y" in FIG. 11A, according to some embodiments.

The ground plates 502A and 502B may provide shielding for intermediate portions of the conductive elements on two sides. The ground plate 502A may be configured to face to the core member 204, for example, including features to attach to the core member 204. The ground plate 502B may be configured to face away from the core member 204. The shielding provided by the ground plates 502A and 502B may connect to shielding provided by interface shielding interconnects 214 and mating interface shielding provided by the T-Top that the leadframe is attached to and another T-Top of a mating connector, for example, as illustrated in FIG. 11B. Such configuration enables high frequency performance by shielding throughout two mated connectors.

The ground plates and/or the dielectric portions may include openings configured to receive retention features of the core member (e.g., retention features 414). It should be appreciated that, though the Type-B IMLA 206B has a different configuration of signal and ground conductors than in a Type-A IMLA, it may similarly be configured with ground plates and retention features similar to the Type-A IMLA 206A.

Each type of IMLA may include structures that connect the ground plates to ground structures on a printed circuit board to which a connector, formed with those IMLAs, is mounted. For example, the Type-A IMLA 206A may include compressible members 518, which may form portions of the mounting interface shielding interconnect 214 (FIG. 2C). In some embodiments, the compressible members 518 may be formed integrally with the ground plates 502A and 502B. For example, the compressible members 518 may be formed by stamping and bending a metal sheet that forms a ground plate. The integrally formed shielding interconnect simplifies the manufacturing process and reduces manufacturing cost.

In some embodiments, the shielding interconnect 214 may be formed to support a small connector footprint. The shielding interconnect, for example, may be designed to deform when pressed against a surface of a printed circuit board, so as to generate a relatively small counterforce. The counterforce may be sufficiently small that press fit contact tails, as illustrated in FIG. 5I, may adequately retain the connector against that counterforce. Such a configuration reduces connector footprint because it avoids the need for retaining features such as screws.

Figure 5J:
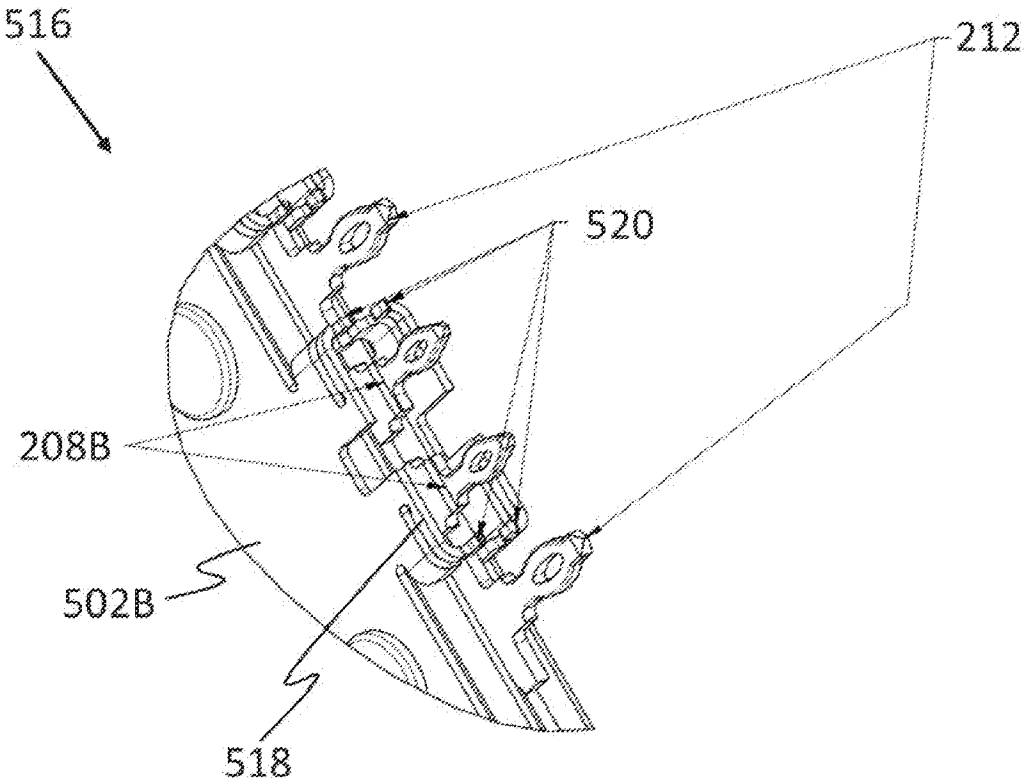
FIG. 5J is an enlarged view of the portion of the mounting interface of the Type-A IMLA within the circle marked as "5J" in FIG. 5I, according to some embodiments.
Figure 5K:
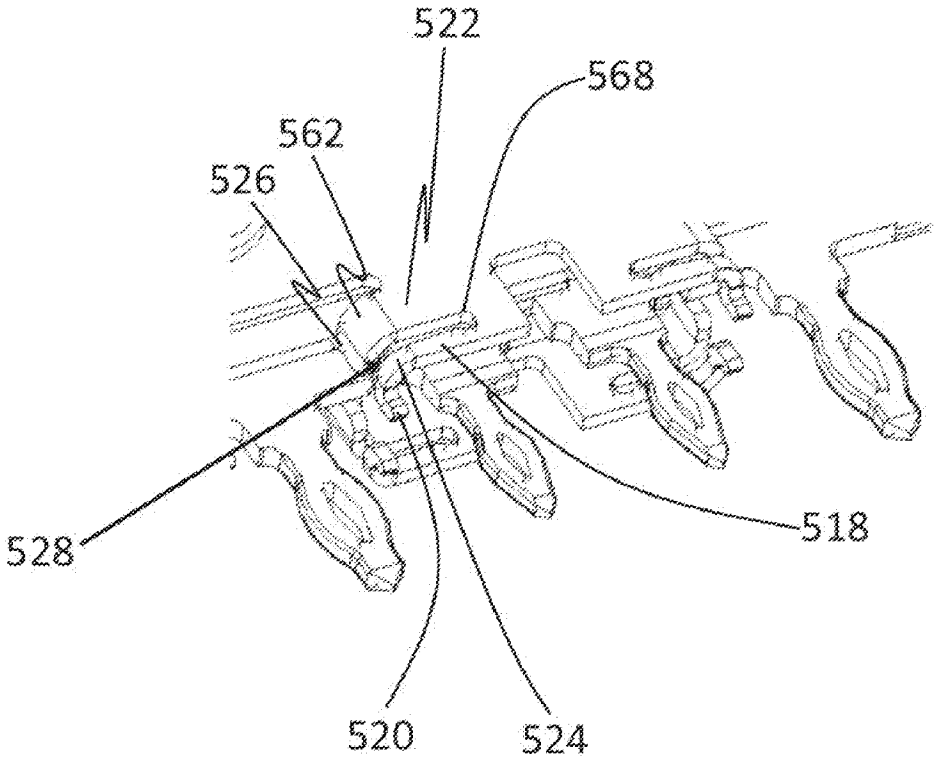
FIG. 5K is a perspective view of the portion of the Type-A IMLA in FIG. 5J, according to some embodiments.
Figure 5M:
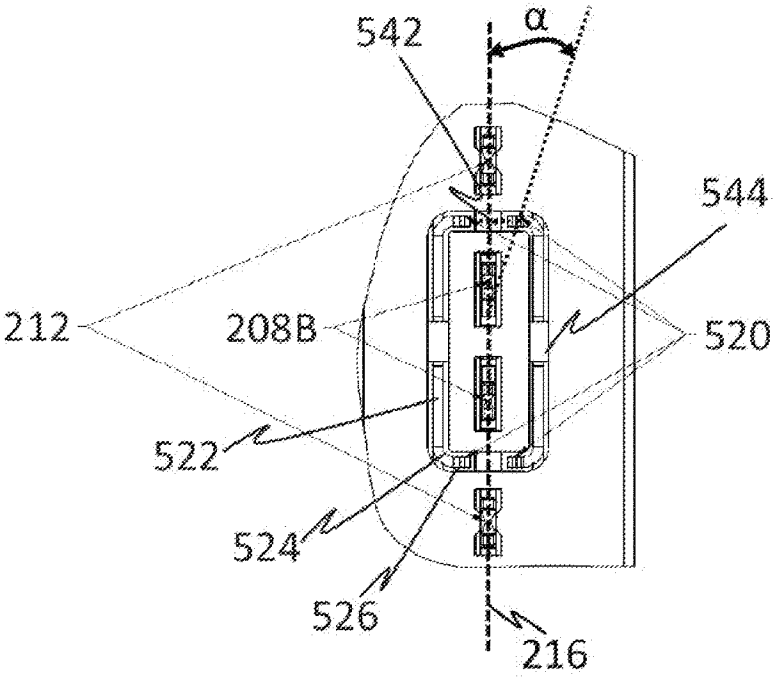
FIG. 5M is a plan view of the portion of the Type-A IMLA in FIG. 5L, according to some embodiments.
Figure 5L:
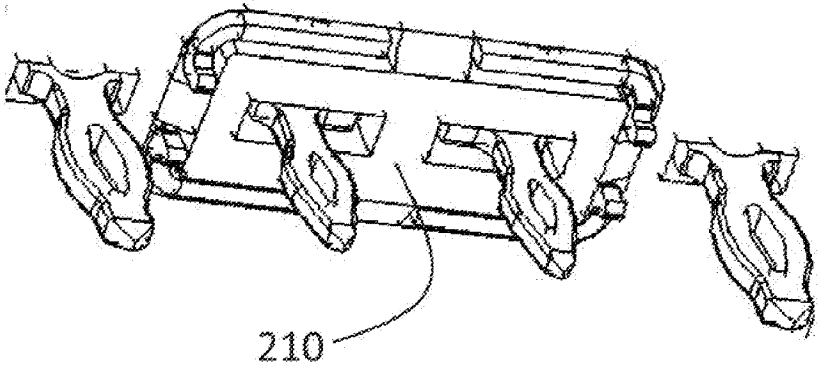
FIG. 5L is a perspective view of the portion of the Type-A IMLA in FIG. 5J with an organizer attached, according to some embodiments.
Figure 5N:
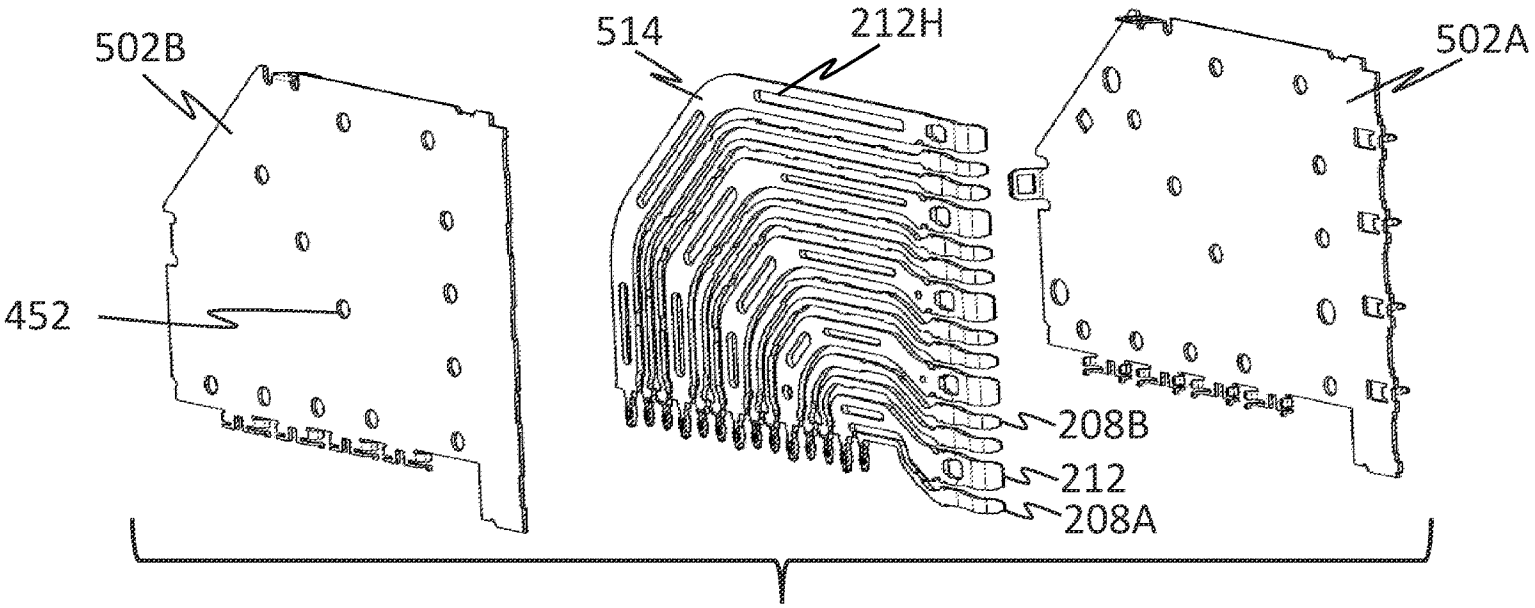
FIG. 5N is an exploded view of the Type-A IMLA of FIG. 5I, with dielectric material removed, according to some embodiments.
Figure 5O:
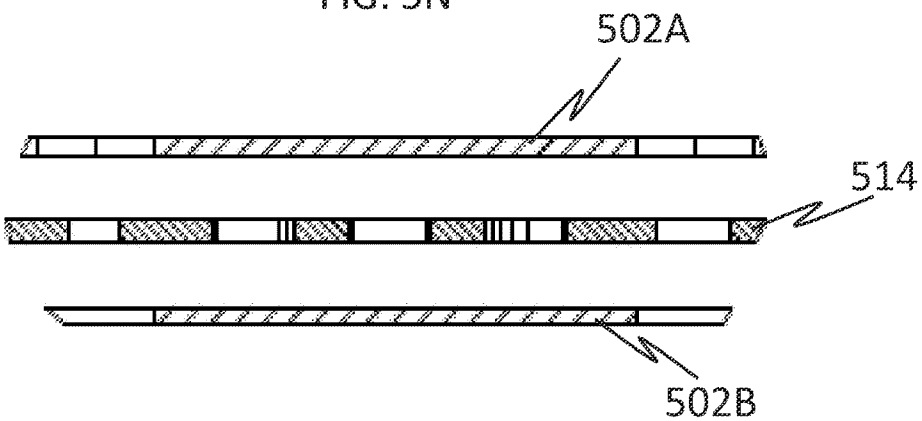
FIG. 5O is a partial cross sectional view of the Type-A IMLA of FIG. 5N, according to some embodiments.
Figure 5P:
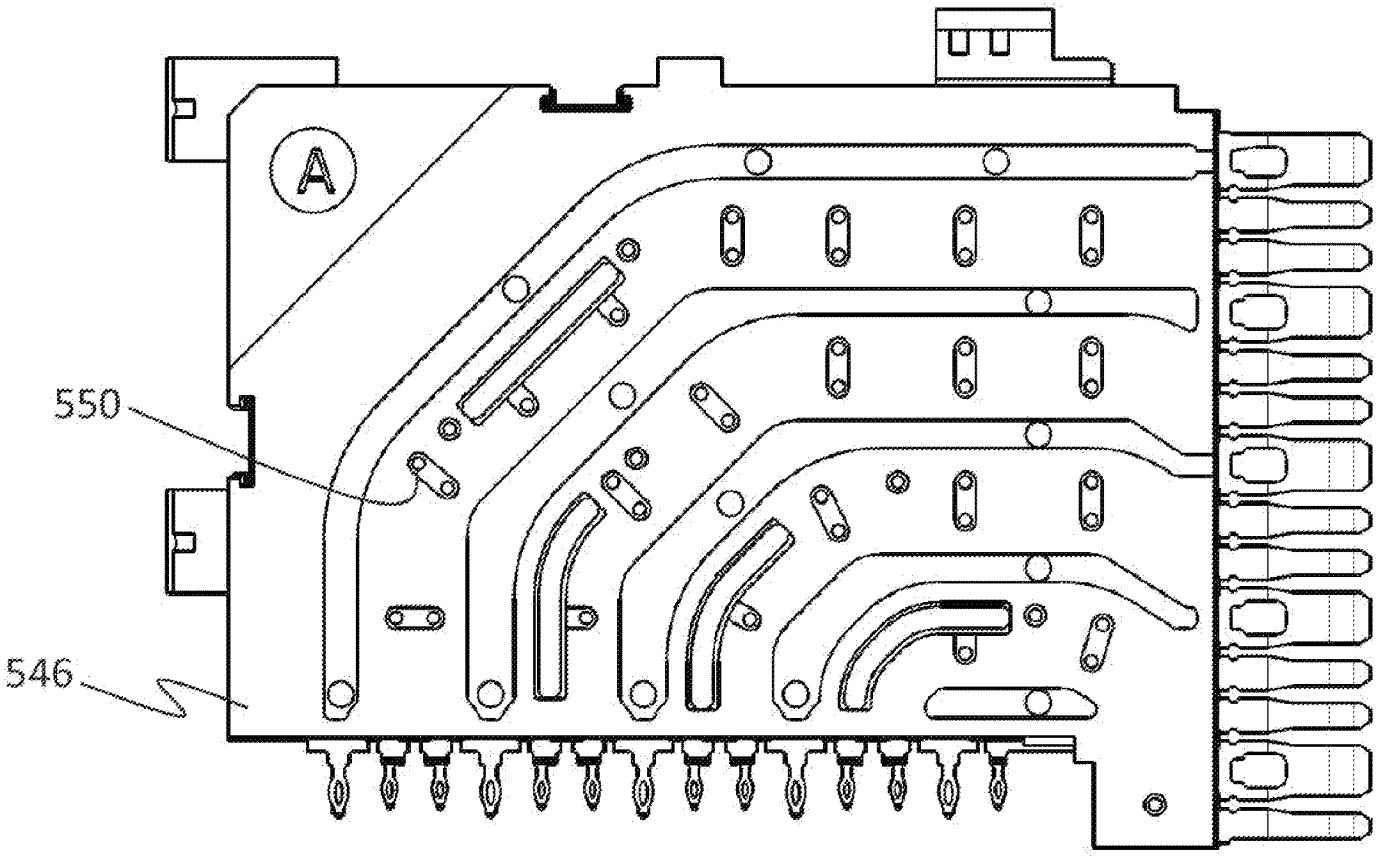
FIG. 5P is a plan view of the Type-A IMLA of FIG. 5I, with ground plates removed, according to some embodiments.

Enlarged views of a shielding interconnect 214 implemented with compressible members 518 are illustrated in FIGS. 5J-5M. FIG. 5J and FIG. 5K depict enlarged perspective views of a portion 516 of the Type-A IMLA 206A within the circle marked as "5J" in FIG. 5I, according to some embodiments. FIG. 5L and FIG. 5M depict a perspective view and a plan view, respectively, of the portion 516 of the Type-A IMLA 206A with the organizer 210 attached, according to some embodiments. The portion 516 of the Type-A IMLA 206A with the organizer 210 attached is also illustrated in FIG. 2C within the circle marked as "5L." FIGS. 5K and 5L show views taken through the neck of a press fit contact tail. The distal, compliant portion of the contact tail, shown as an eye-of-the-needle segment in FIG. 5J, may be present. Though, the contact tails may be in configurations other than eye-of-the-needle press-fits.

The shielding interconnect 214 may fill a space between the connector and the board, and provide current paths between the board's ground plane and the connector's internal ground structures such as the ground plates. In some embodiments, a pair of differential signal conductive elements (e.g., 208B) may be partially surrounded by shielding interconnects 214 extending from ground plates that sandwich the leadframe having the pair. The contact tails of the pair may be separated from the shielding interconnect 214 by dielectric material of the organizer 210.

In some embodiments, a shielding interconnect 214 may include a body 562 extending from an edge of an IMLA shield. One or more gaps 528 may be cut in body 562, creating a cantilevered compressible member 518. A distal portion of the compressible member 518 may be shaped with a tine 520. When the connector is pushed onto a board, the tines 520 may make physical contact with the board, causing deflection of compressible member 518. Compressible member 518 is cantilevered and could, in some embodiments, act as a compliant beam. In the embodiment illustrated, however, deflection of compressible member 518 generates a relatively low spring force. In this embodiment, gap 528 includes an enlarged opening 568 at the base of compressible member 518 configured to weaken the spring forces by making the compressible members 518 easier to deflect and/or deform. A low spring force may prevent the tines from springing back when contacting a board such that the connector would not be pushed off the board. The resulting spring force, per tine, may be in the range of 0.1 N to 10 N, or any suitable value in between, in some embodiments. The compressible members may or may not make physical contact with a board. In some embodiments, the compressible members may be adjacent the board, which may provide sufficient coupling to suppress the emissions at the mounting interface.

In some embodiments, a body 562 and compressible member 518 may include an in-column portion 522 extending from a ground plate (e.g., 502A or 502B), a distal portion 526 substantially perpendicular to the in-column portion 522, and a transition portion 524 between the in-column portion 522 and the distal portion 526. Such a configuration enables the shielding interconnects 214 extending from two adjacent shields to cooperate to surround, at least in part, contact tails of a pair of signal conductive elements. For example, four shielding interconnects 214 may surround a pair, as shown, two extending from each IMLA shield on each side of the signal conductive elements, one on each side of the pair.

In the illustrated, for example in FIG. 5L, there are gaps between the shielding interconnects. For examples, there are gaps 542 between the distal portion 526 of shielding interconnects 214 on opposite sides of a pair of signal conductors. There are also gaps 544 between the in-column portion 522 of shielding interconnects 214 on the same sides of a pair of signal conductors. Bridges 266 of the organizer 210 may at least partially occupy the gaps 542 and 544. Nonetheless, the illustrated configuration may be effective at reducing resonances in the ground structures of the connector over a desired operating range of the connector, such as up to 112 Gbps or higher.

In some embodiments, tines 520 on compressible member 518 may be selectively positioned so as to more effectively suppress resonances. The tines, 520, as they provide a path for high frequency ground return current to flow to or from the ground plane of the PCB provide a reference for electromagnetic waves. In the illustrated example, the tines 520 and therefore the location of the references are positioned where the electromagnetic fields around the pair of signal conductors partially surrounded by shielding interconnects 214 is high. In the illustrated example, the electromagnetic field around the pair of tails of signal conductors may be the strongest between pairs in a column, but offset from the centerline 216 of the column by an angle α in the range of 5 to 30 degrees, or 5 to 15 degrees, or any suitable number in between. Accordingly, tines 520 positioned in this location with respect to the tails of the signal conductors of each pair may be effective at reducing resonances and improving signal integrity.

In the illustrated example, the tines 520 extend from the distal portions 526. It should be appreciated that the present disclosure is not limited to the illustrated positions for the tines 520. In some embodiments, the tines 520 may be positioned, for example, extending from the in-column portions 522 or the transition portions 524. It also should be appreciated that the present disclosure is not limited to the illustrated number of the tines 520. A differential signal pair may be surrounded by four tines 520 as illustrated, or more than four tines in some embodiments, or less than four tines in some embodiments. Further, it should be appreciated that it may not be necessary for all tines to make physical contact with the ground plane of a mounting board. A tine may or may not make physical contact with a mounting board, for example, depending on the actual surface topology of the mounting board. For example, the times 520 may be positioned to make physical or capacitive contact with ground vias 244 in FIG. 2D.

A Type-B IMLA may similarly have compressible members positioned with respect to pairs of signal conductors as shown in FIGS. 5J and 5K. The arrangement of pairs within a column, however, may differ between a Type-A and a Type-B IMLA.

Figure 5Q:
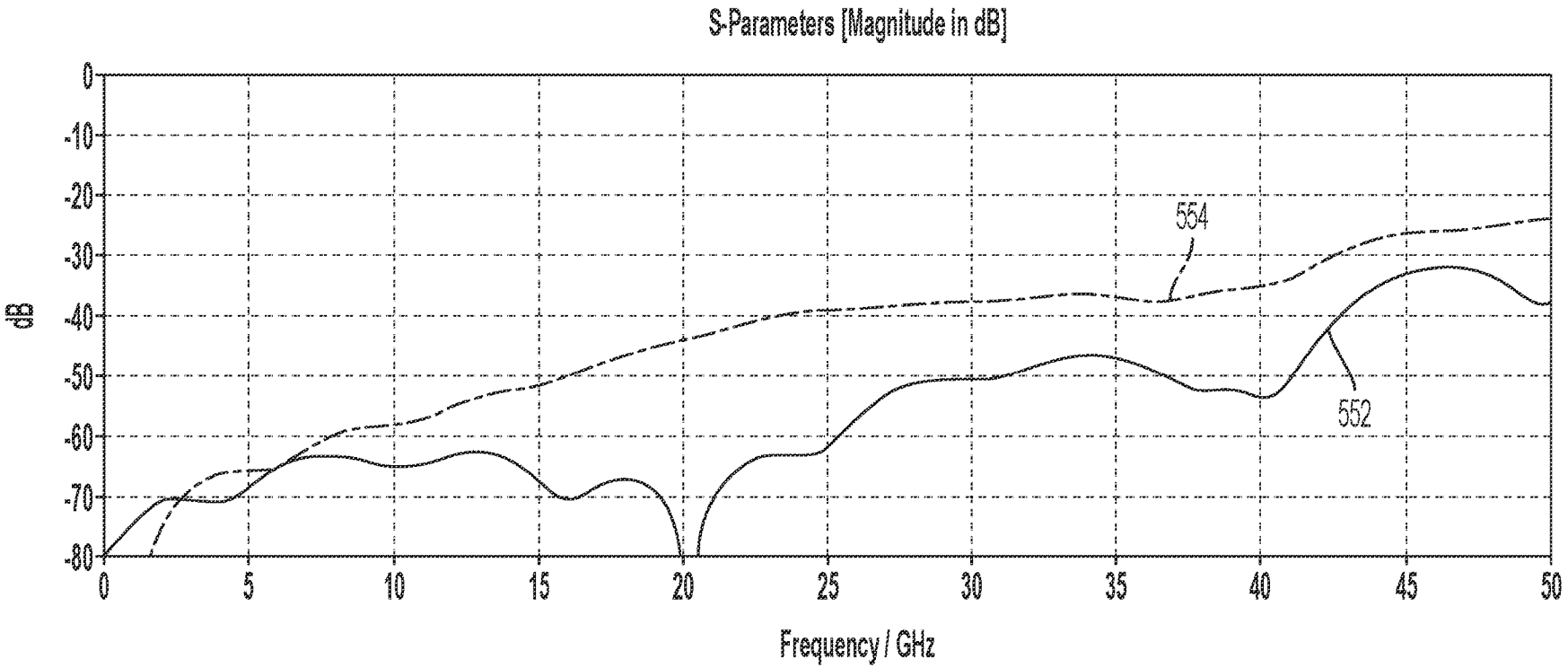
FIG. 5Q is an S-parameter chart across a frequency range of the connector of FIG. 2C compared with a connector with a conventional mounting interface, showing an S-parameter representing crosstalk from a nearest aggressor within a column, according to some embodiments.

FIG. 5Q shows simulation results of an S-parameter across a frequency range. The S-parameters represent crosstalk from a nearest aggressor within a column. The simulation results illustrate the S-parameter result 552 of the connector 200 with the mounting interface shielding interconnect 214, compared with the S-parameter result 554 of a counterpart connector with a conventional mounting interface, according to some embodiments. As illustrated, the connector 200 significantly reduces crosstalk while insertion loss and return loss are maintained. In some scenarios, the operating range of the connector may be set by the magnitude of the S-parameter as a function of frequency. The operating frequency range may be defined, for example, as the frequency range over which the S-parameter is greater than or less than some threshold amount. As a specific example, the operating frequency range may be based on the S-parameter having a value less than -30 dB. In the example of FIG. 5P, trace 552 shows an operating frequency range exceeding 50 GHz, which is an improvement over a conventional connector, represented by trace 554, with an operating frequency range less than 45 GHz.

FIGS. 6A-6F depict a side IMLA assembly 202A, according to some embodiments. The side IMLA assembly 202A may include a core member 204A. One side of the core member 204, illustrated in FIG. 6C, may be attached with a Type-A IMLA 206A. The other side of the core member 204A, illustrated in FIG. 6F, may form part of an insulative enclosure of the connector. The core member 204A may, on the side receiving IMLA 206A be shaped in the same way as core member 204, described above. The opposing side, which need not include features to receive an IMLA, may be flat.

Figure 6B:
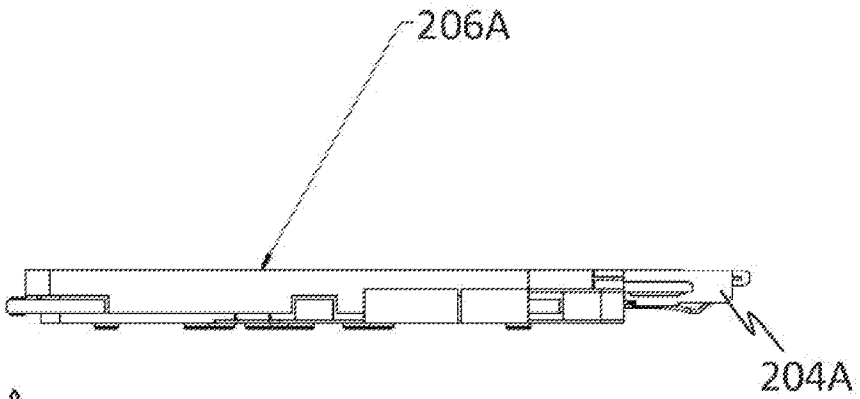
FIG. 6B is a top view of the side IMLA assembly of FIG. 6A, illustrating a single Type-A IMLA attached to one side of a core member, according to some embodiments.
Figure 6A:
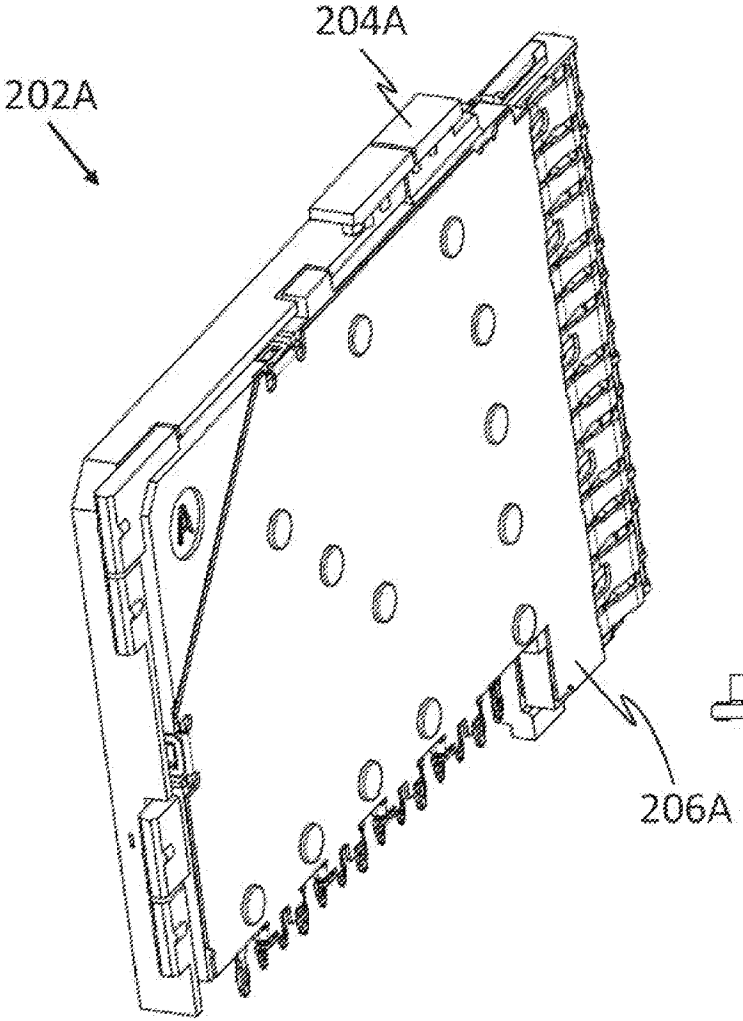
FIG. 6A is a perspective view of a side IMLA assembly, according to some embodiments.
Figure 6D:
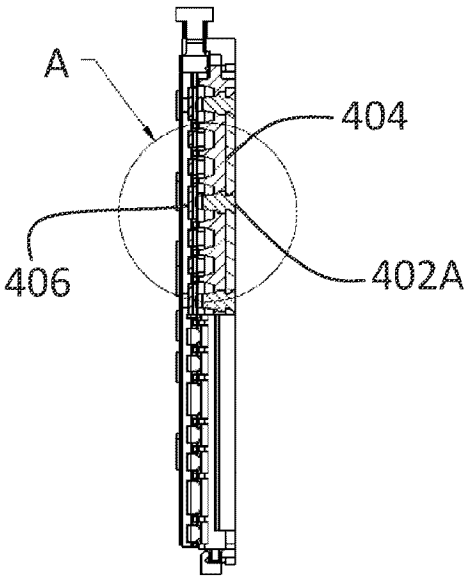
FIG. 6D is a cross sectional view along line M-M in FIG. 6C, illustrating a mating end of the side IMLA assembly of FIG. 6A, according to some embodiments.

FIG. 6D depicts a front view of the side IMLA assembly 202A, partially cut away, according to some embodiments. FIG. 6D reveals the positioning of lossy material 402A, with ribs 406, adjacent to the mating contact portions of the ground conductors. A shield 404 is also adjacent and parallel to the mating contact portions, as in FIG. 5E. The lossy material 402A underneath the ground conductors electrically connects the ground conductors to the shield 404, and thus reduces crosstalk between pairs of signal conductors separated by the ground conductors.

Figure 6E:
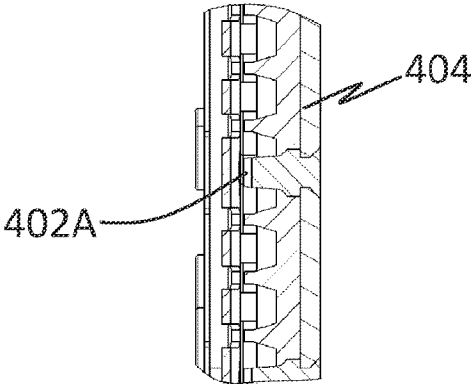
FIG. 6E is an enlarged view of the portion of the side IMLA assembly within the circle marked as "A" in FIG. 6D, according to some embodiments.
Figure 6C:
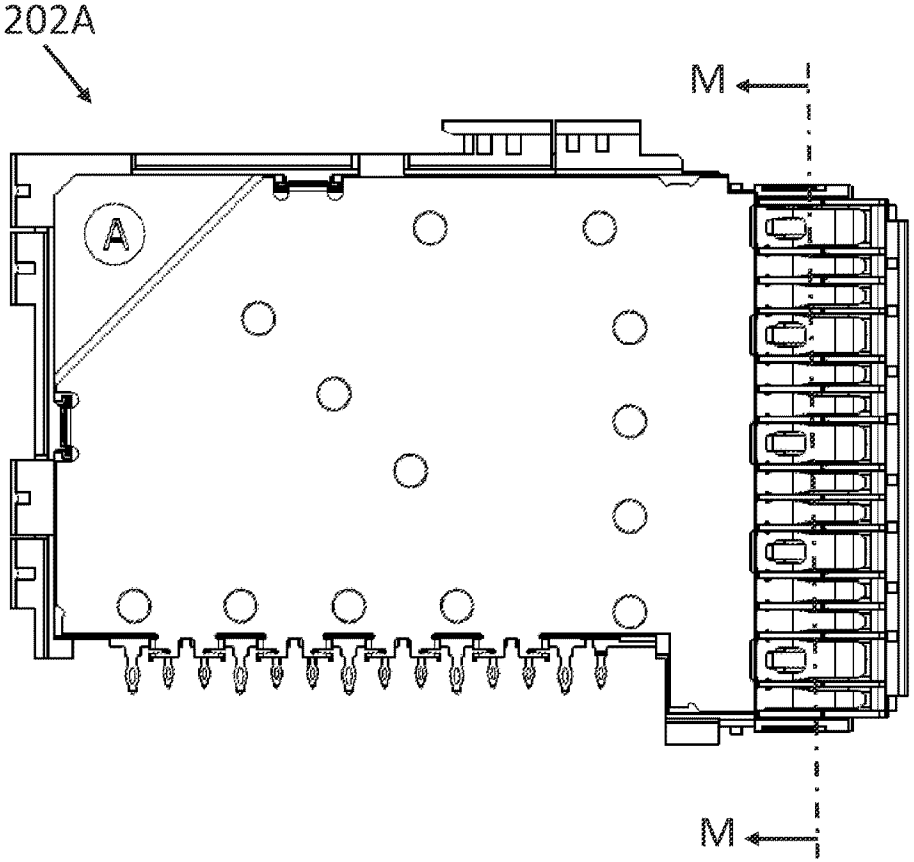
FIG. 6C is a side view of the side IMLA assembly of FIG. 6A, showing a side with a Type-A IMLA attached, according to some embodiments.
Figure 6F:
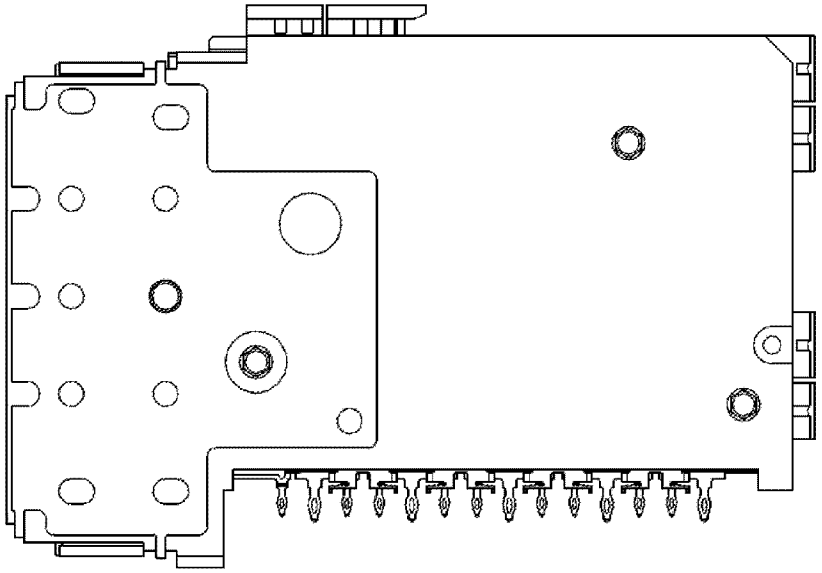
FIG. 6F is a side view of the side IMLA assembly of FIG. 6A, showing a side at an end of a row of IMLA assemblies, according to some embodiments.

FIG. 6E depicts an enlarged view of the circle marked as "A" in FIG. 6D, according to some embodiments. Although the side IMLA assembly 600 is illustrated as being attached with a Type-A IMLA 206A, it should be appreciated that a side IMLA assembly may be formed to receive a Type-B IMLA 206B. A core member for such a Type-B IMLA may, like the core member 204A, have features to receive an IMLA on one side and may be flat on the other side, or otherwise configured as an exterior wall of a connector. The core member for a Type-B IMLA assembly may differ from core member 204A in that it is configured to receive a Type-B IMLA, with a different configuration of conductive elements, on the opposite side relative to a Type-A core member. For example, insulative and conductive ribs may be on the opposite side, as are pre-load features 512.

Figure 7B:
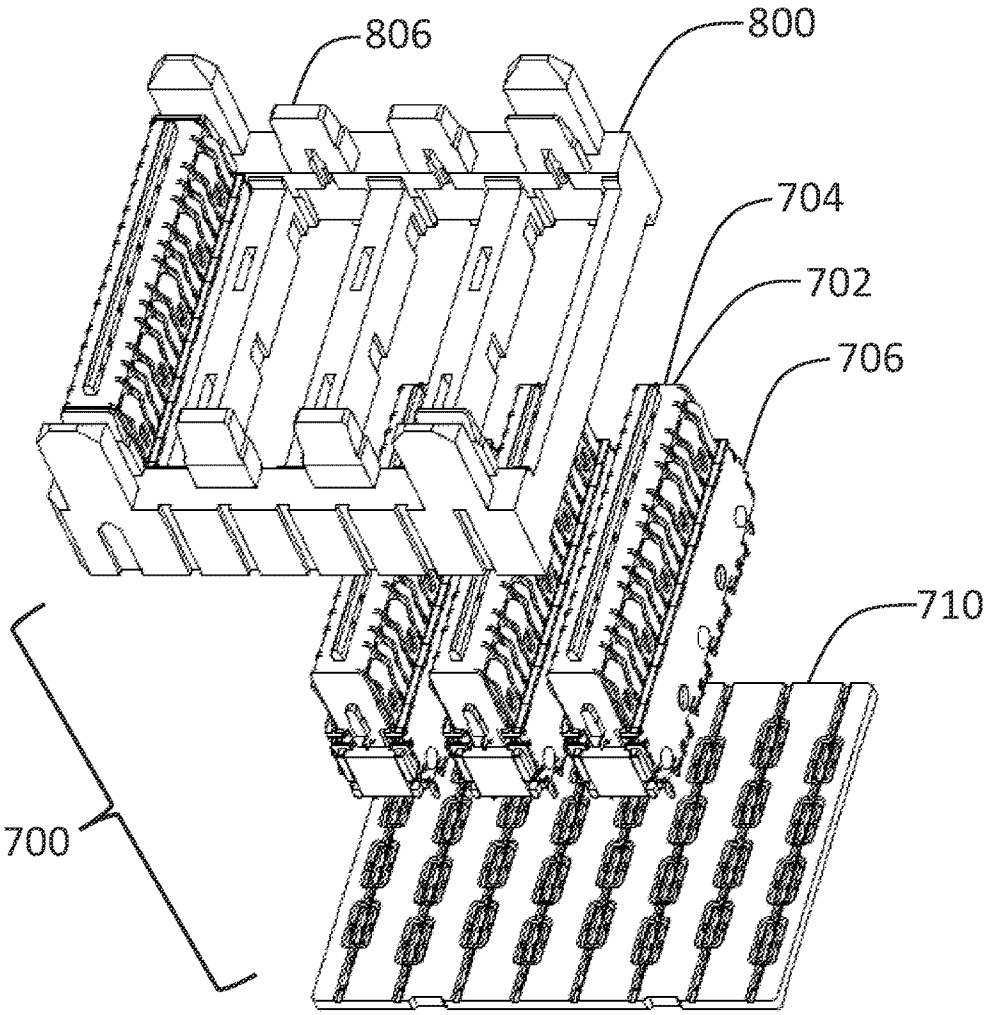
FIG. 7B is an exploded view of the header connector of FIG. 7A, according to some embodiments.
Figure 7A:
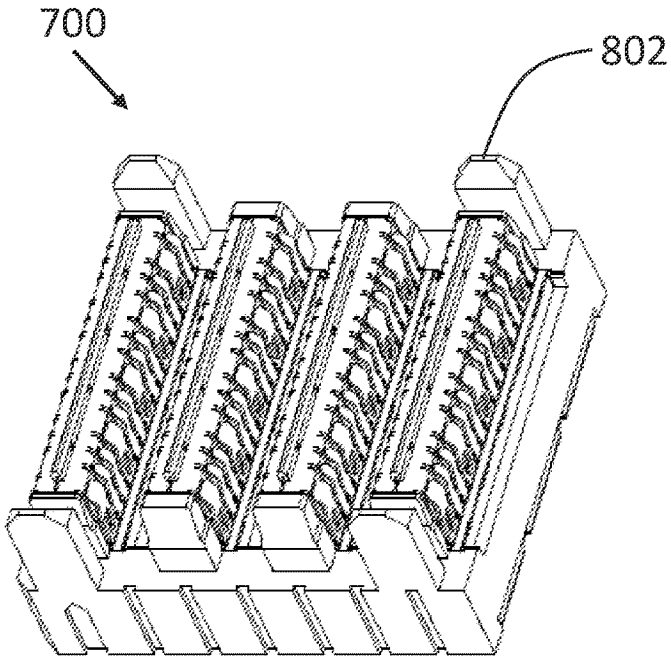
FIG. 7A is a perspective view of the header connector of FIG. 1A, according to some embodiments.

A right-angle connector may mate with a header connector. FIGS. 7A and 7B depict a perspective view and exploded view of the header connector 700, according to some embodiments. The header connector 700 may include dual IMLA T-Top assemblies 702 aligned in a row in a housing 800. A T-Top assembly 702 may include a core member 704 attached with at least one leadframe assembly 706. The header connector 700 may include an organizer 710 attached to its mounting end.

Though the header connector is vertical, rather than right angle as for connector 200, similar construction techniques may be applied. For example, leadframe assemblies may be formed by molding insulative materials over a column and attaching leadframe assembly shields. Those assemblies may be attached to core members that are then inserted into a housing to form a connector.

The mating interface may be configured to be complimentary to the mating interface of connector 200. In this embodiment, the IMLA assemblies of header connector 700 fit between the A-Type and B-Type side IMLA assemblies, such that header connector 700 does not have separate side IMLA assemblies forming a side of header connector 700. Accordingly, in the embodiment illustrated, all of the IMLA assemblies of header connector 700 are two-sided IMLA assemblies.

Figure 8B:
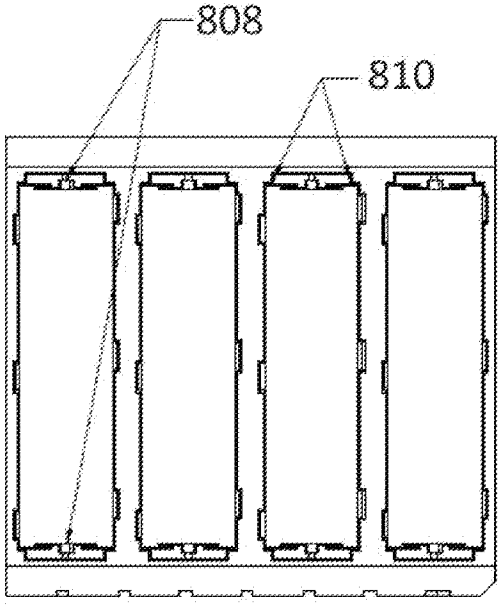
FIG. 8B is a mounting end view of the connector housing of FIG. 8A, according to some embodiments.
Figure 8A:
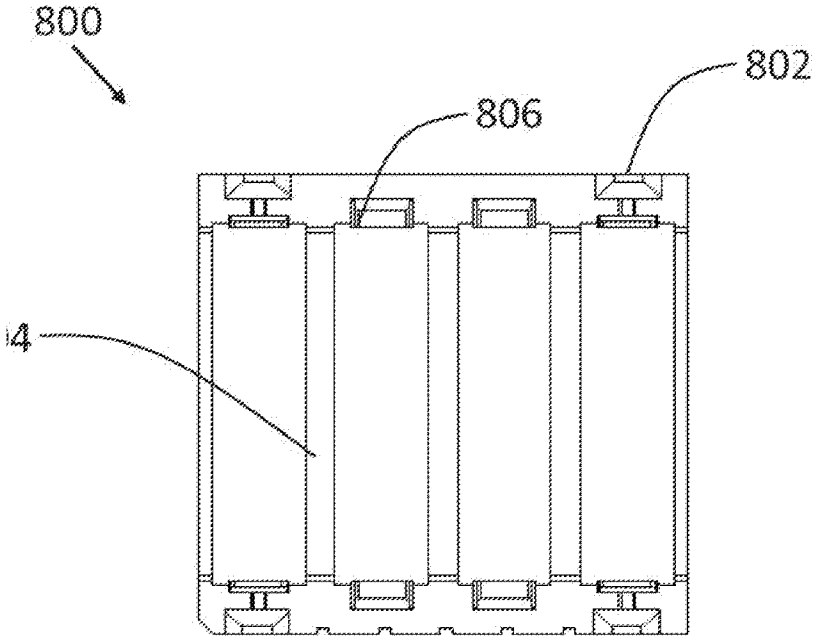
FIG. 8A is a mating end view of a connector housing of the header connector of FIG. 7A, according to some embodiments.

FIGS. 8A and 8B depict a mating end view and a mounting end view of the housing 800 respectively, according to some embodiments. The housing 800 may include mating keys 802 configured to insert into matching slots in a housing of a mating connector, for example, mating keyways 308 of the housing 300 (FIG. 3B). The housing 800 may include walls 804 configured to separate adjacent T-Top assemblies 702 and provide isolation and mechanical support. The walls 804 may include slots (not shown) configured to receive the distal ends of the T-Top region 410 of the right angle connector 200. The housing 800 may include pairs of members 806 and pairs of IMLA support features 810. Each pair of the members 806 may include alignment features 808 configured to align and secure a T-Top assembly, and IMLA support features 810 configured to provide mechanical support to leadframe assemblies of the T-Top assembly. It should be appreciated that the housing 800 does not include complex and thin features required by conventional connectors, and thus is easier to manufacture. Housing 800 may be easily formed in a mold that closes and opens in a direction perpendicular to the surfaces shown in FIGS. 8A and 8B. Fine features, such as insulative and lossy ribs, and preload features may be formed in the T-top portions of the core members, as described above.

Figure 9A:
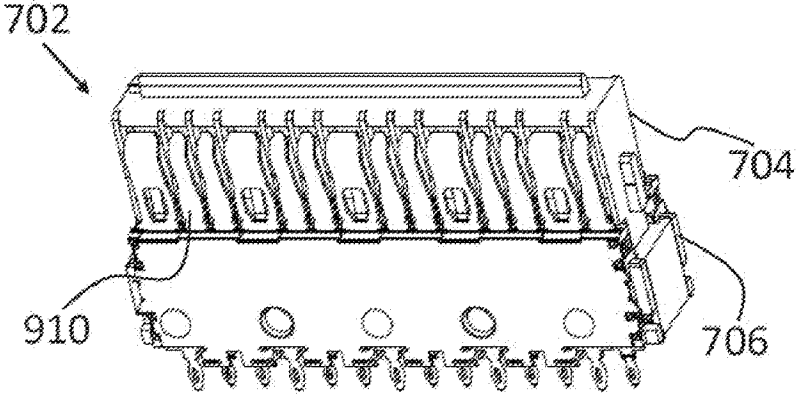
FIG. 9A is a perspective view of a dual IMLA assembly of the header connector of FIG. 7A, according to some embodiments.
Figure 9B:
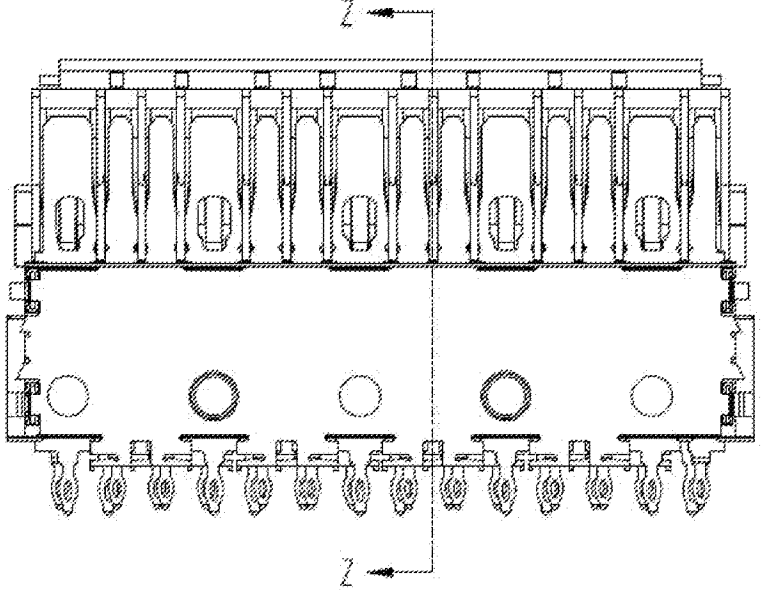
FIG. 9B is a side view of the dual IMLA assembly of FIG. 9A, according to some embodiments.
Figure 9C:
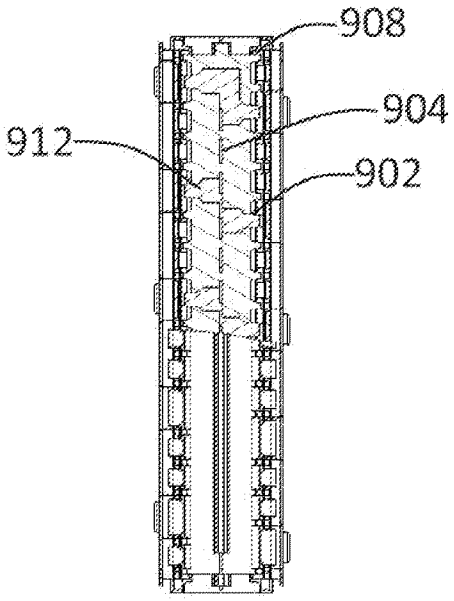
FIG. 9C is a mating end view of the dual IMLA assembly of FIG. 9A, partially cut away, according to some embodiments.
Figure 9D:
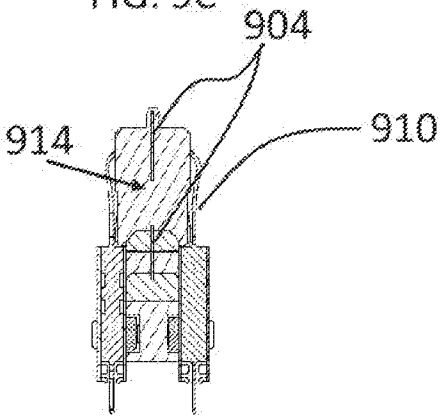
FIG. 9D is a cross sectional view along line Z-Z in FIG. 9B, according to some embodiments.

In some embodiments, the dual IMLA assemblies 702 of the header connector 700 may include features similar to those of the dual IMLA assemblies 202C of the right angle connector 200. FIGS. 9A and 9B depict a dual IMLA assembly 702 of the header connector 700, according to some embodiments. FIG. 9C depicts a mating end view of the dual IMLA assembly 702, partially cut away, according to some embodiments. FIG. 9D depicts a cross-sectional view along line Z-Z in FIG. 9B, according to some embodiments.

The dual IMLA assembly 702 may include a core member 704 to which two leadframe assemblies 706 are attached. Each leadframe assembly 706 may include multiple conductive elements 910 aligned in a column. The core member 704 may include a T-Top interface shield 904, lossy material 902 selectively molded over the interface shield 904, and insulating plastic 908 selectively molded over the lossy material 902 and interface shield 904. Although a gap 914 between two portions of the interface shield 904 is illustrated in FIG. 9D, it should be appreciated that the interface shield 904 may be a unitary piece. The gap 914 may be the cross-sectional view of a hole cut out of the shield such that other materials (e.g., lossy material 902 and/or insulative material 908) can flow around the shield 904. The lossy material 902 may include ribs 912 extending from the interface shield 904 towards ground conductive elements of the leadframe assemblies such that the ground conductive elements are electrically connected through the lossy material 902 and the interface shield, which reduces resonances, and otherwise improves signal integrity. Although the illustrated example shows only dual IMLA assemblies for the header connector 700, a header connector may include side IMLA assemblies, for example, configured similar to side IMLA assemblies 202A, 202B of the right angle connector 200. Such a configuration would enable the header to mate with a right angle connector without side IMLA assemblies. In some embodiments, the IMLA assemblies on opposite sides of a core member may have conductive elements disposed in the orders that are complimentary to a mating right angle connector. For example, the IMLA assemblies on opposite sides of a core member may include leadframes that are complimentary to the leadframes of the Type-A IMLA 206A and Type-B IMLA 206B respectively.

Figure 10A:
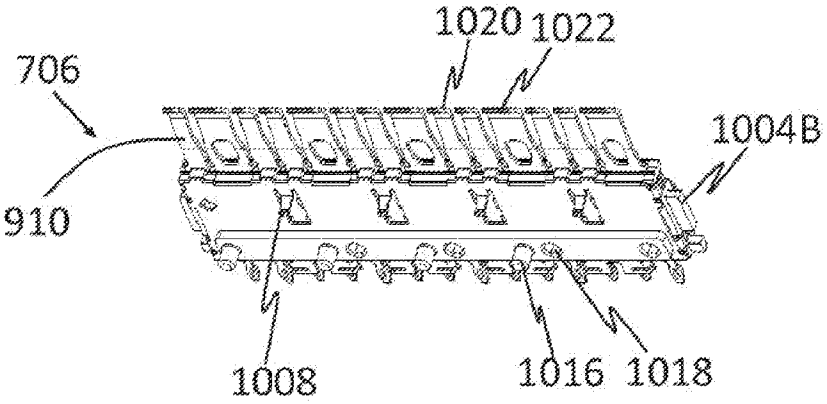
FIG. 10A is a perspective view of a leadframe assembly of the dual IMLA assembly of FIG. 9A, according to some embodiments.
Figure 10C:
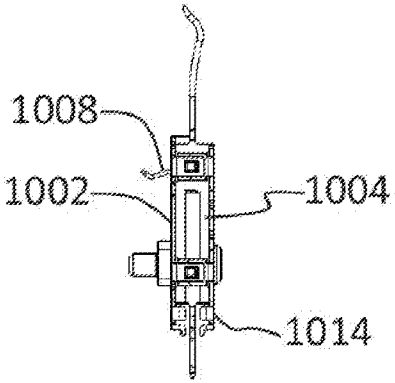
FIG. 10C is a side view of the leadframe assembly of FIG. 10A, according to some embodiments.
Figure 10D:
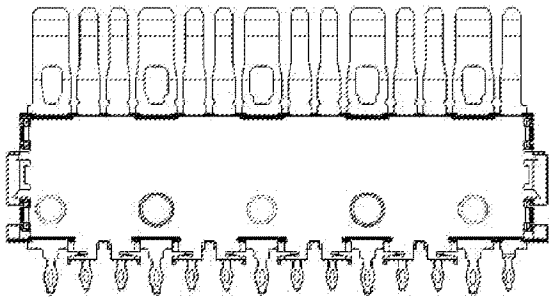
FIG. 10D is a view of the side of the leadframe assembly of FIG. 10A facing away from a core member, according to some embodiments.
Figure 10B:
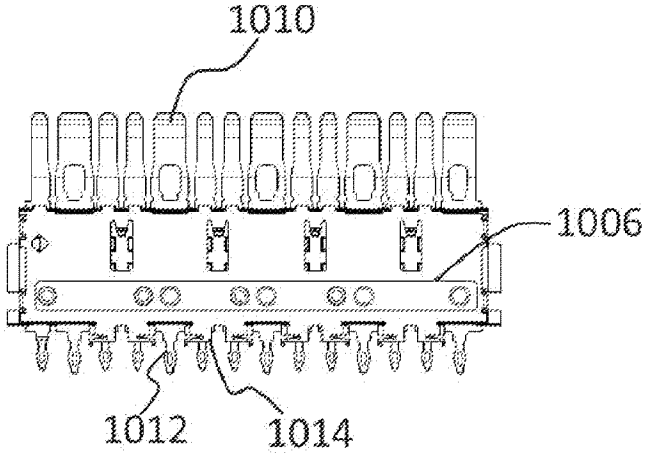
FIG. 10B is a view of the side of the leadframe assembly of FIG. 10A facing to a core member, according to some embodiments.

FIG. 10A depicts a perspective view of a leadframe assembly 706 of the dual IMLA assembly 702, according to some embodiments. FIG. 10B depicts an elevation view of the side of the leadframe assembly 706 facing to the core member 704, according to some embodiments. FIG. 10C depicts a side view of the leadframe assembly 706, according to some embodiments. FIG. 10D depicts an elevation view of the side of the leadframe assembly 706 facing away from the core member 704, according to some embodiments.

In some embodiments, the leadframe assembly 706 may be manufactured by molding insulative material 1004 over a leadframe including the column of conductive elements 910, attaching ground plates 1002 to sides of the column of conductive elements 910 molded with insulative material 1004, and selectively molding a lossy material bar 1006. The insulative material 1004 may include a projection 1004B configured for secondary alignment and support. The lossy material bar may be configured to retain the ground plates 1002, and provide electrical connection between the ground plates and ground conductive elements of the column while maintaining isolation from signal conductive elements of the column. In some embodiments, the lossy material bar 1006 may include ribs or other projections extending towards ground conductive elements 1022.

In some embodiments, the column of conductive elements 910 may include signal conductive elements (e.g., 1020) separated by ground conductive elements (e.g., 1022). The signal conductive elements may include signal mating portions and signal mounting tails. The ground conductive elements may be wider than the signal conductive elements and may include ground mating portions 1010 and ground mounting tails 1012.

In some embodiments, the ground plates 1002 may include beams 1008 extending substantially perpendicular to a length of the conductive elements 910 and towards a core member that the leadframe assembly 706 configured to be attached to. In some embodiments, the beams 1008 may be positioned adjacent to the signal conductive elements 1020. In such a configuration, the ground current path through the IMLA shields and T-Top shields is closer to and generally parallel to the signal conductive elements, which may improve the shielding effectiveness and enhance signal integrity. In some embodiments, the ground plates 1002 may not include beams 1008, for example, as illustrated in FIG. 9D.

In some embodiments, the lossy material bar 1006 may include retention features such as projections 1016 and openings 1018. In some embodiments, the core member may include projections and openings to insert into the openings 1018 and receive the projections 1016. In some embodiments, the core member may be configured to enable the projections 1016 pass through and insert into the openings of a complimentary leadframe assembly attached to a same core member. For example, the projections 1016 may be configured to attach to openings of a complimentary leadframe assembly attached to a same core member. The openings 1018 may be configured to receive projections of the complimentary leadframe assembly attached to the same core member. Such retention features provide mechanical support for a dual IMLA assembly, and also provide current paths between ground structures of the dual IMLA assembly.

As with the right angle connector 200, the header connector 700 may include mounting interface shielding interconnects. The mounting interface shielding interconnects may be formed by compressible members 1014, for example, extending from the shields 1002. The compressible members 1014 may be configured similar to compressible members 518.

Figure 11A:
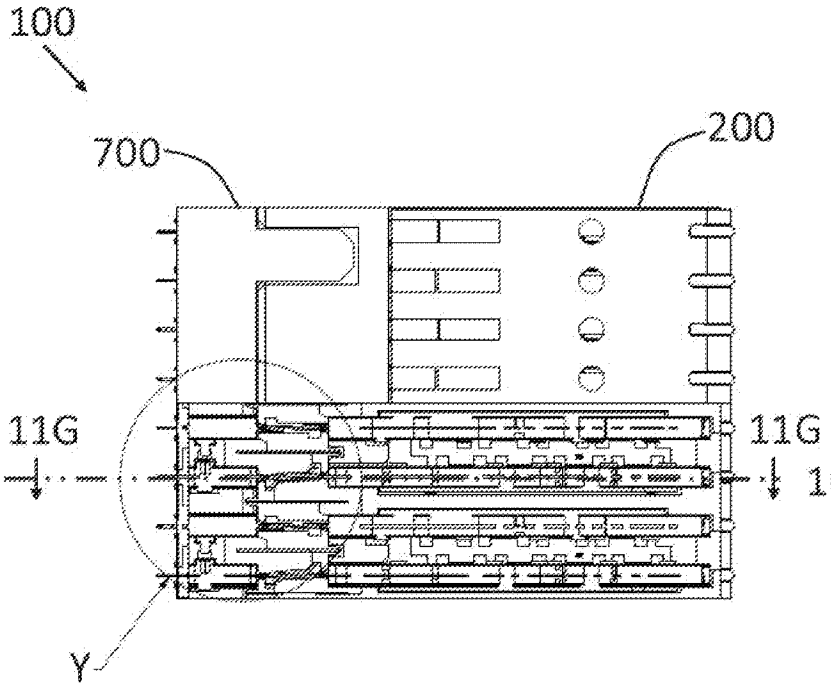
FIG. 11A is a top view of the mated connectors of FIG. 1A, partially cut away, according to some embodiments.

FIG. 11A depicts a top view of the electrical interconnection system 100, partially cut away, according to some embodiments. FIG. 11B depicts an enlarged view of the circle marked as "Y" in FIG. 11A, according to some embodiments.

In the illustrated example, the right angle connector 200 and the header connector 700 are mated by forming electrical connection between conductive elements 504 of the right angle connector 200 and conductive elements 902 of the header connector 400 at one or more contact locations 1104. FIG. 11B illustrates in cross section a portion of header connector 700 and a portion of the right angle connector 200 at which a conductive element from each of the connectors are mated. The conductive elements may be signal conductive elements or ground conductive elements, as, in the illustrated embodiment, both have the same profile in cross section.

In this configuration, mated portions of the conductive elements 504 and 902 are shielded by the T-Top interface shield 404 of the core member 204 of the right angle connector 200 and the T-Top interface shield 904 of the core member 704 of the header connector 700. In this way, the shielding configuration, with planar shields on both sides of the conductive elements, is carried into the mating interface of the mated connectors. However, rather than that two-sided shielding being provided by the IMLA shields 502 or 1002 as for the intermediate portions of the conductive elements within the IMLA insulation, the two-sided shielding is provided by the T-Top shields of the two T-Tops carrying the mating contact portion of the two mated conductive elements.

It also should be appreciated that the T-Top interface shield 404 of the core member 204 of the right angle connector 200 overlaps with the shield 1002 of the leadframe assembly 706 of the header connector 700 when the connectors are mated. The T-Top interface shield 904 of the core member 704 of the header connector 700 overlaps with the shield 1002 of the leadframe assembly 206 of the right angle connector 200 when the connectors are mated. A length of the overlaps may be controlled by a length of extensions of interface shields (e.g., extension 510 of the T-Top interface shield 404). The extension 510 may have a thickness smaller than the rest of the core member such that the extension 510 can be inserted into a matching opening of a mating connector. The above described configuration of T-Top interface shields 404 and 904 of the core members 204 and 704 not only provides shielding for the mated portions of the conductive elements at the mating interface 106 but also reduces shielding discontinuity caused by the change from the internal shields of leadframe assemblies (e.g., shields 1002, 1102) to the interface shields (e.g., T-Top interface shields 404, 904).

A method of operating connectors 200 and 700 to mate with each other in accordance with some embodiments is described herein. Such a method may enable conductive elements to have short lead-in segments between a contact point and distal end, which enhances high frequency performance. Yet, there may be a low risk of stubbing. FIGS. 11C - 11F depict enlarged views of the mating interface of the two connectors of FIG. 1A, or connectors in other configurations with similar mating interfaces. FIG. 11G depicts an enlarged partial plan view of the mating interface along the line marked "11G" in FIG. 11A. A conductive element may include a curved contact portion 1106 with a contact location on a convex surface. The contact portion 1106 may extend from an intermediate portion of the conductive element and from the insulative portion of the IMLA into an opening 1110. For mating to another connector, the contact portion may press against a mating conductive element. A tip 1108 may extend from the contact portion 1106. As illustrated in FIG. 11G, mated pairs of signal conductive elements of connectors 200 and 700 may have mated ground conductive elements of the connectors on their sides to block energy propagating through the grounds and thus reduce cross talk.

FIGS. 11C-11F illustrate a mating sequence that operates with a tip 1108 that can be shorter than in a conventional connector. In contrast to a connector in which the tip of a mating portion of a conductive element may be retained by a feature in the housing enclosing the conductive element, tip 1108 is free and substantially fully exposed in the opening into which mating conductive element 902 will be inserted. In a convention connector, such a configuration risks stubbing of the conductive elements as the connectors are mated. However, stubbing of conductive elements 902 and 504 is avoided because each conductive element is moved out of the path of the other conductive element by a feature on a housing around the other conductive element.

Figure 11C:
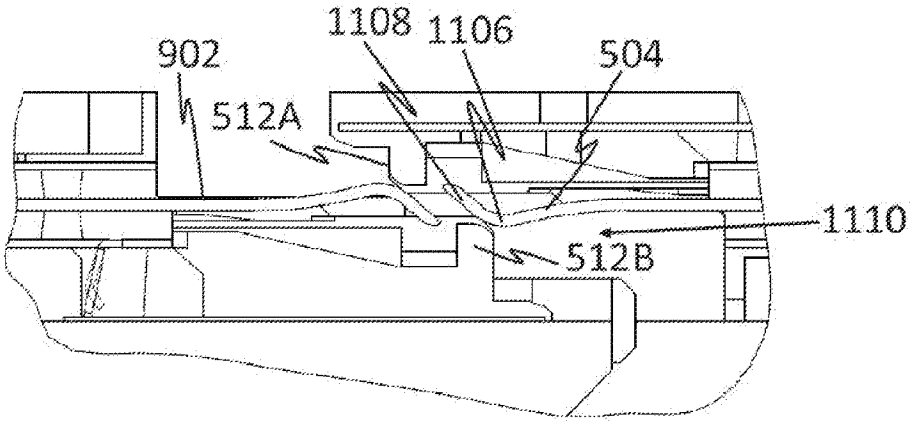
FIGS. 11C - 11F are enlarged views of the mating interface of the connectors of FIG. 1A, at successive steps in mating, illustrating a method of mating the connectors, according to some embodiments.

The method of operating connectors 200 and 700 may start with bringing the connectors together so that mating conductive elements are aligned, as illustrated in (FIG. 11C). In this state, the conductive element 504 of the right angle connector 200 and conductive elements 902 of the header connector 700 may be in respective rest states, and aligned with one another in a mating direction.

Figure 11D:
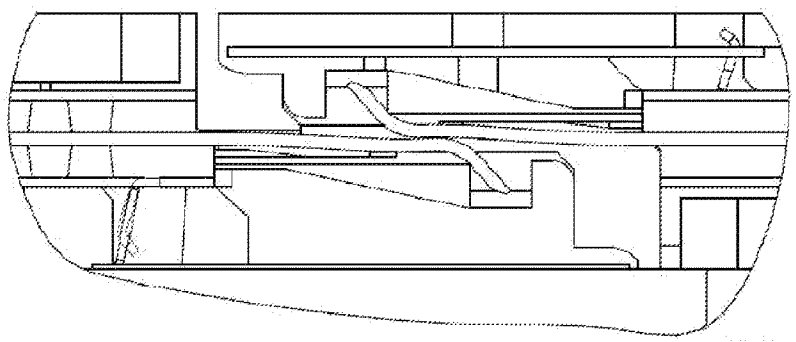

Connectors 200 and 700 may be further pressed together in the mating direction until they reach the state illustrated in FIG. 11D. In this state, conductive element 504 of the right angle connector 200 has engage with a preload feature 512B of the header connector 700. To reach this state, the angled lead-in portions of 1108 slid along tapered leading edge of preload feature 512B. The preload feature 512B of the header connector 700 deflected the conductive element 504 of the right angle connector 200 from its rest state.

In this example, both connectors have similar mating interface elements, and conductive element 902 of the header connector 700 has similarly engaged with preload feature 512A of the right angle connector 200. The preload feature 512A of the right angle connector 200 deflected the conductive element 902 of the header connector 700 from its rest state. As a result, conductive elements 902 and 504 have been deflected in opposite directions such that the distance between the distal-most portions of their respective tips has increased. Such an increased distance between the tips, moving both tips away from the centerline of the mated conductive elements, reduces that chance that variations in the manufacture or positioning of the connectors during mating will result in the stubbing of conductive elements 902 and 504. Rather, the tapered lead-in portions of conductive elements 902 and 504 will ride along each other as the connectors are pressed together.

Figure 11E:
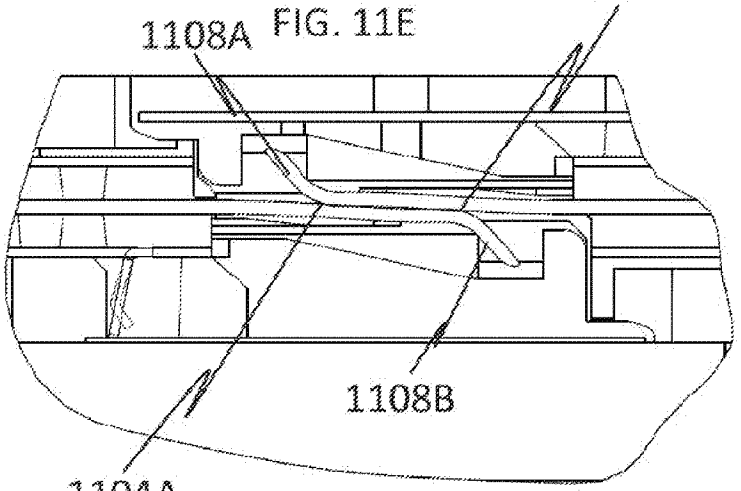

Connectors 200 and 700 may be further pressed together in the mating direction until they reach the state illustrated in FIG. 11E. In this state, the conductive element 504 of the right angle connector 200 and conductive elements 902 of the header connector 400 have disconnected from the preload features 512A and 512B, and make contact with each other. Each conductive element is further deflected relative to the state in FIG. 11D when they are engaged with respective preload features 512A or 512B. In this state, the convex contact surface of each conductive element presses against a contact surface, which may be flat, of the mating conductive element.

Figure 11F:
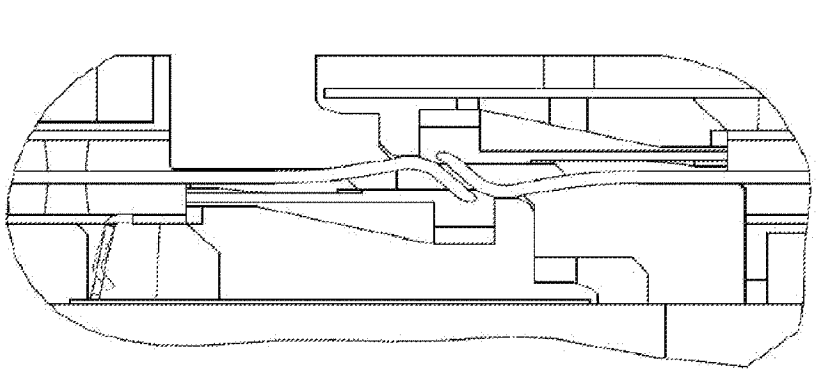
Figure 11G:
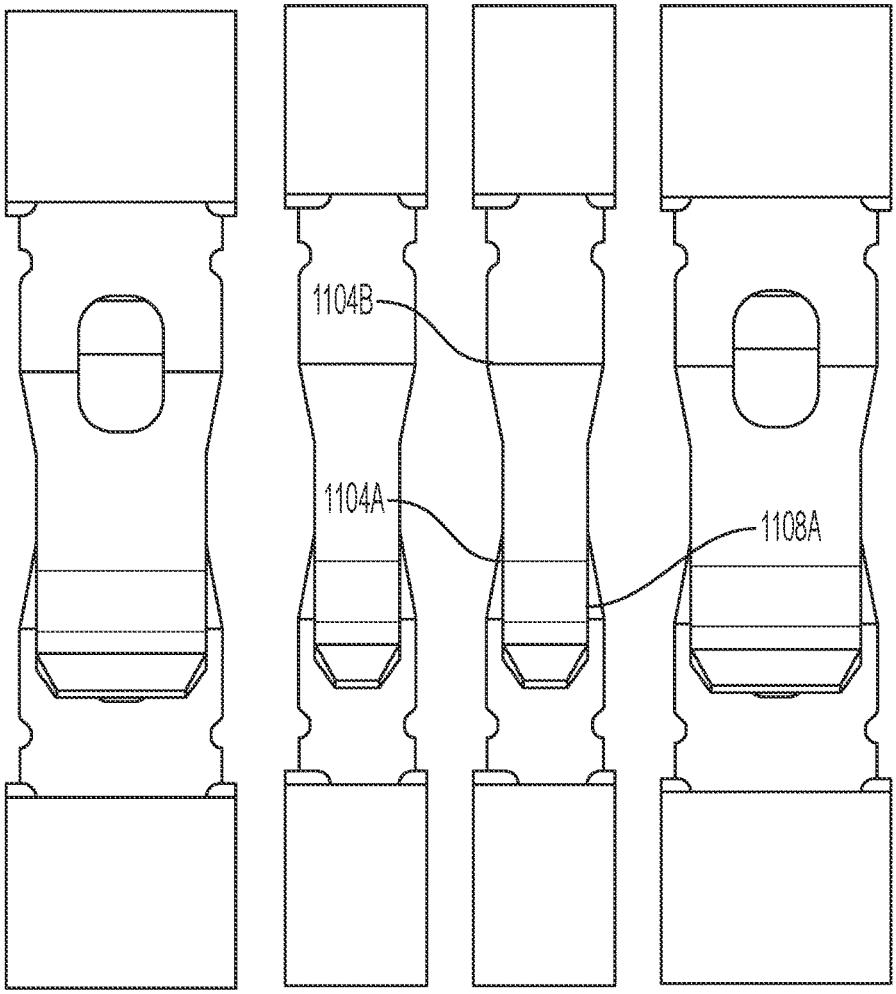
FIG. 11G is an enlarged partial plan view of the mated connectors of FIG. 1A along the line marked "11G" in FIG. 11A, according to some embodiments.

Connectors 200 and 700 may be further pressed together in the mating direction until they reach the state illustrated in FIG. 11F. In this state, the conductive element 504 of the right angle connector 200 and conductive elements 902 of the header connector 400 may be in a fully-mated condition and make contact with each other at locations 1104A and 1104B. The locations 1104A and 1104B may be at an apex of the convex surface of the contact portions 1106. The configuration may enable a connector to have a smaller wipe length for a contact portion (e.g., contact portion 1106) before reaching a respective contact location (e.g., locations

1104A, 1104B), such as less than 2.5 mm, and may be approximately 1.9 mm, for example.

Each of the conductive elements has an unterminated portion, 1108A and 1108B, respectively, extending beyond its respective contact location 1104A and 1104B. This unterminated portion may form a stub, which can support a resonance. But, as the stub is short, that resonance may be higher than the operating frequency range of the connector, such as above 35 GHz or above 56 GHz. The unterminated portions 1108A and 1108B, may have a length, for example, in the range of 0.02 mm and 2 mm and any suitable value in between, or in the range of 0.1 mm and 1 mm and any suitable value in between, or less than 0.8 mm, or less than 0.5 mm, or less than 0.1 mm.

Although details of specific configurations of conductive elements, housings, and shield members are described above, it should be appreciated that such details are provided solely for purposes of illustration, as the concepts disclosed herein are capable of other manners of implementation. In that respect, various connector designs described herein may be used in any suitable combination, as aspects of the present disclosure are not limited to the particular combinations shown in the drawings.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. As a specific example of a possible variation, the connector may be configured for a frequency range of interest, which may depend on the operating parameters of the system in which such a connector is used, but may generally have an upper limit between about 15 GHz and 224 GHz, such as 25 GHz, 30 GHz, 40 GHz, 56 GHz, 112 GHz, or 224 GHz, although higher frequencies or lower frequencies may be of interest in some applications. Some connector designs may have frequency ranges of interest that span only a portion of this range, such as 1 to 10 GHz or 5 to 35 GHz or 56 to 112 GHz.

The operating frequency range for an interconnection system may be determined based on the range of frequencies that can pass through the interconnection with acceptable signal integrity. Signal integrity may be measured in terms of a number of criteria that depend on the application for which an interconnection system is designed. Some of these criteria may relate to the propagation of the signal along a single-ended signal path, a differential signal path, a hollow waveguide, or any other type of signal path. Two examples of such criteria are the attenuation of a signal along a signal path or the reflection of a signal from a signal path.

Other criteria may relate to interaction of multiple distinct signal paths. Such criteria may include, for example, near end cross talk, defined as the portion of a signal injected on one signal path at one end of the interconnection system that is measurable at any other signal path on the same end of the interconnection system. Another such criterion may be far end cross talk, defined as the portion of a signal injected on one signal path at one end of the interconnection system that is measurable at any other signal path on the other end of the interconnection system.

As specific examples, it could be required that signal path attenuation be no more than 3 dB power loss, reflected power ratio be no greater than -20 dB, and individual signal path to signal path crosstalk contributions be no greater than -50 dB. Because these characteristics are frequency dependent, the operating range of an interconnection system is defined as the range of frequencies over which the specified criteria are met.

Designs of an electrical connector are described herein that improve signal integrity for high frequency signals, such as at frequencies in the GHz range, including up to about 25 GHz or up to about 40 GHz, up to about 56 GHz or up to about 60 GHz or up to about 75 GHz or up to about 112 GHz or higher, while maintaining high density, such as with a spacing between adjacent mating contacts on the order of 3 mm or less, including center-to-center spacing between adjacent contacts in a column of between 1 mm and 2.5 mm or between 2 mm and 2.5 mm, for example. Spacing between columns of mating contact portions may be similar, although there is no requirement that the spacing between all mating contacts in a connector be the same.

Manufacturing techniques may also be varied. For example, embodiments are described in which the daughtercard connector 200 is formed by organizing a plurality of wafers onto a stiffener. It may be possible that an equivalent structure may be formed by inserting a plurality of shield pieces and signal receptacles into a molded housing.

Connector manufacturing techniques were described using specific connector configurations as examples. A header connector, suitable for mounting on a backplane, and a right angle connector, suitable for mounting on a daughter card to plug into the backplane at a right angle, was illustrated for example. The techniques described herein for forming mating and mounting interfaces of connectors are applicable to connectors in other configurations, such as backplane connectors, cable connectors, stacking connectors, mezzanine connectors, I/O connectors, chip sockets, etc.

In some embodiments, contact tails were illustrated as press fit "eye of the needle" compliant sections that are designed to fit within vias of printed circuit boards. However, other configurations may also be used, such as surface mount elements, solderable pins, etc., as aspects of the present disclosure are not limited to the use of any particular mechanism for attaching connectors to printed circuit boards.

The present disclosure is not limited to the details of construction or the arrangements of components set forth in the foregoing description and/or the drawings. Various embodiments are provided solely for purposes of illustration, and the concepts described herein are capable of being practiced or carried out in other ways. Also, the phraseology and terminology used herein are for the purpose of description and should not be regarded as limiting. The use of "including," "comprising," "having," "containing," or "involving," and variations thereof herein, is meant to encompass the items listed thereafter (or equivalents thereof) and/or as additional items.

What is claimed is:

1. A connector housing for holding a plurality of connector modules, each module comprising a plurality of conductive elements, the connector housing comprising:

at least one support member of a first material; and a portion of a second material different from the first material, the portion of the second material comprising a plurality of openings configured to hold the plurality of connector modules, wherein the second material encapsulates the at least one support member.

2. The connector housing of claim 1, wherein
the first material is a metal.

3. The connector housing of claim 1, wherein
the second material encapsulates the at least one support member such that the at least one support member is isolated from the conductive elements of the connector modules.

4. The connector housing of claim 1, wherein
the at least one support member comprises one or more holes filled with the second material.

5. The connector housing of claim 1, wherein
the at least one support member comprises a flange and an elongated member, and
the portion of the second material comprises an outer wall encapsulating the flange and an inner wall encapsulating the elongated member.

6. The connector housing of claim 5, wherein
the portion of the second material comprises a feature configured to mate with a matching feature of a connector housing of a mating connector, and
the feature comprises the flange of the at least one support member.

7. The connector housing of claim 5, wherein
the portion of the second material comprises a plurality of inner walls separated by a plurality of second openings configured to receive a plurality of connector modules of a mating connector.

8. An electrical connector comprising:
a plurality of connector modules, each module comprising a plurality of conductive elements, each conductive element comprising a mating end, a mounting end opposite the mating end, and an intermediate portion extending between the mating end and the mounting end; and
a housing comprising at least one support member of a first material and a second material overmolded on the at least one support member, the second material comprising a plurality of inner walls bounding a plurality of openings, wherein the mating ends of the plurality of conductive elements of the plurality of connector modules are exposed with the openings.

9. The electrical connector of claim 8, wherein
the at least one support member is isolated from the conductive elements of the connector modules by the second material.

10. The electrical connector of claim 8, wherein
the at least one support member comprises first and second flanges and an elongated member extending between the first flange and the second flange, and
the second material comprises first and second outer walls encapsulating the first and second flanges respectively and an inner wall of the plurality of inner walls encapsulating the elongated member.

11. The electrical connector of claim 8, wherein
each of the plurality of connector modules comprises one or more leadframe assemblies and a core member,
each leadframe assembly comprises at least a portion of the plurality of conductive elements disposed in a column, and
the one or more leadframe assemblies are attached to one or more sides of the core member.

12. The electrical connector of claim 11, wherein
the plurality of inner walls extend in a first direction;
the core member comprises a body and a mating portion adjacent the mating ends of the conductive elements of the one or more leadframe assemblies attached to the core member; and
the mating portions of the core member comprise projections extending in a direction perpendicular to the first direction.

13. A method of manufacturing a connector, the method comprising:
providing at least one support member held to a carrier strip by at least one tie bar;
molding a material over the at least one support member in a mold having a first opening/closing direction, wherein the over molded material comprising a housing of the connector with at least one opening extending in a first direction through the housing parallel to the first opening/closing direction;
severing the at least one tie bar; and
attaching a connector module to the housing, wherein the connector module comprises a plurality of conductive elements with mating contact portions and the mating contact portions are exposed in an opening of the at least one opening.

14. The method of claim 13, wherein providing the support member comprises stamping and bending a metal sheet.

15. The method of claim 13, wherein molding the material over the at least one support member comprises
filling the material into holes of a support member of the at least one support member.

16. The method of claim 13, further comprising:
molding a core member of the connector module in a mold having a second opening/closing direction such that the core member comprises a body and features extending from the body in a second direction parallel to the second opening/closing direction and orthogonal to the first direction.

17. The method of claim 16, further comprising:
attaching one or more leadframe assemblies to the core member with contact portions of conductive elements of the one or more leadframe assemblies adjacent the features of the core member.

18. The method of claim 16, wherein
the housing comprises a channel extending in the first direction and inserting the connector module comprises sliding projecting portions of the core member in the channel.

19. The method of claim 16, wherein molding the core member comprises
molding a lossy material over a shield.

20. The method of claim 19, wherein
the lossy material forms at least a portion of the features extending in the second direction.

* * * * *